US008720332B2

(12) United States Patent
Sato et al.

(10) Patent No.: US 8,720,332 B2
(45) Date of Patent: May 13, 2014

(54) CYLINDER THROW-ON/OFF APPARATUS AND CYLINDER THROW-ON/OFF METHOD FOR PRINTING PRESS

(75) Inventors: Toshiyuki Sato, Ibaraki (JP); Toshihiro Kobashi, Ibaraki (JP)

(73) Assignee: Komori Corporation, Tokyo (JP)

( * ) Notice: Subject to any disclaimer, the term of this patent is extended or adjusted under 35 U.S.C. 154(b) by 1092 days.

(21) Appl. No.: 12/283,879

(22) Filed: Sep. 16, 2008

(65) Prior Publication Data

US 2009/0090258 A1 Apr. 9, 2009

(30) Foreign Application Priority Data

Sep. 19, 2007 (JP) ..... 2007-242906

(51) Int. Cl.
*B41F 9/10* (2006.01)

(52) U.S. Cl.
USPC ..... 101/144; 101/145

(58) Field of Classification Search
USPC ..... 101/143–145, 218, 247, 283–285
See application file for complete search history.

(56) References Cited

U.S. PATENT DOCUMENTS

| | | | | | |
|---|---|---|---|---|---|
| 3,146,705 | A * | 9/1964 | Ritzerfeld et al. | ..... | 101/144 |
| 3,552,313 | A * | 1/1971 | Jeschke | ..... | 101/218 |
| 3,593,662 | A * | 7/1971 | Gates | ..... | 101/218 |
| 4,976,197 | A * | 12/1990 | Yamanari et al. | ..... | 101/137 |
| 5,142,981 | A * | 9/1992 | Dettinger et al. | ..... | 101/248 |
| 5,272,975 | A * | 12/1993 | Dettinger et al. | ..... | 101/218 |
| 5,588,362 | A * | 12/1996 | Sugiyama et al. | ..... | 101/218 |
| 6,019,039 | A * | 2/2000 | Knauer et al. | ..... | 101/218 |
| 6,213,016 | B1 * | 4/2001 | Tsunashima | ..... | 101/218 |
| 2002/0139261 | A1 * | 10/2002 | Tokiwa | ..... | 101/218 |
| 2003/0066450 | A1 * | 4/2003 | Senoo et al. | ..... | 101/425 |
| 2005/0155503 | A1 * | 7/2005 | Onuma et al. | ..... | 101/177 |
| 2005/0188867 | A1 * | 9/2005 | Hirt et al. | ..... | 101/352.01 |
| 2008/0148980 | A1 * | 6/2008 | Ollivier et al. | ..... | 101/484 |
| 2008/0229954 | A1 * | 9/2008 | Saito et al. | ..... | 101/425 |
| 2008/0236421 | A1 * | 10/2008 | Ito | ..... | 101/217 |

FOREIGN PATENT DOCUMENTS

| | | | | |
|---|---|---|---|---|
| JP | 07-299897 | | 11/1995 | |
| JP | 07-299897 | A | 11/1995 | |
| JP | 2003-048309 | | 2/2003 | |
| JP | 2003205598 | A * | 7/2003 | ..... B41F 33/08 |

OTHER PUBLICATIONS

"Improvement in Paper Waste Reduction and Printing Quality in a New Style Sheet-Fed Press"; New Daiya; vol. 39, No. 4, Jul. 2002.

* cited by examiner

*Primary Examiner* — David Banh
(74) *Attorney, Agent, or Firm* — Blakely Sokoloff Taylor & Zafman

(57) ABSTRACT

In a cylinder throw-on/off apparatus for a printing press, a cylinder throw-on/off motor is driven while the notch of a blanket cylinder opposes the notch of a plate cylinder to throw on/off the blanket cylinder with respect to the plate cylinder, and driven while the notch of the blanket cylinder opposes the notch of an impression cylinder to throw on/off the blanket cylinder with respect to the impression cylinder. A throw-on operation control unit drives the cylinder throw-on/off motor, to control throw-on operation of the blanket cylinder for the plate cylinder and the impression cylinder. A motor drive amount calculation unit obtains a drive amount of the cylinder throw-on/off motor, while controlling the throw-on operation of the blanket cylinder, in accordance with the rotation phase of the printing press.

12 Claims, 43 Drawing Sheets

CYLINDER THROW-ON/OFF APPARATUS AND CYLINDER THROW-ON/OFF METHOD FOR PRINTING PRESS

BACKGROUND OF THE INVENTION

The present invention relates to a cylinder throw-on/off apparatus and cylinder throw-on/off method for a printing press, in which throwing-on/off operation (impression throw-on/off) of a blanket cylinder with respect to a plate cylinder or impression cylinder is performed in a printing press such as an offset rotary printing press.

Conventionally, as a cylinder throw-on/off apparatus of this type, one disclosed in Japanese Patent Laid-Open No. 7-299897 (reference 1) is available. In the cylinder throw-on/off apparatus described in reference 1, an electric motor (stepping motor) is used as a drive source to pivot an eccentric bearing, and a blanket cylinder axially supported by the eccentric bearing is thrown on/off with respect to a plate cylinder and impression cylinder.

FIG. 13 is a side view of the main part of an offset rotary printing press described in reference 1. As shown in FIG. 14, the offset rotary printing press comprises a plate cylinder 1, blanket cylinder 2, and impression cylinder 3 for each printing unit 10. A printing plate (plate) is mounted on the plate cylinder 1. During printing, the blanket cylinder 2 is in contact with the plate cylinder 1. A blanket is mounted on the outer surface of the blanket cylinder 2. During printing, the blanket cylinder 2 is brought into contact with the impression cylinder 3 through a printing target sheet (not shown). The plate cylinder 1, blanket cylinder 2, and impression cylinder 3 constitute a printing section 31.

In such a conventional offset rotary printing press, a stepping motor serving as a cylinder throw-on/off motor 6 is fixed to a stud 5, close to the end shaft of the impression cylinder 3 and projecting outward from one frame 4, such that a drive rod 7 extends upright. When the cylinder throw-on/off motor 6 rotates, the drive rod 7 moves forward/backward vertically to pivot an eccentric bearing 8, so that throwing-on/off operation (impression throw-on/off) of the blanket cylinder 2 with respect to the plate cylinder 1 and impression cylinder 3 is performed.

During impression throw-on, the throw-on operation of the plate cylinder 1 for the blanket cylinder 2 takes place within a range excluding the printing ranges of the two cylinders, i.e., within the range of an angle θ1 shown in FIG. 15A, where notches P and B, indicated by reference symbols BC and PC, which are the notches (portions where a plate clamp, blanket fixing device, and the like are provided) of the plate cylinder 1 and blanket cylinder 2, respectively, are in contact with each other, so the film thickness of the ink applied to the plate will not be adversely affected.

Similarly, during impression throw-on, the throw-on operation of the blanket cylinder 2 for the impression cylinder 3 takes place within a range excluding the printing ranges of the two cylinders, i.e., within the range of an angle θ2 shown in FIG. 15B, where notches B and I, indicated by reference symbols BC and IC, which are the notches (portions where a blanket fixing device, a mechanism which holds a printing target sheet, and the like are provided) of the blanket cylinder 2 and impression cylinder 3, respectively, are in contact with each other, so the film thickness of the ink transferred onto the blanket on the blanket cylinder 2 will not be adversely affected and that the outer surface of the impression cylinder 3 will not be contaminated with the ink.

After impression throw-on takes place in this manner, when sheet feed is started, the image transferred from the plate on the plate cylinder 1 onto the blanket on the blanket cylinder 2 is transferred to a sheet 9 passing between the blanket cylinder 2 and impression cylinder 3, thus performing printing. When the printing operation is finished, the throw-off operation of the blanket cylinder 2 from the impression cylinder 3 takes place at the impression throw-on timing described above, i.e., within the range of the angle θ2 where the notches B and I are in contact with each other, and the throw-off operation of the blanket cylinder 2 from the plate cylinder 1 takes place at the impression throw-on timing described above, i.e., within the range of the angle θ1 where the notches P and B are in contact with each other.

According to reference 1, the speeds of the printing press during impression throw-on and impression throw-off are determined to be constant. The throw-on/off operation of the blanket cylinder 2 with respect to the plate cylinder 1 and impression cylinder 3 is performed in accordance with the predetermined operation patterns (a curve representing the relationship between the rotation phase of the printing press and the drive amount of the cylinder throw-on/off motor) of the cylinder throw-on/off motor.

[Impression Throw-on (Throw-on Operation)]

In order to suppress the influence of the impact caused by impression throw-on, the slower motion speed is determined as the speed of the printing press during impression throw-on, and sheet feed is performed by setting the speed of the printing press at a constant slower motion speed. When the rotation phase of the printing press reaches an impression throw-on start phase, the operation pattern of the cylinder throw-on/off motor is loaded, and the throw-on operation (impression throw-on) of the blanket cylinder 2 for the plate cylinder 1 and impression cylinder 3 is performed. This impression throw-on is performed sequentially by starting from the upstream printing unit 10 (10-1). When impression throw-on of the last printing unit (10-4) is completed, the speed of the printing press is accelerated to the printing speed.

[Impression Throw-Off (Throw-Off Operation)]

In order to suppress the influence of the impact caused by impression throw-off, the slower motion speed is determined as the speed of the printing press during impression throw-off. When stopping the printing press, the printing press is decelerated from the printing speed to the slower motion speed. At a constant slower motion speed, when the rotation phase of the printing press reaches an impression throw-off start phase, the operation pattern of the cylinder throw-on/off motor is loaded, and the throw-off operation (impression throw-off) of the blanket cylinder 2 from the plate cylinder 1 and impression cylinder 3 is performed. This impression throw-off is performed sequentially by starting from the upstream printing unit 10 (10-1). When impression throw-off of the last printing unit (10-4) is completed, the printing press is stopped.

With the conventional cylinder throw-on/off apparatus described above, impression throw-on/off is performed after setting the speed of the printing press at, e.g., a constant slower motion speed. It takes time until printing at the printing speed is actually started. It also takes time until the printing press is stopped. This degrades the operation rate of the printing press. The degradation of the operation rate, i.e., the time loss, increases as the number of printing units increases.

In the conventional cylinder throw-on/off apparatus described above, the predetermined operation pattern of the cylinder throw-on/off motor is indicated by a curve representing the relationship between the rotation phase of the printing press and the drive amount of the cylinder throw-on/off motor. The throw-on/off operation of the blanket cylinder 2 with respect to the plate cylinder 1 and impression cylinder 3 is performed in accordance with the operation pattern of the cylinder throw-on/off motor. In this case, considering the fact that the speeds of the printing press during impression throw-on and impression throw-off are set constant, the impression throw-on/off operation of the blanket cylinder 2 with respect to the plate cylinder 1 and impression cylinder 3 would be performed only by plotting the axis of rotation phase of the printing press in the operation pattern of the cylinder throw-on/off motor along the time axis and reading the drive amount of the cylinder throw-on/off motor at every predetermined time interval.

SUMMARY OF THE INVENTION

It is an object of the present invention to provide a cylinder throw-on/off apparatus and cylinder throw-on/off method for a printing press, in which the time taken until printing at the printing speed is started or the time taken since the printing press is stopped is shortened, thus improving the operation rate of the printing press.

In order to achieve the above object, according to the present invention, there is provided a cylinder throw-on/off apparatus for a printing press, comprising at least one printing unit comprising a plate cylinder including a notch in an outer surface thereof, an impression cylinder including a notch in an outer surface thereof, and a blanket cylinder disposed between the plate cylinder and the impression cylinder and including a notch in an outer surface thereof, a cylinder throw-on/off motor which is driven while the notch of the blanket cylinder opposes the notch of the plate cylinder to throw on/off the blanket cylinder with respect to the plate cylinder, and driven while the notch of the blanket cylinder opposes the notch of the impression cylinder to throw on/off the blanket cylinder with respect to the impression cylinder, rotation phase detection means for detecting a rotation phase of the printing press, accelerating means for accelerating the printing press to a predetermined printing speed, throw-on operation control means for driving the cylinder throw-on/off motor, during or after acceleration to the printing speed, to control throw-on operation of the blanket cylinder for the plate cylinder and the impression cylinder, and motor drive amount calculation means for obtaining a drive amount of the cylinder throw-on/off motor, while controlling the throw-on operation of the blanket cylinder, in accordance with the rotation phase of the printing press detected by the rotation phase detection means.

DESCRIPTION OF THE PREFERRED EMBODIMENTS

The present invention will be described in detail with reference to the accompanying drawings.

[Principle of Present Invention]

Figure 1:
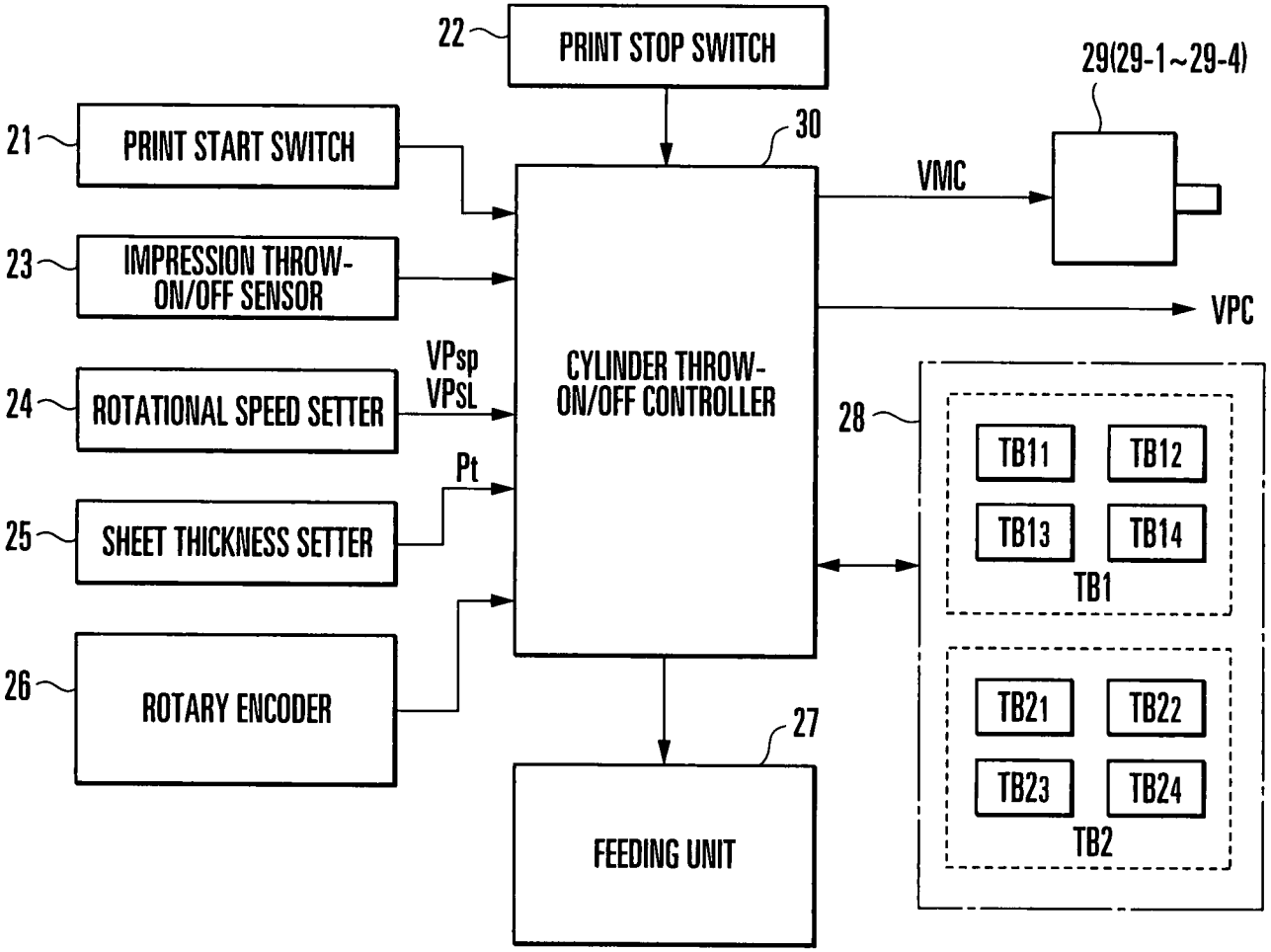
FIG. 1 is a block diagram of a cylinder throw-on/off apparatus for a printing press, which shows the principle of the present invention.

First, the principle of the present invention will be described with reference to FIGS. 1 to 3F. As shown in FIG. 1, a cylinder throw-on/off apparatus according to the present invention comprises a print start switch 21, print stop switch 22, impression throw-on sensor 23, rotational speed setter 24, sheet thickness setter 25, printing press rotation phase detection rotary encoder 26, feeding unit 27, storage unit 28, cylinder throw-on/off motor 29, and cylinder throw-on/off controller 30.

In the cylinder throw-on/off apparatus described above, the impression throw-on sensor 23 is provided midway along a convey path for a sheet fed from the feeding unit 27 to the printing press, and turned on when the first sheet from the feeding unit 27 reaches a predetermined position. The rotational speed setter 24 sets VPsp as the printing speed and $VP_{SL}$ as the slower motion speed. The sheet thickness setter 25 sets a thickness Pt of the sheet to be printed by the printing press. The rotary encoder 26 generates a 1-pulse clock signal every time the printing press rotates through a predetermined angle.

Figure 13:
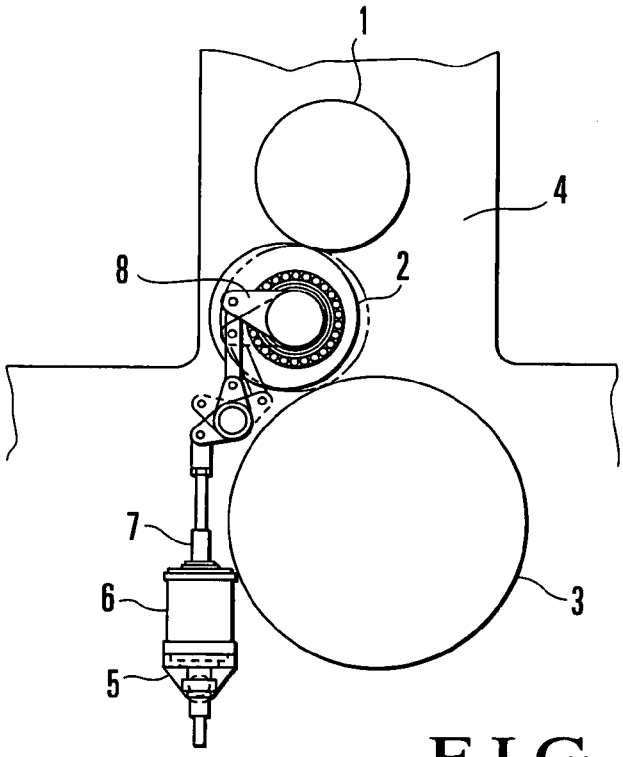
FIG. 13 PRIOR ART
FIG. 13 is a side view of the main part of a conventional offset rotary printing press.

The cylinder throw-on/off motor 29 corresponds to the motor 6 in FIG. 13 and is provided to each printing unit 10. In this example, the printing press is a four-color sheet-fed rotary printing press, and the printing units 10-1 to 10-4 of the respective colors are provided with the cylinder throw-on/off motors 29-1 to 29-4. Although the cylinder throw-on/off motors 29 (29-1 to 29-4) are stepping motors in this example, they are not necessary stepping motors.

The storage unit 28 stores, for each of the printing units 10 (10-1 to 10-4), curves (operation patterns during the throw-on operation) indicating the relationship between the rotation phase of the printing press and the drive amount of the cylinder throw-on/off motor during the throw-on operation in the form of reference rotation phase conversion tables TB1 ($TB1_1$ to $TB1_4$), and curves (operation patterns during the throw-off operation) indicating the relationship between the rotation phase of the printing press and the drive amount of the cylinder throw-on/off motor during the throw-off operation in the form of reference rotation phase conversion tables TB2 ($TB2_1$ to $TB2_4$).

Figure 2:
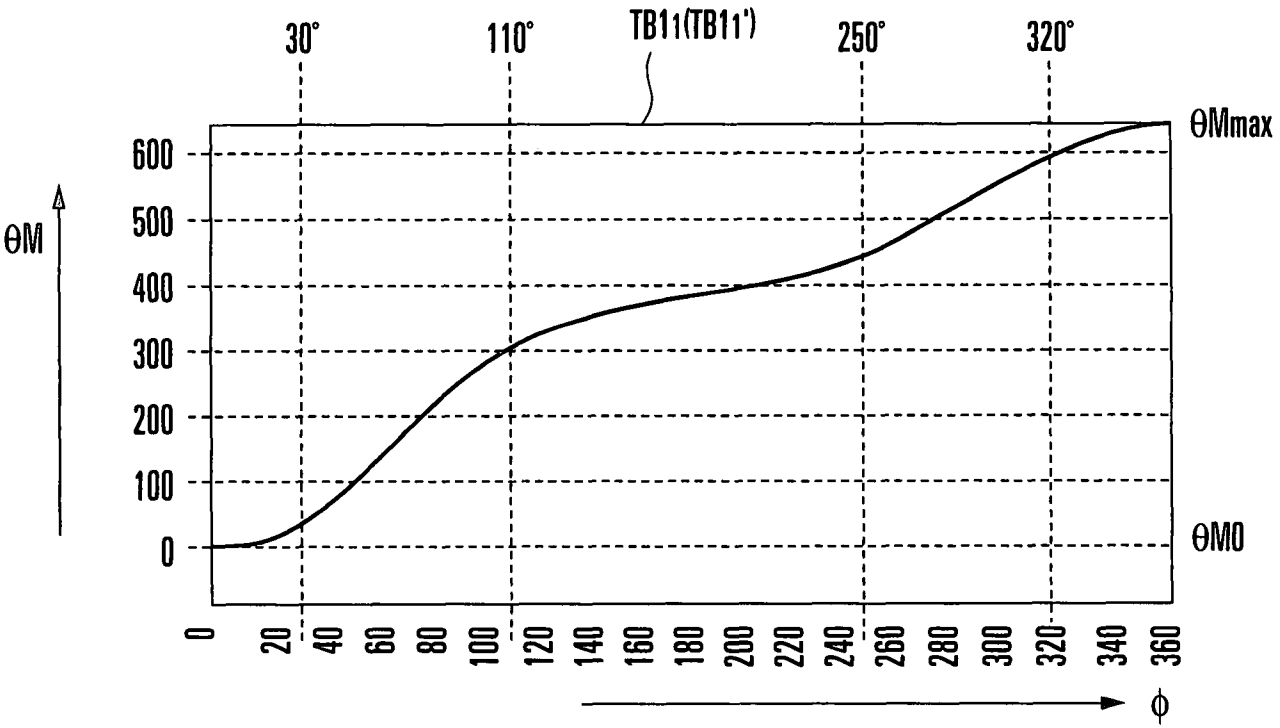
FIG. 2 is a graph showing an example of a reference rotation phase conversion table used in the cylinder throw-on/off apparatus shown in FIG. 1.
Figure 15A:
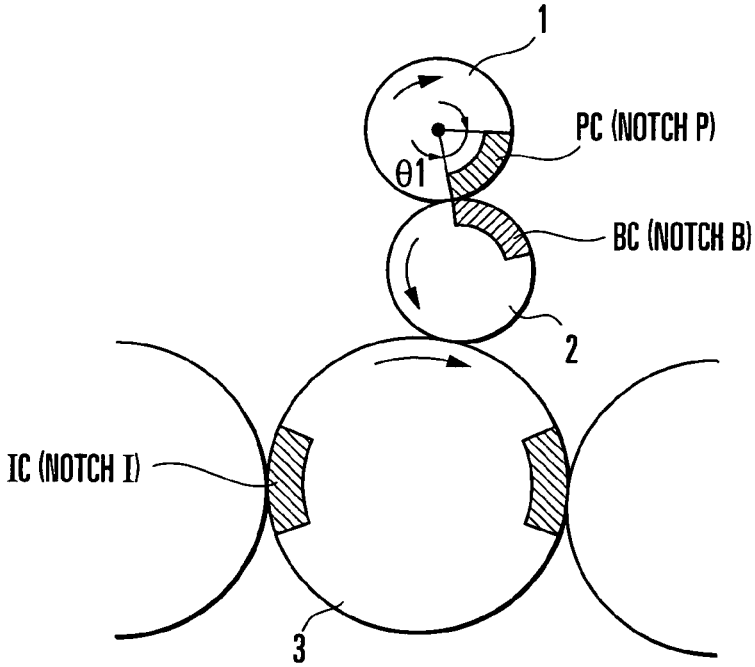
FIG. 15A PRIOR ART
FIGS. 15A and 15B are views showing the phases and timings of respective cylinders in impression throw-on in the conventional apparatus shown in FIG. 13.
Figure 15B:
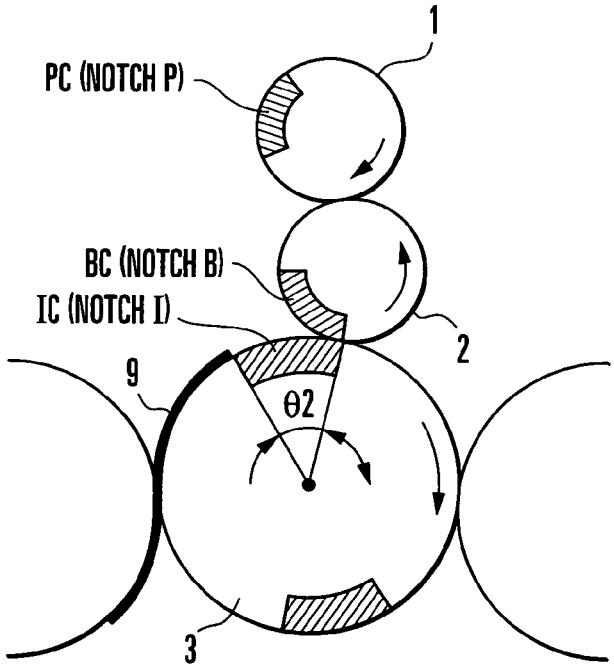
FIG. 15B PRIOR ART

In the reference rotation phase conversion table $TB1_1$ shown in FIG. 2, the axis of abscissa represents a rotation phase ϕ of the printing press, and the axis of ordinate represents a rotation phase θM of the cylinder throw-on/off motor. According to the present invention, the rotation phase θM of the cylinder throw-on/off motor 29-1 in the printing unit 10-1 is changed from θM0 to θMmax in accordance with this operation pattern. In this example, in the printing unit 10-1, a blanket cylinder 2 is thrown on a plate cylinder 1 when the rotation phase ϕ of the printing press falls between 30° to 110°, is moved from a position where it is completely thrown on the plate cylinder 1 to a position to start throw-on operation for an impression cylinder 3 when the rotation phase ϕ of the printing press falls between 110° to 250°, and is thrown on the impression cylinder 3 when the rotation phase ϕ of the printing press falls between 250° to 320°. In other words, the range of 30° to 110° in FIG. 2 corresponds to the angle θ1 at which the notch P of the plate cylinder 1 comes into contact with the notch B of the blanket cylinder 2 in FIG. 15A, and the range of 250° to 320° corresponds to the angle θ2 at which the notch B of the blanket cylinder 2 comes into contact with the notch I of the impression cylinder 3 in FIG. 15B.

The cylinder throw-on/off controller 30 is implemented by hardware comprising a processor and storage, and a program which cooperates with the hardware to realize various types of functions as the controller. FIGS. 3A to 3F show the processing operation performed by the cylinder throw-on/off controller 30. The processing operation of the cylinder throw-on/off controller 30 according to the present invention will be described hereinafter with reference to the flowcharts of FIGS. 3A to 3F.

When the print start switch 21 is turned on (YES in step S1), the cylinder throw-on/off controller 30 reads the sheet thickness Pt set through the sheet thickness setter 25 (step S2). The cylinder throw-on/off controller 30 reads out the reference rotation phase conversion tables $TB1_1$ to $TB1_4$, and $TB2_1$ to $TB2_4$ stored in the storage unit 28, and modifies the loaded reference rotation phase conversion tables $TB1_1$ to $TB1_4$ and $TB2_1$ to $TB2_4$ using the sheet thickness Pt to obtain rotation phase conversion tables $TB1_1'$ to $TB1_4'$ and $TB2_1'$ to $TB2_4'$ (steps S3 and S4). For example, concerning the reference rotation phase conversion table $TB1_1$ shown in FIG. 2, the value of the rotation phase θM of the cylinder throw-on/off motor on the axis of ordinate is modified in accordance with the sheet thickness Pt to obtain the reference rotation phase conversion table $TB1_1'$.

Then, the cylinder throw-on/off controller 30 sets N=1 (step S5) and sends a feed start instruction to the feeding unit 27 (step S6). Hence, the feeding unit 27 starts feeding sheets to the printing press. Simultaneously with the feed start instruction to the feeding unit 27, the cylinder throw-on/off controller 30 causes a timer T to start counting from zero (step S7). In this case, the cylinder throw-on/off controller 30 advances to step S14 until the timer count of the timer T reaches a control time interval TC. When the timer count T of the timer T reaches the control time interval TC, the cylinder throw-on/off controller 30 advances to step S9.

In step S14, it is checked whether or not the impression throw-on sensor 23 is ON. When the feeding unit 27 starts feeding the sheets to the printing press, the impression throw-on sensor 23 is not ON yet (NO in step S14), and accordingly the cylinder throw-on/off controller 30 advances to step S15. In step S15, it is checked whether or not a current impression throw-on/off rotation phase ϕD (to be described later) is equal to or more than a first-color impression throw-on start rotation phase $\phi DI_{ST1}$. Since $\phi D<\phi DI_{ST1}$ is still maintained (NO in step S15), the cylinder throw-on/off controller 30 returns to step S8 to continue counting with the timer T.

When T=TC is satisfied in step S8, a predetermined rotational speed modification value Δα for acceleration is added to an instruction rotational speed VPC for the printing press to obtain a new instruction rotational speed VPC (step S9). Note that the initial value of the instruction rotational speed VPC is zero.

Upon confirmation of the fact that the instruction rotational speed VPC for the printing press has not reached a printing speed VPsp yet (NO in step S10), the cylinder throw-on/off controller 30 outputs the instruction rotational speed VPC for the printing press (step S12). Hence, the printing press starts rotation at the instruction rotational speed VPC, that is, at Δα.

After outputting the instruction rotational speed VPC for the printing press (step S12), the cylinder throw-on/off controller 30 stores the output instruction rotational speed VPC as a previous instruction rotational speed VPCold (step S13), and returns to step S7. By repeating this processing operation, the speed of the printing press increases as the instruction rotational speed VPC increases by Δα in each control time interval TC.

In repeating this processing operation, when the first sheet from the feeding unit 27 reaches the predetermined position and the impression throw-on sensor 23 is turned on (YES in step S14), the cylinder throw-on/off controller 30 starts counting the impression throw-on/off rotation phase ϕD from zero (step S16). More specifically, the cylinder throw-on/off controller 30 sets the impression throw-on/off rotation phase ϕD at this time to zero, counts clock signals from the rotary encoder 26, and obtains the impression throw-on/off rotation phase ϕD from the count.

[Impression Throw-on in First-Color Printing Unit]

Figure 3A:
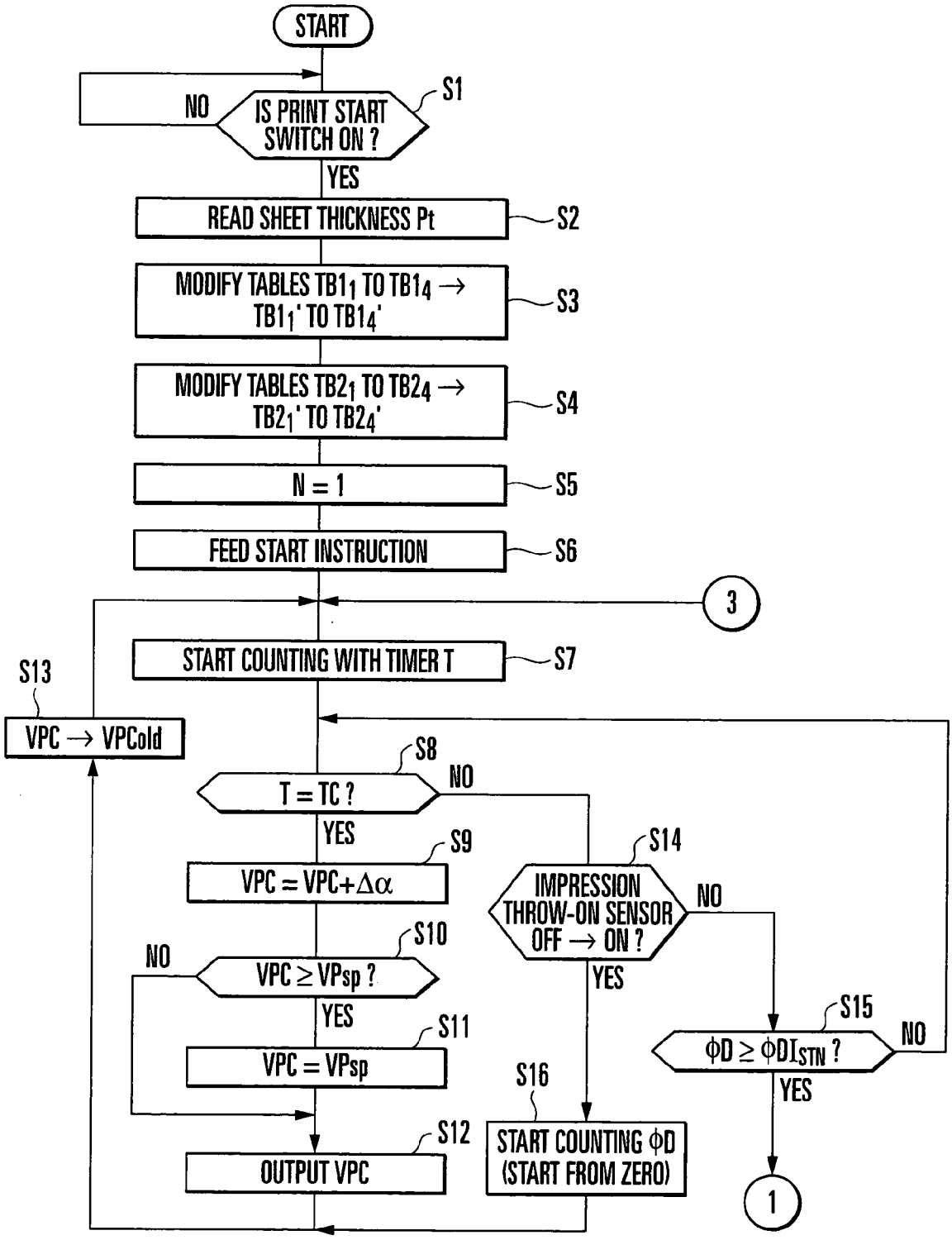
FIGS. 3A to 3F are flowcharts showing processing operation performed by the CPU of the cylinder throw-on/off apparatus shown in FIG. 1.
Figure 3B:
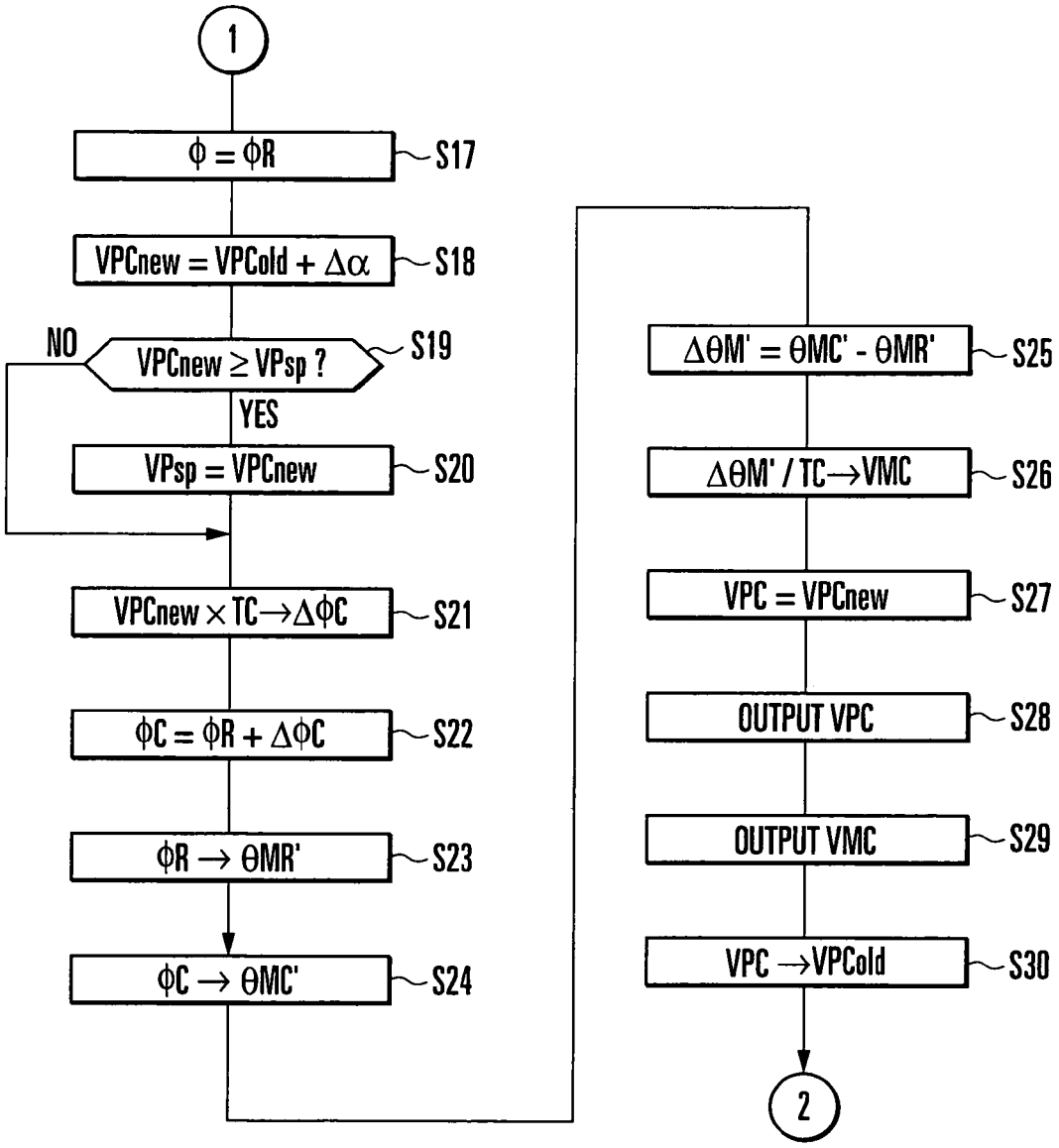

When the impression throw-on/off rotation phase ϕD becomes equal to or more than the first-color impression throw-on start rotation phase $\phi DI_{ST1}$ (YES in step S15), the cylinder throw-on/off controller 30 determines the rotation phase ϕ of the printing press at this time as a current rotation phase ϕR of the printing press (step S17 in FIG. 3B).

The rotation phase ϕ of the printing press is counted by counting the clock signals from the rotary encoder 26 while resetting the count each time the printing press reaches the home position. Note that at the impression throw-on start rotation phase $\phi DI_{ST1}$, the rotation phase ϕ of the printing press is set to 0°.

Subsequently, the cylinder throw-on/off controller 30 adds the rotational speed modification value Δα to the previous instruction rotational speed VPCold to obtain a modified instruction rotational speed VPCnew (step S18). Upon confirmation of the fact that the modified instruction rotational speed VPCnew has not reached the printing speed VPsp yet (NO in step S19), the cylinder throw-on/off controller 30 multiplies the modified instruction rotational speed VPCnew by the control time interval TC to obtain a rotation phase ΔϕC for which the printing press is to advance until the next control (step S21). The cylinder throw-on/off controller 30 also adds the rotation phase ΔϕC, for which the printing press is to advance until the next control, to the current rotation phase ϕR of the printing press to obtain an expected rotation phase ϕC of the printing press for the next control (step S22).

The rotation phase θM of the cylinder throw-on/off motor corresponding to the current rotation phase θR of the printing press is obtained as θMR' from the rotation phase conversion table $TB1_1$ (step S23). Also, the rotation phase θM of the cylinder throw-on/off motor corresponding to the expected rotation phase $\phi C$ of the printing press for the next control is obtained as $\theta MC'$ from the rotation phase conversion table $TB1_1$ (step S24).

The rotation phase $\theta MR'$ of the cylinder throw-on/off motor corresponding to the current rotation phase $\phi R$ of the printing press is subtracted from the rotation phase $\theta MC'$ of the cylinder throw-on/off motor corresponding to the expected rotation phase $\phi C$ of the printing press for the next control to obtain a rotation phase $\Delta\theta M'$ for which the cylinder throw-on/off motor 29-1 in the printing unit 10-1 is to advance until the next control (step S25). This $\Delta\theta M'$ is divided by the control time interval TC to obtain an instruction rotational speed $VMC_1$ for the cylinder throw-on/off motor 29-1 (step S26). This instruction rotational speed $VMC_1$ represents the drive amount of the cylinder throw-on/off motor 29-1 until the next control.

The cylinder throw-on/off controller 30 outputs the instruction rotational speed VPCnew modified in step S18 as the instruction rotational speed VPC for the printing press (steps S27 and S28) and the instruction rotational speed $VMC_1$ for the cylinder throw-on/off motor 29-1 obtained in step S26 as an instruction rotational speed for the current control (step S29). In this case, the output instruction rotational speed VPC is stored as the previous instruction rotational speed VPCold (step S30).

Figure 3C:
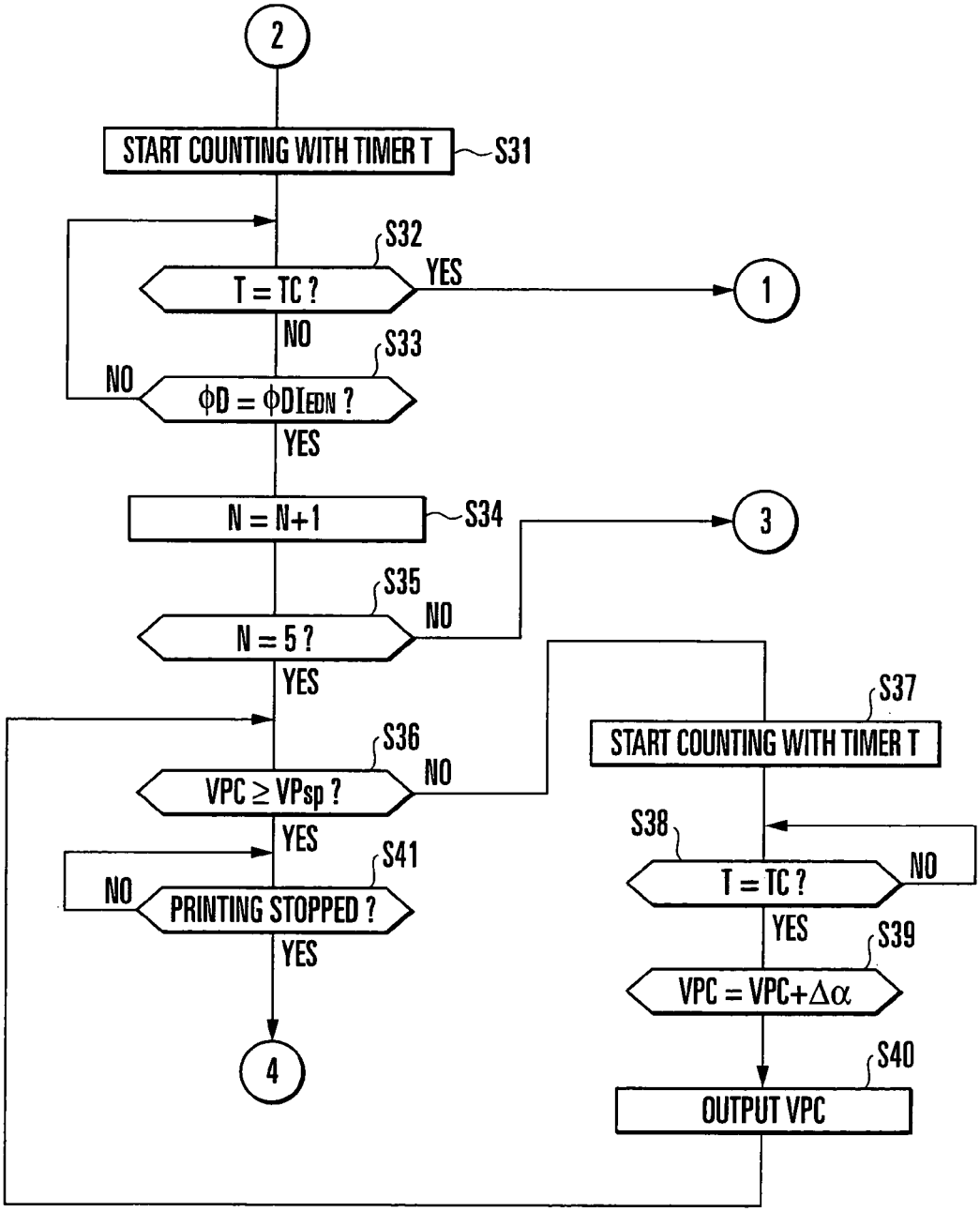
Figure 3D:
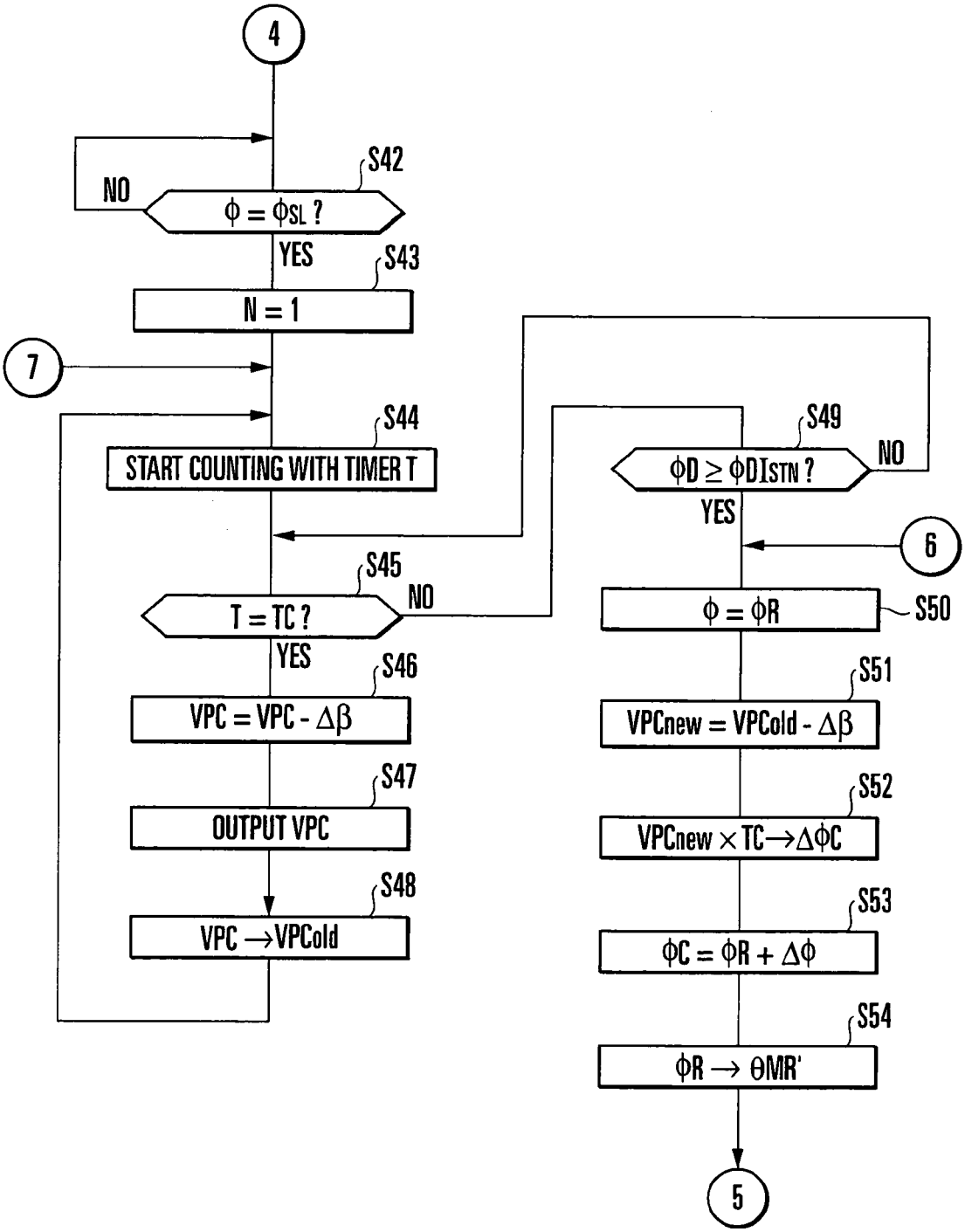
Figure 3E:
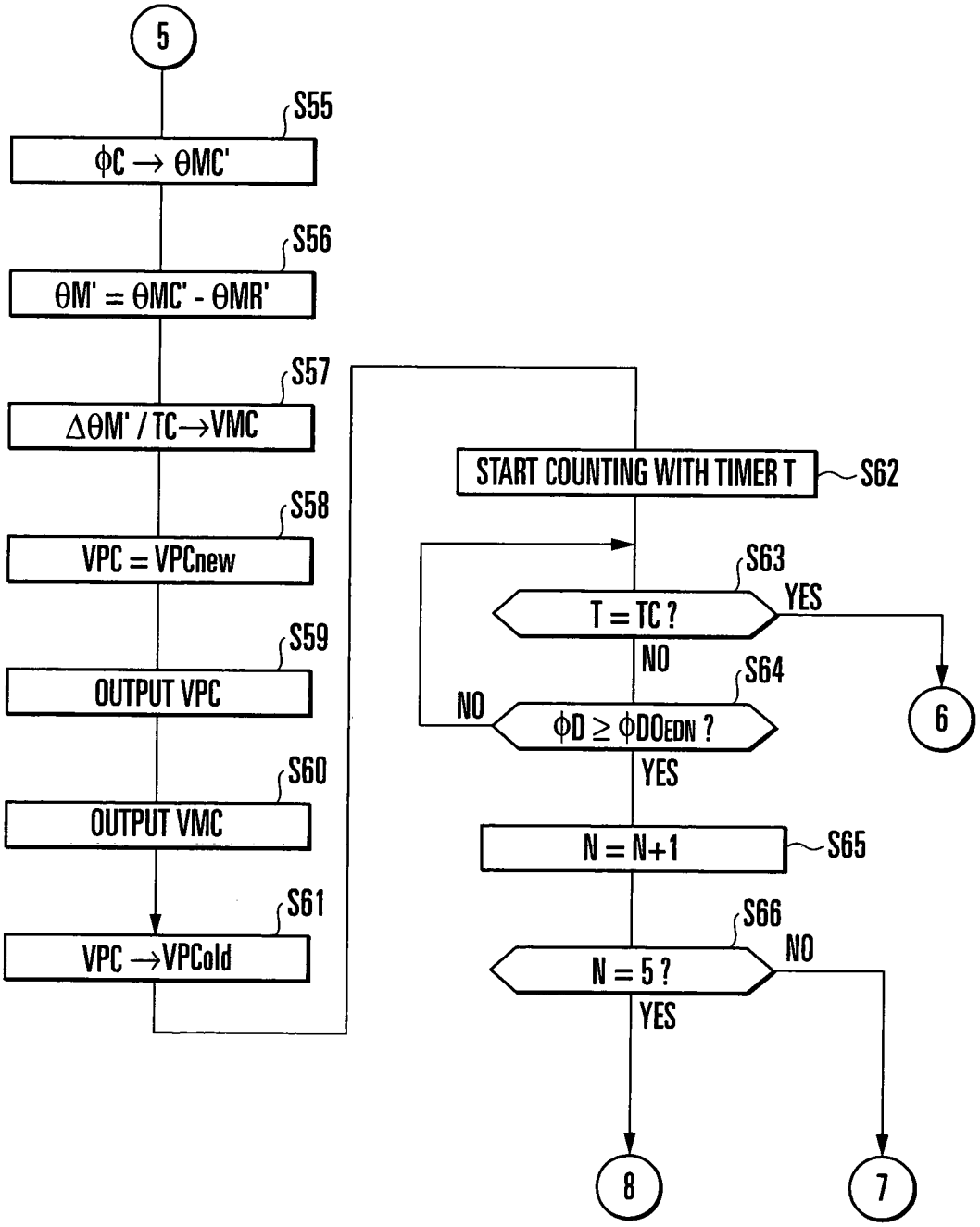

Then, the cylinder throw-on/off controller 30 starts counting with the timer T from zero (step S31 in FIG. 3C). The cylinder throw-on/off controller 30 advances to step S33 until the timer count of the timer T reaches the control time interval TC, and returns to step S17 when the timer count of the timer T reaches the control time interval TC (FIG. 3B).

In step S33, it is checked whether or not the impression throw-on/off rotation phase $\phi D$ becomes equal to or more than a first-color impression throw-on completion rotation phase $\phi DI_{ED1}$. In this case, since the impression throw-on/off rotation phase $\phi D$ still satisfies $\phi D<\phi DI_{ED1}$ (NO in step S33), the cylinder throw-on/off controller 30 returns to step S32 to continue counting with the timer T. When T=TC is achieved (YES in step S32), the cylinder throw-on/off controller 30 returns to step S17 (FIG. 3B), and repeats the processing operation of steps S17 to S33.

Therefore, the speed of the printing press is increased while the instruction rotational speed VPC is increased by $\Delta\alpha$ in each control time interval TC. During this acceleration of the printing press, the cylinder throw-on/off motor 29-1 of the first-color printing unit 10-1 rotates in each control time interval TC at the instruction rotational speed $VMC_1$ obtained in accordance with the current rotation phase $\phi R$ of the printing press. Thus, in the first-color printing unit 10-1, impression throw-on is performed with an appropriate operation pattern to follow a change in speed of the printing press (the changing speed of the rotation phase of the printing press).

[Impression Throw-on in Second-, Third-, and Fourth-Color Printing Units]

When the impression throw-on/off rotation phase $\phi D$ becomes equal to or more than the first-color impression throw-on completion rotation phase $\phi DI_{ED1}$ (YES in step S33), the cylinder throw-on/off controller 30 sets N=N+1=2 (step S34), and repeats the processing operation of steps S7 to S35 until N=5 is set (YES in step S35). Thus, in the second-, third-, and fourth-color printing units 10-2, 10-3, and 10-4 as well, impression throw-on is performed with an appropriate operation pattern to follow a change in speed of the printing press (the changing speed of the rotation phase of the printing press), in the same manner as in the first-color printing unit 10-1.

The instruction rotational speed VPC for the printing press may become equal to or more than the printing speed VPsp before impression throw-on is started in the fourth-color printing unit 10-4. In this case, if YES in step S10, the cylinder throw-on/off controller 30 advances to step S11, and sets the instruction rotational speed VPC for the printing press to VPsp. If the modified instruction rotational speed VPCnew becomes equal to or more than the printing speed VPsp (YES in step S19), the cylinder throw-on/off controller 30 sets the modified instruction rotational speed VPCnew as the printing speed VPsp (step S20), and performs the processes from step S21. Hence, even after the speed of the printing press is increased to the printing speed VPsp, impression throw-on in the remaining printing units is performed in the same manner as described above.

If N=5 in step S35, it is checked whether or not the instruction rotational speed VPC for the printing press is equal to the printing speed VPsp (step S36). If the instruction rotational speed VPC for the printing press has not reached the printing speed VPsp yet (NO in step S36), the cylinder throw-on/off controller 30 increases the instruction rotational speed VPC for the printing press by $\Delta\alpha$ for each control time interval TC (steps S37 to S40).

If the instruction rotational speed VPC for the printing press reaches the printing speed VPsp (YES in step S36), or the instruction rotational speed VPC for the printing press becomes equal to or more than the printing speed VPsp because of the processes in steps S37 to S40, the cylinder throw-on/off controller 30 advances to the process in step S41. In step S41, the state of the print stop switch 22 is monitored.

[Stop of Printing Press]

When the print stop switch 22 is turned on (YES in step S41, FIG. 3C), as soon as the rotation phase $\phi$ of the printing press reaches a predetermined deceleration start rotation phase $\phi_{SL}$ (YES in step S42, FIG. 3D), the cylinder throw-on/off controller 30 sets N=1 (step S43), and starts counting with the timer T from zero (step S44). In this case, the cylinder throw-on/off controller 30 advances to step S49 until the timer count of the timer T reaches the control time interval TC, and advances to step S46 when a timer count T of the timer T reaches the control time interval TC.

In step S49, it is checked whether or not the current impression throw-on/off rotation phase $\phi D$ is equal to or more than a first-color impression throw-off start rotation phase $\phi DO_{ST1}$. Since $\phi D<\phi DO_{ST1}$ is maintained yet (NO in step S49), the cylinder throw-on/off controller 30 returns to step S45 to continue counting with the timer T.

When T=TC is satisfied in step S45, a predetermined rotational speed modification value $\Delta\beta$ for deceleration is subtracted from the instruction rotational speed VPC for the printing press to obtain a new instruction rotational speed VPC (step S46). Then, the instruction rotational speed VPC is output to the printing press (step S47). Thus, the speed of the printing press that has been operated at the printing speed VPsp lowers by $\Delta\beta$.

After outputting the instruction rotational speed VPC for the printing press (step S47), the cylinder throw-on/off controller 30 stores the output instruction rotational speed VPC as a previous instruction rotational speed VPCold (step S48), and returns to step S44. By repeating this processing operation, the speed of the printing press lowers as the instruction rotational speed VPC reduces by $\Delta\beta$ in each control time interval TC.

[Impression Throw-Off in First-Color Printing Unit]

In repeating this processing operation, when the impression throw-on/off rotation phase $\phi D$ becomes equal to or more than the first-color impression throw-on start rotation phase $\phi DO_{ST1}$ (YES in step S49), the cylinder throw-on/off controller 30 determines the rotation phase $\phi$ of the printing press at this time as a current rotation phase $\phi R$ of the printing press (step S50). Note that at the impression throw-on start rotation phase $\phi DO_{ST1}$, the rotation phase $\phi$ of the printing press is set to 0°.

Subsequently, the cylinder throw-on/off controller 30 subtracts the rotational speed modification value $\Delta\beta$ from the previous instruction rotational speed VPCold to obtain a modified instruction rotational speed VPCnew (step S51). The cylinder throw-on/off controller 30 then multiplies the modified instruction rotational speed VPCnew by the control time interval TC to obtain a rotation phase $\Delta\phi C$ for which the printing press is to advance until the next control (step S52). The cylinder throw-on/off controller 30 also adds the rotation phase $\Delta\phi C$, for which the printing press is to advance until the next control, to the current rotation phase $\phi R$ of the printing press to obtain an expected rotation phase $\phi C$ of the printing press for the next control (step S53).

The rotation phase $\theta M$ of the cylinder throw-on/off motor corresponding to the current rotation phase $\phi R$ of the printing press is obtained as $\theta MR'$ from the rotation phase conversion table $TB2_1'$ (step S54). Also, the rotation phase $\theta M$ of the cylinder throw-on/off motor corresponding to the expected rotation phase $\phi C$ of the printing press for the next control is obtained as $\theta MC'$ from the rotation phase conversion table $TB2_1'$ (step S55 in FIG. 3E).

The rotation phase $\theta MR'$ of the cylinder throw-on/off motor corresponding to the current rotation phase $\phi R$ of the printing press is subtracted from the rotation phase $\theta MC'$ of the cylinder throw-on/off motor corresponding to the expected rotation phase $\phi C$ of the printing press for the next control to obtain a rotation phase $\Delta\theta M'$ for which the cylinder throw-on/off motor 29-1 in the printing unit 10-1 is to advance until the next control (step S56). This $\Delta\theta M'$ is divided by the control time interval TC to obtain an instruction rotational speed $VMC_1$ for the cylinder throw-on/off motor 29-1 (step S57). This instruction rotational speed $VMC_1$ represents the drive amount of the cylinder throw-on/off motor 29-1 until the next control.

The cylinder throw-on/off controller 30 outputs the instruction rotational speed VPCnew modified in step S51 as the instruction rotational speed VPC for the printing press (steps S58 and S59) and the instruction rotational speed $VMC_1$ for the cylinder throw-on/off motor 29-1 obtained in step S57 as an instruction rotational speed for the current control (step S60). In this case, the output instruction rotational speed VPC is stored as the previous instruction rotational speed VPCold (step S61).

Then, the cylinder throw-on/off controller 30 starts counting with the timer T from zero (step S62). The cylinder throw-on/off controller 30 advances to step S64 until the timer count of the timer T reaches the control time interval TC, and returns to step S50 when the timer count of the timer T reaches the control time interval TC.

In step S64, it is checked whether or not the impression throw-on/off rotation phase $\phi D$ becomes equal to or more than the first-color impression throw-off completion rotation phase $\phi DO_{ED1}$. In this case, since the impression throw-on/off rotation phase $\phi D$ still satisfies $\phi D<\phi DO_{ED1}$ (NO in step S64), the cylinder throw-on/off controller 30 returns to step S63 to continue counting with the timer T. When T=TC is achieved (YES in step S63), the cylinder throw-on/off controller 30 returns to step S50 (FIG. 3D), and repeats the processing operation of steps S50 to S64.

Therefore, the speed of the printing press lowers as the instruction rotational speed VPC reduces by $\Delta\beta$ in each control time interval TC. During this deceleration of the printing press, the cylinder throw-on/off motor 29-1 of the first-color printing unit 10-1 rotates in each control time interval TC at the instruction rotational speed $VMC_1$ obtained in accordance with the current rotation phase $\phi R$ of the printing press. Thus, in the first-color printing unit 10-1, impression throw-on is performed with an appropriate operation pattern to follow a change in speed of the printing press (the changing speed of the rotation phase of the printing press).

[Impression Throw-Off in Second-, Third-, and Fourth-Color Printing Units]

When the impression throw-on/off rotation phase $\phi D$ becomes equal to or more than the first-color impression throw-off completion rotation phase $\phi DO_{ED1}$ (YES in step S64), the cylinder throw-on/off controller 30 sets N=N+1=2 (step S65), and repeats the processing operation of steps S44 to S66 until N=5 is set (YES in step S66). Thus, in the second-, third-, and fourth-color printing units 10-2, 10-3, and 10-4 as well, impression throw-off is performed with an appropriate operation pattern to follow a change in speed of the printing press (the changing speed of the rotation phase of the printing press), in the same manner as in the first-color printing unit 10-1.

Figure 3F:
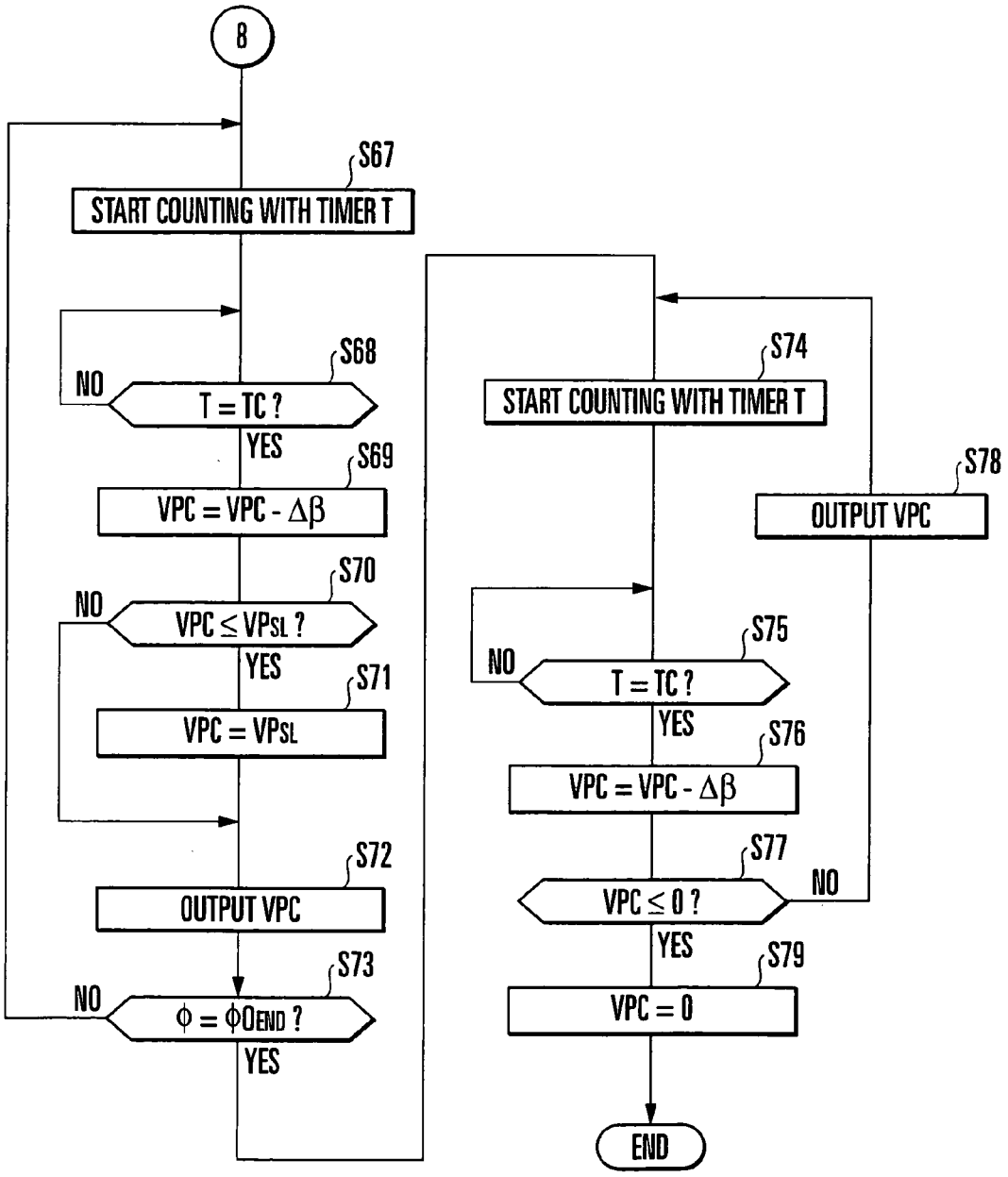

When N=5 is set (YES in step S66), the cylinder throw-on/off controller 30 decreases the instruction rotational speed VPC for the printing press by AO in each control time interval TC (repetition of the processes in steps S67 to S73 in FIG. 3F). During this deceleration, if the instruction rotational speed VPC becomes equal to or less than a slower motion speed $VP_{SL}$ (YES in step S70), the instruction rotational speed VPC is set as the slower motion speed $VP_{SL}$ (step S71).

When the rotation phase $\phi$ of the printing press reaches a predetermined impression throw-on/off rotation phase $\phi O_{END}$ for delivery completion (YES in step S73), the cylinder throw-on/off controller 30 lowers the instruction rotational speed VPC for the printing press in each control time interval TC again (repetition of the processes in steps S74 to S78). When the instruction rotational speed VPC satisfies VPC≤0 (YES in step S77), the cylinder throw-on/off controller 30 outputs the instruction rotational speed VPC as satisfying VPC=0 (step S79), and ends the series of impression throw-on/off processing operation.

Figure 14:
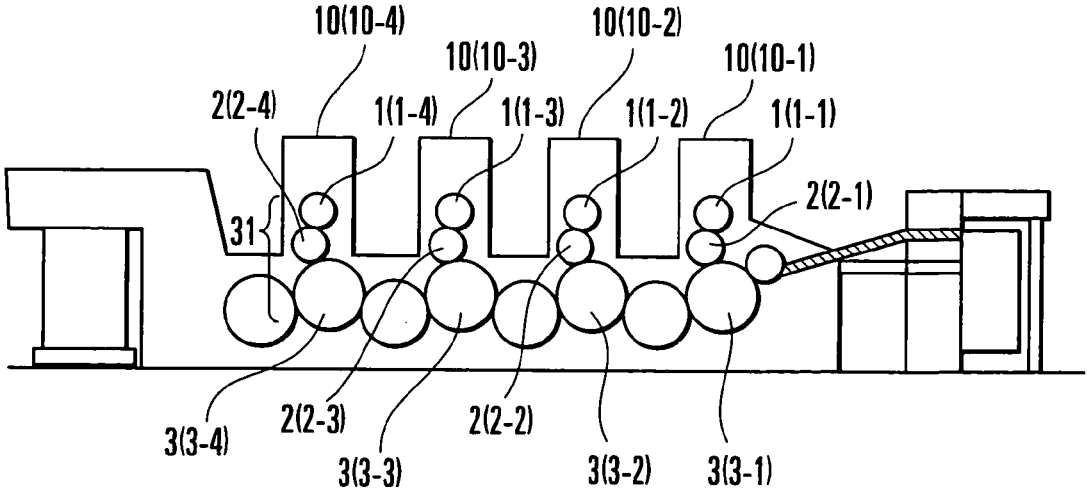
FIG. 14 is a side view for explaining an offset rotary printing press (four-color sheet-fed rotary printing press)

In the principle of the present invention described above, the plate cylinder 1, the impression cylinder 3, and the blanket cylinder 2 disposed between the two cylinders 1 and 3 constitute one printing section 31 (FIG. 14). Alternatively, one set of blanket cylinder 2 and plate cylinder 1 may be arranged both at the front and rear portions of one impression cylinder 3. Namely, a front set of blanket cylinder and plate cylinder and a rear set of blanket cylinder and plate cylinder can share one impression cylinder. In this case, it is regarded that although only one impression cylinder exists, two sets of printing sections exist.

First Embodiment

Figure 4:
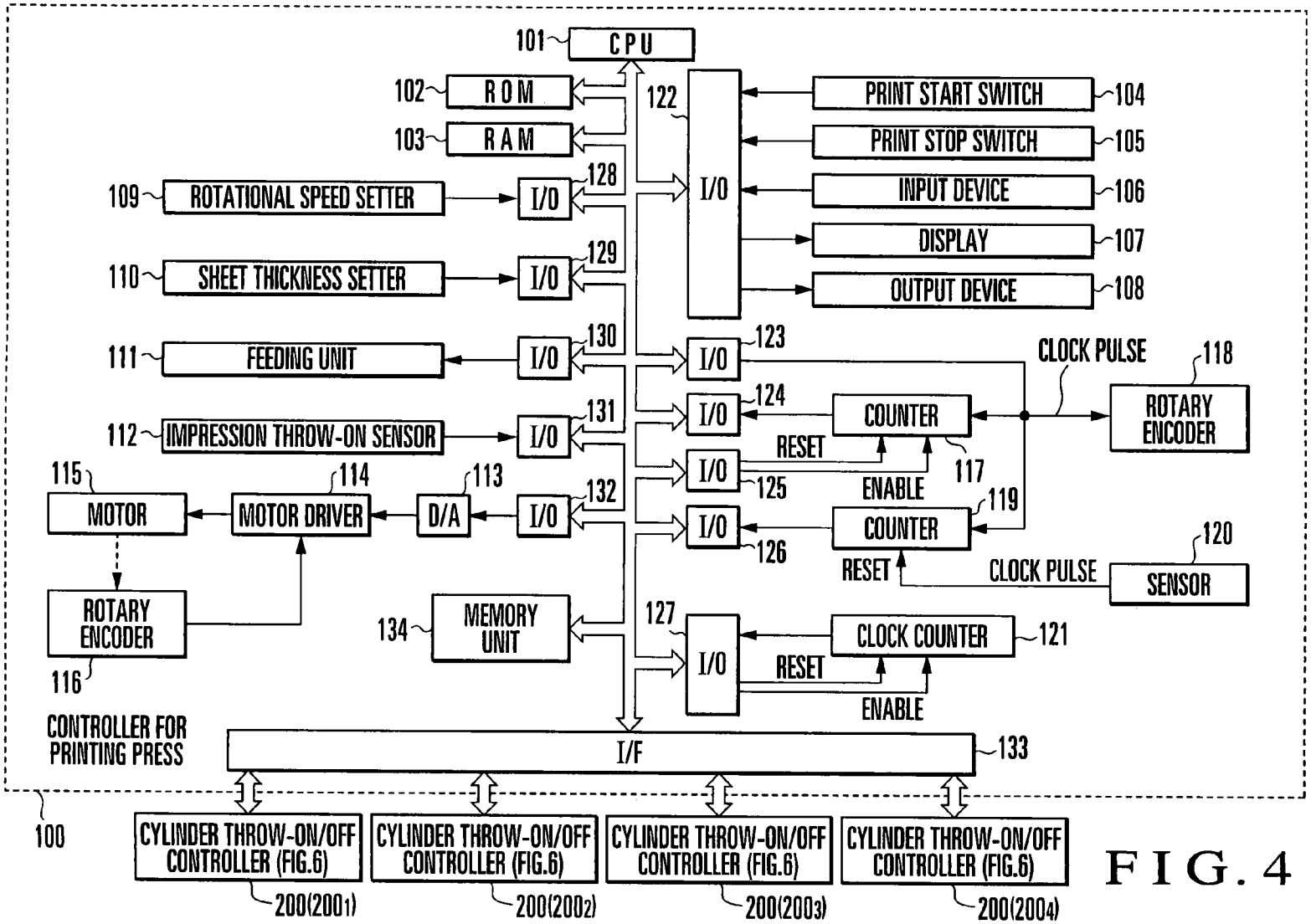
FIG. 4 is a block diagram of a cylinder throw-on/off apparatus for a printing press according to the first embodiment of the present invention.

A cylinder throw-on/off apparatus for a printing press according to the first embodiment of the present invention will be described with reference to FIGS. 4 to 9B. As shown in FIG. 4, the cylinder throw-on/off apparatus of this embodiment comprises a controller 100 for the printing press and cylinder throw-on/off controllers 200 for a plurality of printing units (a cylinder throw-on/off controller $\mathbf{200}_1$ for the first-color printing unit to a cylinder throw-on/off controller $\mathbf{200}_4$ for the fourth-color printing unit) to be connected to the controller 100. The main constituent elements of the cylinder throw-on/off apparatus for the printing press according to this embodiment are included in the controller 100.

The controller 100 comprises a CPU (Central Processing Unit) 101, ROM (Read Only Memory) 102, RAM (Random Access Memory) 103, print start switch 104, print stop switch 105, input device 106, display 107, output device 108, rotational speed setter 109, sheet thickness setter 110, feeding unit 111, impression throw-on sensor 112, D/A converter 113, drive motor driver 114, drive motor 115, rotary encoder 116, counter 117, rotary encoder 118, counter 119, sensor 120, internal clock counter 121, interfaces 122 to 133, and memory unit 134. The rotary encoder 116 generates pulses corresponding to the rotation phase of the drive motor 115. The counter 117 detects the impression throw-on/off phase. The rotary encoder 118 generates pulses corresponding to the rotation phase of the printing press. The counter 119 counts the pulses from the rotary encoder 118 to detect the rotation phase of the printing press. The sensor 120 detects the home position of the printing press.

The rotary encoder 118 is provided to the rotary member of the printing press such that it rotates by one revolution every time one sheet 9 is fed to the printing press. Every time the printing press rotates through a predetermined angle, the rotary encoder 118 generates one clock pulse. The sensor 120 generates one pulse every time the rotation phase of the printing press reaches the home position, thus resetting the counter 119.

The cylinder throw-on/off controller 200 of each printing unit comprises a CPU 201, ROM 202, RAM 203, input device 204, display 205, output device 206, D/A converter 207, motor driver 218, cylinder throw-on/off stepping motor 219, sensor 221, interfaces 213 to 216, and memory unit 217. The motor driver 218 drives the cylinder throw-on/off motor. The cylinder throw-on/off stepping motor 219 serves as a cylinder throw-on/off motor. The sensor 221 detects the home position of the cylinder throw-on/off motor.

In the cylinder throw-on/off controller 200, the cylinder throw-on/off stepping motor (to be referred to as a cylinder throw-on/off motor hereinafter) 219 rotates clockwise/counterclockwise upon reception of a clockwise/counterclockwise rotation pulse from the motor driver 218. The count of a counter 220 is incremented by the clockwise rotation pulse for the cylinder throw-on/off motor 219 and decremented by the counterclockwise rotation pulse for the cylinder throw-on/off motor 219. The sensor 221 is usually arranged outside the normal throw-off operation range of the blanket cylinder 2 to separate from the plate cylinder 1, and resets the counter 220 for the purpose of maintenance.

Figure 5:
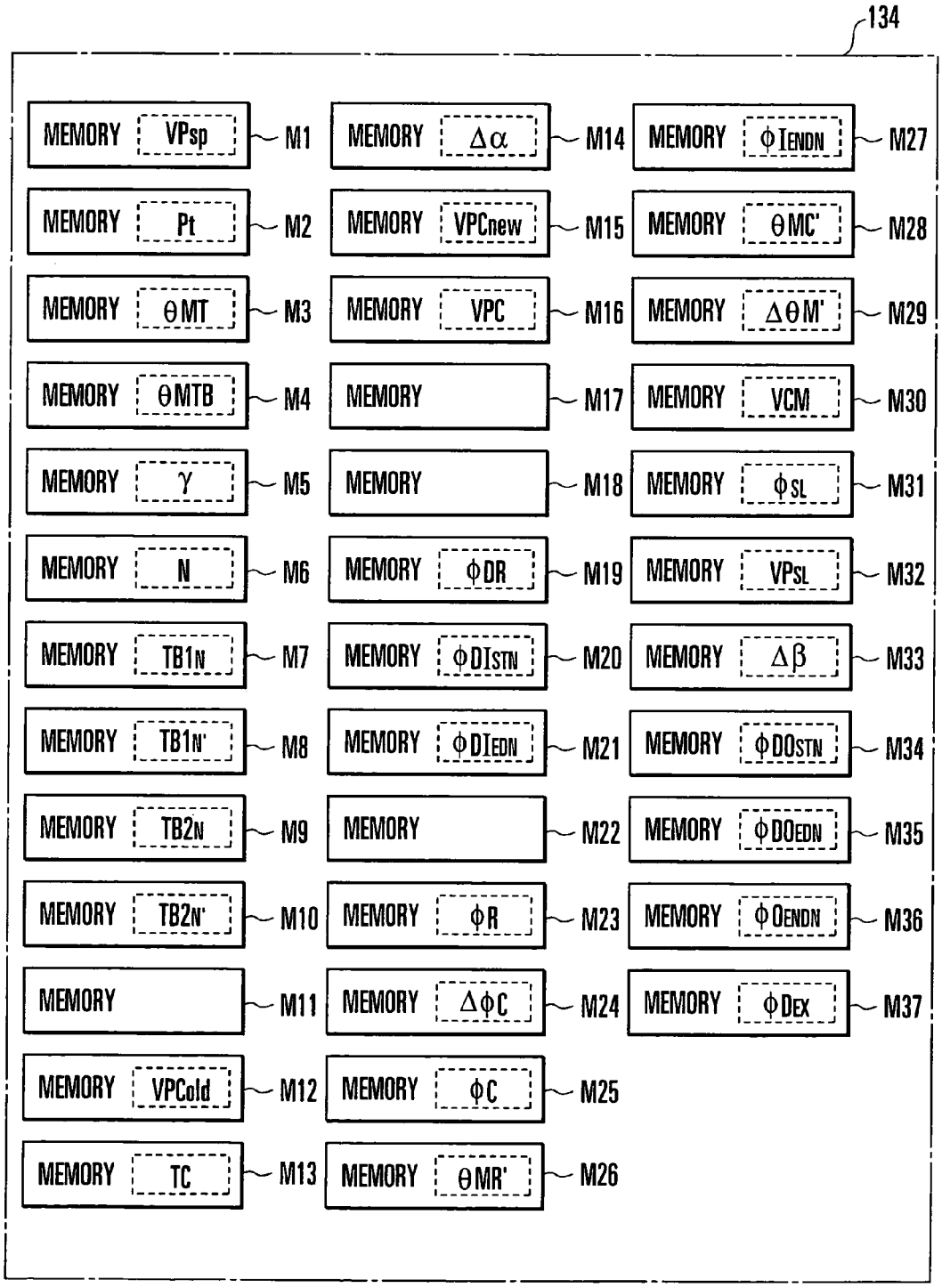
FIG. 5 is a diagram showing in detail the memory unit of a controller shown in FIG. 4.

The memory unit 134 (FIG. 4) of the controller 100 comprises memories M1 to M37, as shown in FIG. 5. The memory M1 stores the preset rotational speed (printing speed) VPsp. The memory M2 stores the sheet thickness Pt. The memory M3 stores a total rotation phase θMT of the cylinder throw-on/off motor. The memory M4 stores a reference total rotation phase θMTB of the cylinder throw-on/off motor. The memory M5 stores a necessary rotation phase ratio γ of the cylinder throw-on/off motor. The memory M6 stores the count N.

The memory M7 stores in advance the reference conversion tables $TB1_N$ ($TB1_1$ to $TB1_4$) for converting the rotation phase of the printing press into the rotation phase of the cylinder throw-on/off motor for impression throw-on. The memory M8 stores the modified conversion tables $TB1_N'$ ($TB1_1$ to $TB1_4'$) for converting the rotation phase of the printing press into the rotation phase of the cylinder throw-on/off motor for impression throw-on.

The memory M9 stores in advance the reference conversion tables $TB2_N$ ($TB2_1$ to $TB2_4$) for converting the rotation phase of the printing press into the rotation phase of the cylinder throw-on/off motor for impression throw-off. The memory M10 stores the modified conversion tables $TB2_N'$ ($TB2_1'$ to $TB2_4'$) for converting the rotation phase of the printing press into the rotation phase of the cylinder throw-on/off motor for impression throw-off.

The memory M11 stores the total number (=4) of printing units in advance. The memory M12 stores the previous instruction rotational speed VPCold. The memory M13 stores the control time interval TC in advance. The memory M14 stores the rotational speed modification value Δα for acceleration in advance. The memory M15 stores the modified instruction rotational speed VPCnew. The memory M16 stores the instruction rotational speed VPC. The memory M17 stores the printing unit number.

The memory M18 stores the count of the impression throw-on/off phase detection counter. The memory M19 stores a current impression throw-on/off rotation phase ϕDR. The memory M20 stores the impression throw-on start phase $\phi DI_{STN}$ ($\phi DI_{ST1}$ to $\phi DI_{ST4}$) in advance. The memory M21 stores the impression throw-on completion rotation phase $\phi DI_{EDN}$ ($\phi DI_{ED1}$ to $\phi DI_{ED4}$) in advance.

The memory M22 stores the count of the rotation phase detection counter of the printing press. The memory M23 stores the current rotation phase ϕR of the printing press. The memory M24 stores the rotation phase ΔϕC for which the printing press is to advance until the next control. The memory M25 stores the rotation phase ϕC of the printing press for the next control. The memory M26 stores the current virtual rotation phase θMR' of the cylinder throw-on/off motor of the Nth printing unit. The memory M27 stores a rotation phase $\phi I_{ENDN}$ ($\phi I_{END1}$ to $\phi I_{END4}$) of the printing press for impression throw-on completion in advance.

The memory M28 stores the virtual rotation phase θMC' of the cylinder throw-on/off motor of the Nth printing unit for the next control. The memory M29 stores the rotation phase ΔθM' for which the cylinder throw-on/off motor of the Nth printing unit is to advance until the next control. The memory M30 stores the instruction rotational speed VMC of the cylinder throw-on/off motor of the Nth printing unit.

The memory M31 stores the deceleration start rotation phase $\phi_{SL}$ of the printing press in advance. The memory M32 stores the slower rotational speed $VP_{SL}$ in advance. The memory M33 stores the rotational speed modification value Δβ for deceleration in advance. The memory M34 stores the impression throw-off start rotation phase $\phi DO_{STN}$ ($\phi DO_{ST1}$ to $\phi DO_{ST4}$) in advance. The memory M35 stores the impression throw-off completion rotation phase $\phi DO_{EDN}$ ($\phi DO_{ED1}$ to $\phi DO_{ED4}$) in advance. The memory M36 stores the rotation phase $\phi O_{ENDN}$ ($\phi O_{END1}$ to $\phi O_{END4}$) of the printing press in impression throw-off completion in advance. The memory M37 stores an impression throw-on/off rotation phase $\phi D_{EX}$ in delivery completion in advance.

Figure 6:
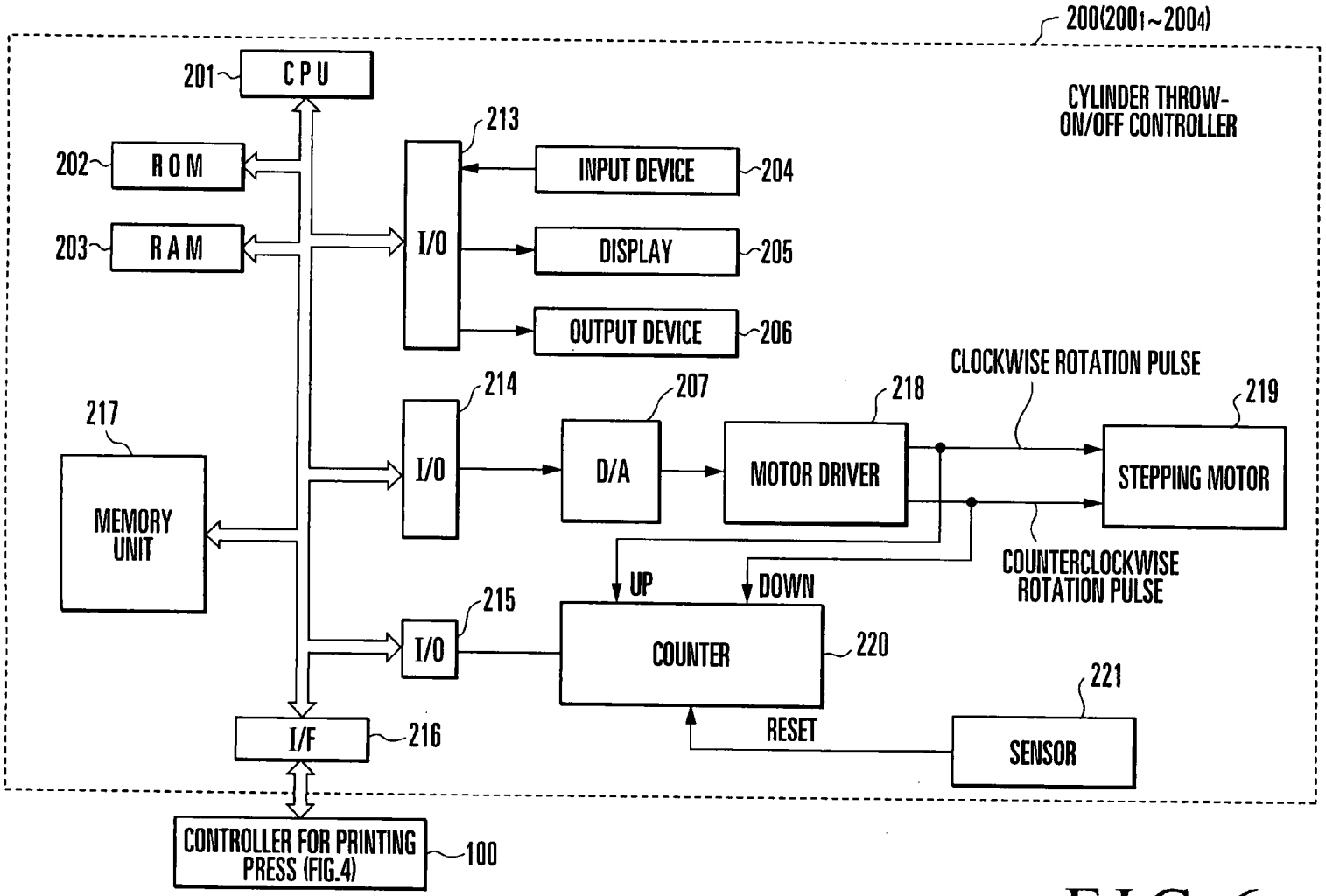
FIG. 6 is a block diagram of each of cylinder throw-on/off controllers shown in FIG. 4.
Figure 7:
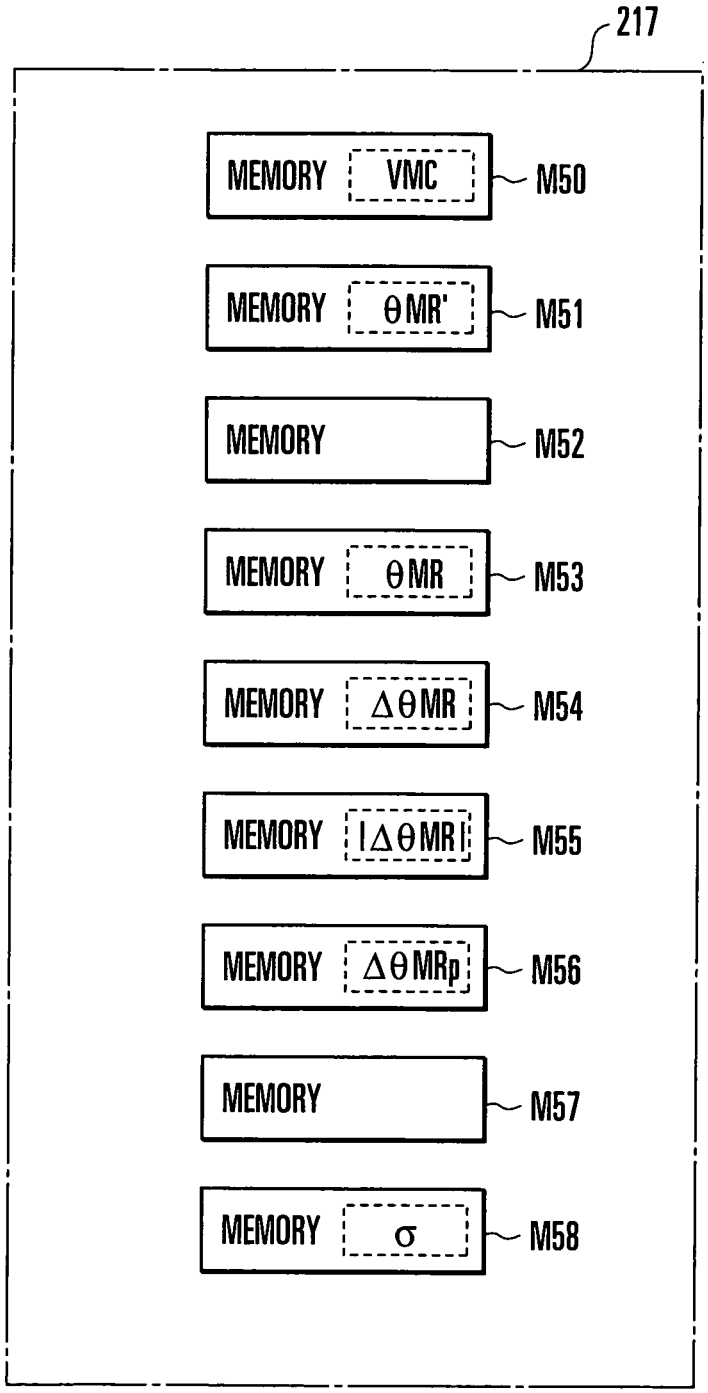
FIG. 7 is a diagram showing in detail the memory unit of the cylinder throw-on/off controller shown in FIG. 6.

As shown in FIG. 7, the memory unit 217 (FIG. 6) of the cylinder throw-on/off controller 200 comprises memories M50 to M58. The memory M50 stores the instruction rotational speed VMC of the cylinder throw-on/off motor. The memory M51 stores the current virtual rotation phase θMR' of the cylinder throw-on/off motor. The memory M52 stores the count of the rotation phase detection counter of the cylinder throw-on/off motor.

The memory M53 stores a current rotation phase θMR of the cylinder throw-on/off motor. The memory M54 stores a current rotation phase difference ΔθMR of the cylinder throw-on/off motor. The memory M55 stores the absolute value of the current rotation phase difference ΔθMR of the cylinder throw-on/off motor. The memory M56 stores a tolerance ΔθMRp of the rotation phase difference of the cylinder throw-on/off motor. The memory M57 stores in advance a conversion table for converting the current rotation phase difference of the cylinder throw-on/off motor into the correction value of the instruction rotational speed, which table indicates the relationship between the current rotation phase difference ΔθMR of the cylinder throw-on/off motor and a correction value σ of the instruction rotational speed. The memory M58 stores the correction value σ of the instruction rotational speed of the cylinder throw-on/off motor.

Figure 8A:
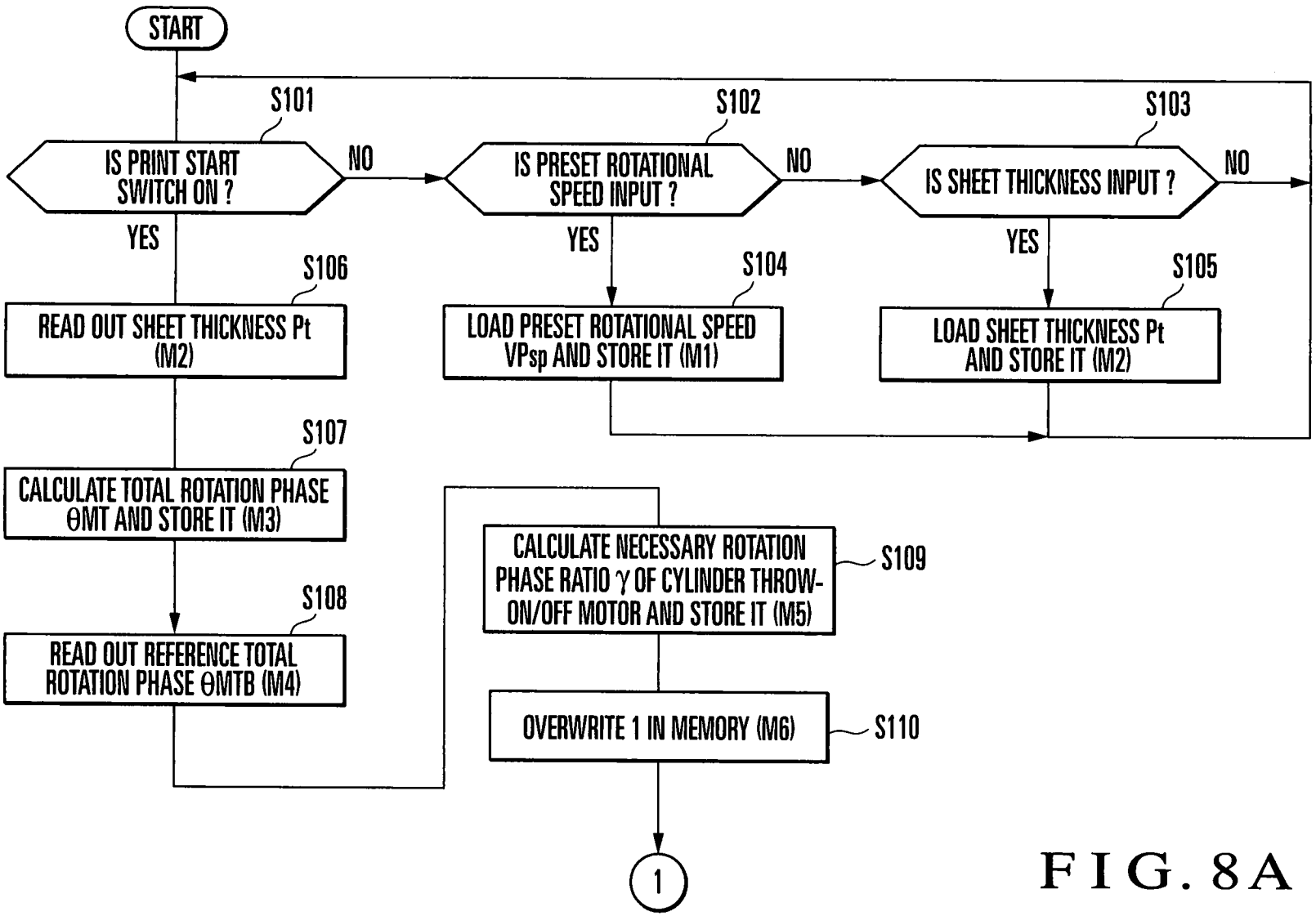
FIGS. 8A to 8X are flowcharts showing processing operation performed by the CPU of the controller shown in FIG. 4.

The processing operation performed by the CPU 101 of the controller 100 will be described hereinafter with reference to FIGS. 8A to 8X.

<Before Start of Printing>

Before the start of printing, the operator inputs the preset rotational speed (printing speed) VPsp of the printing press from the rotational speed setter 109 and the thickness Pt of the printing sheet from the sheet thickness setter 110.

When the preset rotational speed VPsp is input from the rotational speed setter 109 (YES in step S102, FIG. 8A), the CPU 101 stores it in the memory M1 (step S104). When the thickness Pt of the printing sheet is input from the sheet thickness setter 110 (YES in step S103), the CPU 101 stores it in the memory M2 (step S105).

<Start of Printing>

After that, the operator turns on the print start switch 104. Then, the CPU 101 confirms that the print start switch 104 is ON (YES in step S101), reads out the thickness Pt of the printing sheet from the memory M2 (step S106), and calculates the total rotation phase θMT of the cylinder throw-on/off motor from the readout thickness Pt of the printing sheet (step S107). The calculated total rotation phase θMT of the cylinder throw-on/off motor is stored in the memory M3.

Then, the CPU 101 reads out the reference total rotation phase θMTB of the cylinder throw-on/off motor from the memory M4 (step S108) and calculates the necessary rotation phase ratio γ of the cylinder throw-on/off motor by dividing the total rotation phase θMT obtained in step S107 by the reference total rotation phase θMTB (step S109). The calculated necessary rotation phase ratio γ is stored in the memory M5.

<Modification of Tables TB1 and TB2>

Figure 8B:
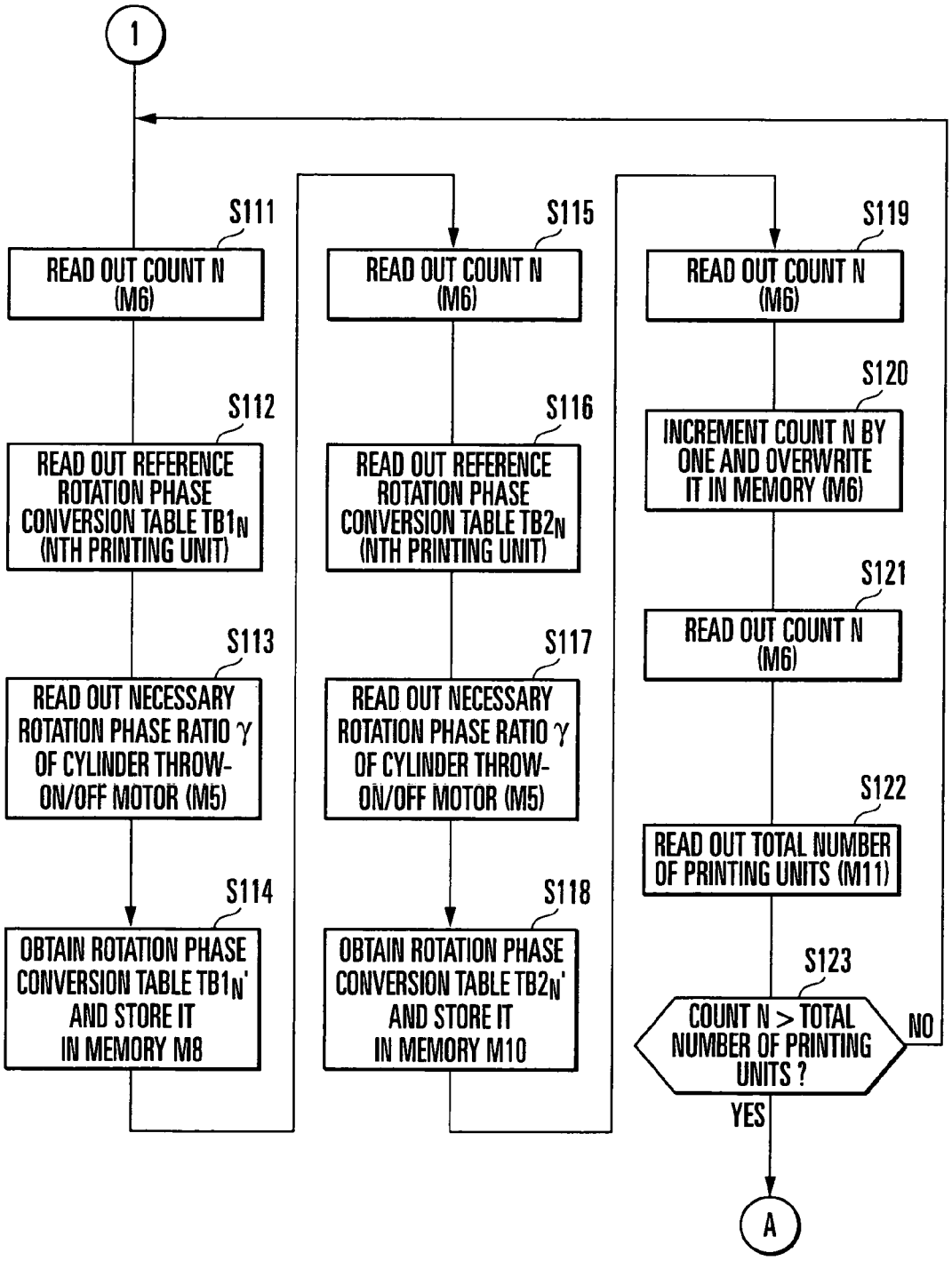
Figure 8C:
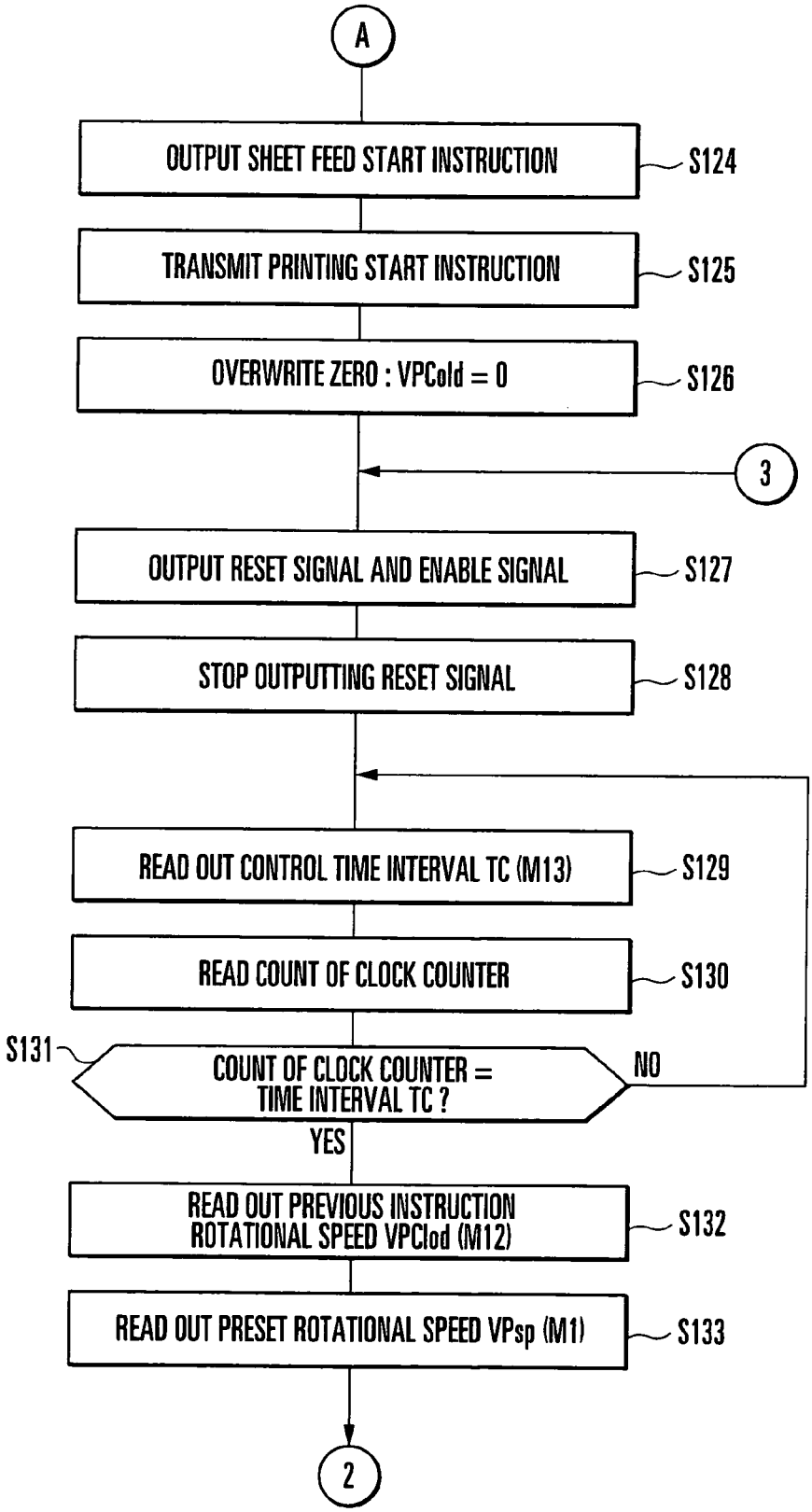

Then, the CPU 101 sets the count N in the memory M6 to satisfy N=1 (step S110), and reads out from the memory M7 the reference conversion table $TB1_1$ for converting the rotation phase of the printing press of the (N=1)th printing press unit into the rotation phase of the cylinder throw-on/off motor for impression throw-on (steps S111 and S112 in FIG. 8B). The CPU 101 multiplies each reference rotation phase of the readout reference rotation phase conversion table $TB1_1$ by the necessary rotation phase ratio γ obtained in step S109 to obtain the conversion table $TB1_1'$ for converting the rotation phase of the printing press of the (N=1)th printing press unit into the rotation phase of the cylinder throw-on/off motor for impression throw-on, and stores in the memory M8 the obtained conversion table $TB1_1'$ for converting the rotation phase of the printing press of the (N=1)th printing press unit into the rotation phase of the cylinder throw-on/off motor for impression throw-on (steps S113 and S114).

Then, the CPU 101 reads out from the memory M9 the reference conversion table $TB2_1$ for converting the rotation phase of the printing press of the (N=1)th printing press unit into the rotation phase of the cylinder throw-on/off motor for impression throw-off (steps S115 and S116). The CPU 101 multiplies each reference rotation phase of the readout reference rotation phase conversion table $TB2_1$ by the necessary rotation phase ratio γ obtained in step S109 to obtain the conversion table $TB2_1'$ for converting the rotation phase of the printing press of the (N=1)th printing press unit into the rotation phase of the cylinder throw-on/off motor for impression throw-off, and stores in the memory M10 the obtained conversion table $TB2_1'$ for converting the rotation phase of the printing press of the (N=1)th printing press unit into the rotation phase of the cylinder throw-on/off motor for impression throw-off (steps S117 and S118).

Then, the CPU 101 increments the count N in the memory M6 by one (steps S119 and S120) and compares the count N with the total number of printing units stored in the memory M11 (steps S121 to S123). The CPU 101 repeats the processes in steps S111 to S123 until the count N exceeds the total number of printing units.

Thus, the conversion tables $TB1_1'$ to $TB1_4'$ for converting the rotation phase of the printing press into the rotation phase of the cylinder throw-on/off motor for impression throw-on, which are modified by the necessary rotation phase ratio γ, are stored in the memory M8, and the conversion tables $TB2_1'$ to $TB2_4'$ for converting the rotation phase of the printing press into the rotation phase of the cylinder throw-on/off motor for impression throw-off, which are modified by the necessary rotation phase ratio γ, are stored in the memory M10.

<Start of Sheet Feed, Acceleration of Printing Press>

After finishing modification of the tables $TB1_1$ to $TB1_4$ and $TB2_1$ to $TB2_4$ (YES in step S123), the CPU 101 outputs a sheet feed start instruction to the feeding unit 111 (step S124 in FIG. 8C) to start sheet feed to the printing press.

The CPU 101 also transmits a printing start instruction to the cylinder throw-on/off controller 200 of each printing unit (step S125) to inform the cylinder throw-on/off controller 200 of each printing unit that printing is to be started.

The CPU 101 also sets the previous instruction rotational speed VPCold in the memory M12 to 0 (step S126), sends a reset signal and enable signal to the internal clock counter 121 (step S127), and then stops outputting the reset signal (step S128) to cause the internal clock counter 121 to start counting from zero (counting of the timer time T).

During counting the timer time T, the CPU 101 reads out the control time interval TC stored in the memory M13 (step S129) and compares it with the timer time T (steps S130 and S131).

Figure 8D:
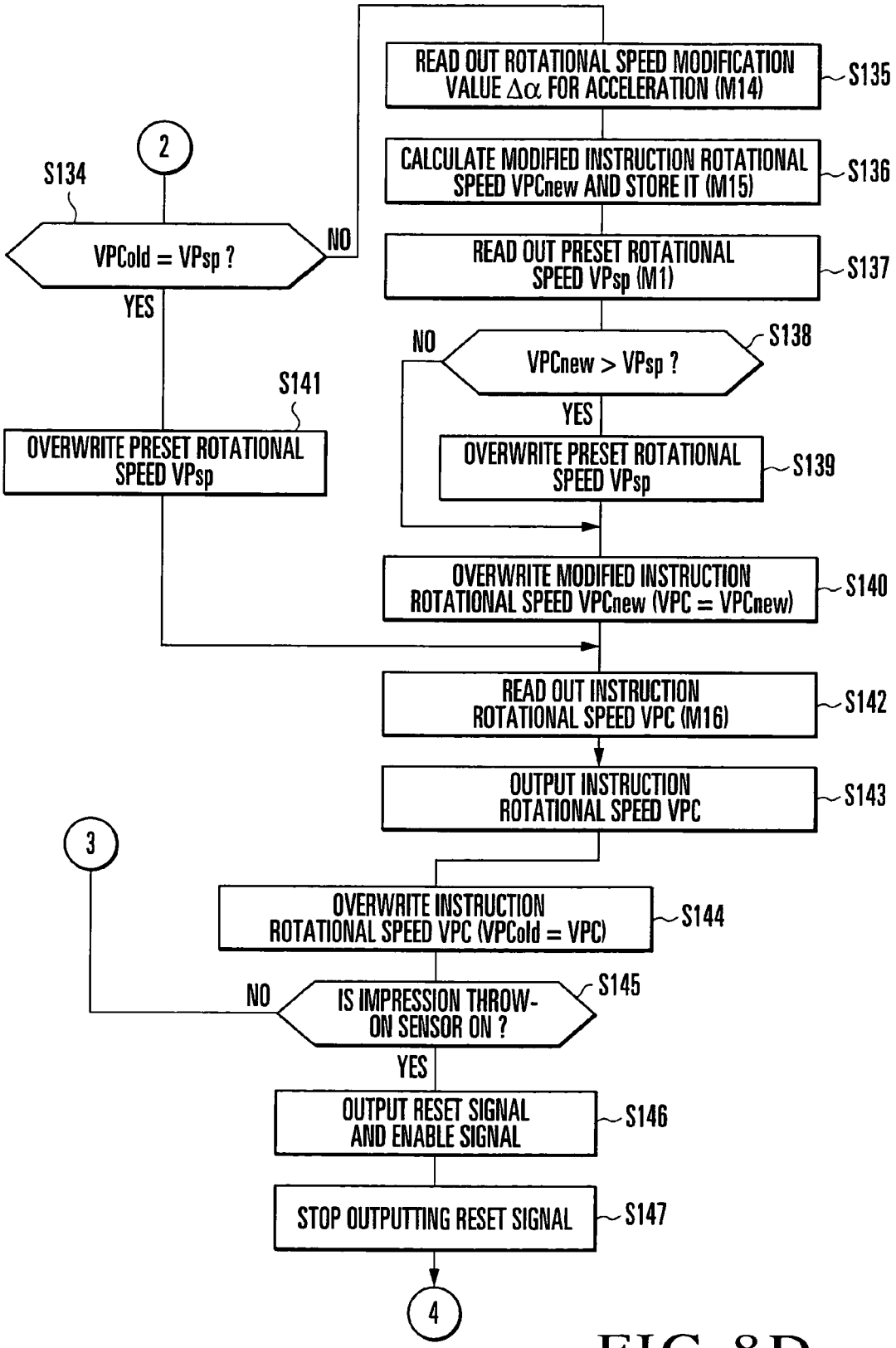
Figure 8E:
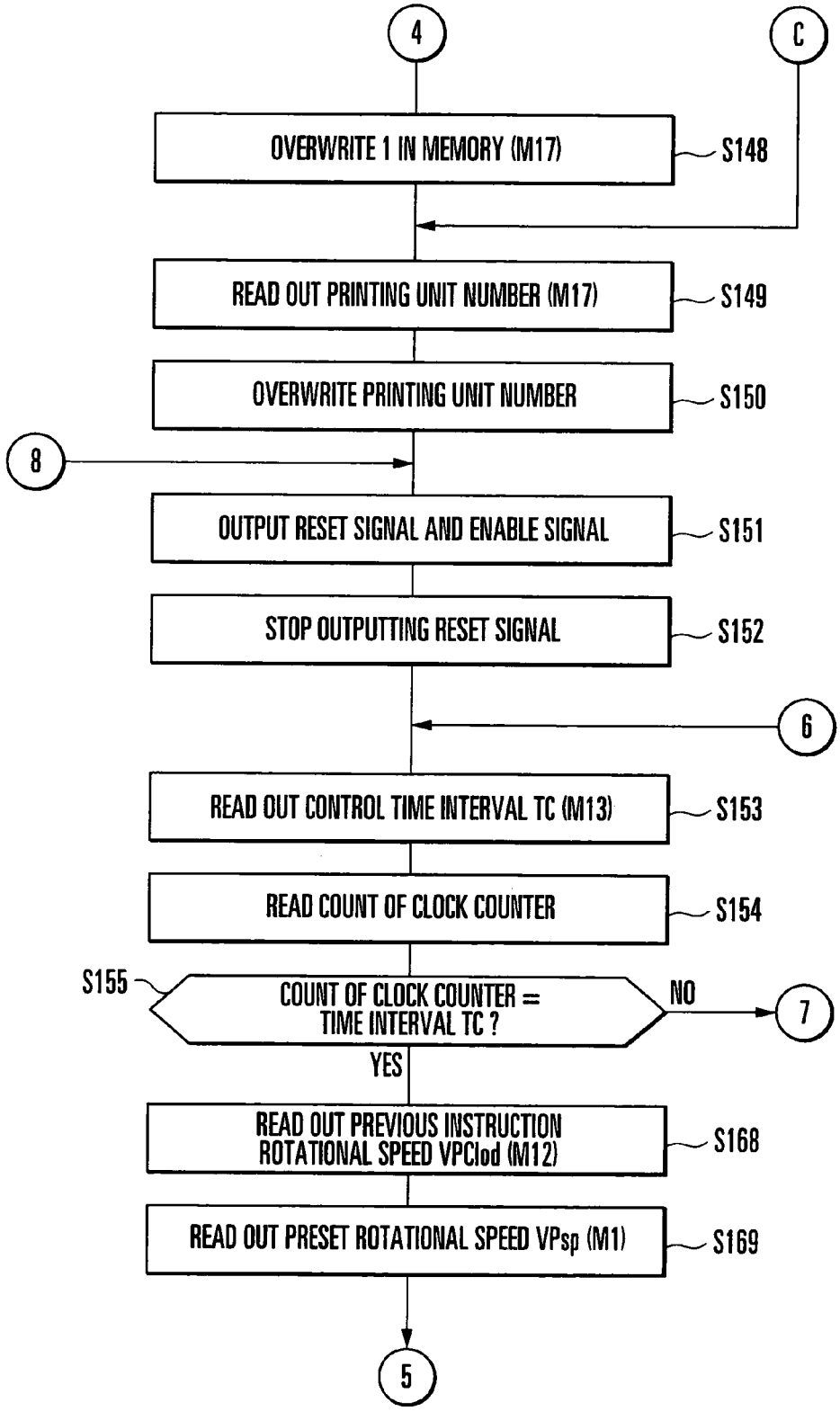

If the timer time T is equal to the control time interval TC (YES in step S131), the CPU 101 reads out the previous instruction rotational speed VPCold in the memory M12 and the preset rotational speed VPsp in the memory M1 (steps S132 and S133), and compares them with each other (step S134 in FIG. 8D).

In this case, as the previous instruction rotational speed VPCold is 0 and VPCold≠VPsp, the CPU 101 advances to step S135 if it is NO in step S134, and reads out the rotational speed modification value Δα for acceleration from the memory M14. The CPU 101 adds the readout rotational speed modification value Δα for acceleration to the previous instruction rotational speed VPCold to obtain a modified instruction rotational speed VPCnew (step S136). The modified instruction rotational speed VPCnew is stored in the memory M15.

Then, the CPU 101 reads out the preset rotational speed VPsp from the memory M1 (step S137) and compares it with the modified instruction rotational speed VPCnew (step S138). In this case, as the modified instruction rotational speed VPChew does not exceed the preset rotational speed VPsp (NO in step S138), the CPU 101 sets the modified instruction rotational speed VPCnew as the instruction rotational speed VPC (step S140), and outputs the instruction rotational speed VPC to the drive motor driver 114 (steps S142 and S143).

After outputting the instruction rotational speed VPC to the drive motor driver 114, the CPU 101 writes it in the memory M12 as the previous instruction rotational speed VPCold (step S144). The CPU 101 returns to step S127 (FIG. 8C) via step S145, and repeats the same operation. Hence, the speed of the printing press increases by $\Delta\alpha$ in each control time interval TC.

In step S134, if the previous instruction rotational speed VPCold is equal to the preset rotational speed VPsp, the CPU 101 sets the instruction rotational speed VPC as the preset rotational speed VPsp (step S141) and advances to step S142. In step S138, if the modified instruction rotational speed VPCnew exceeds the preset rotational speed VPsp, the CPU 101 sets the modified instruction rotational speed VPCnew as the preset rotational speed VPsp (step S139) and advances to step S140.

During the repetition of this processing operation, when the impression throw-on sensor 112 is turned on (YES in step S145), the CPU 101 sends a reset signal and enable signal to the impression throw-on/off phase detection counter 117 (step S146), and then stops outputting the reset signal (step S147) to cause the impression throw-on/off phase detection counter 117 to start counting (measurement of the impression throw-on/off rotation phase $\phi$DR) from zero.

Simultaneously, the CPU 101 writes 1 in the memory M17 as the printing unit number (step S148 in FIG. 8E), and reads out the printing unit number written in the memory M17 (step S149) and writes it in the memory M6 as the count N (step S150). The CPU 101 also sends a reset signal and enable signal to the internal clock counter 121 (step S151), and then stops outputting the reset signal (S152) to cause the internal clock counter 121 to start counting (counting of the timer time T) from zero.

During counting the timer time T, the CPU 101 reads out the control time interval TC stored in the memory M13 (step S153) and compares it with the timer time T (steps S154 and S155).

Figure 8F:
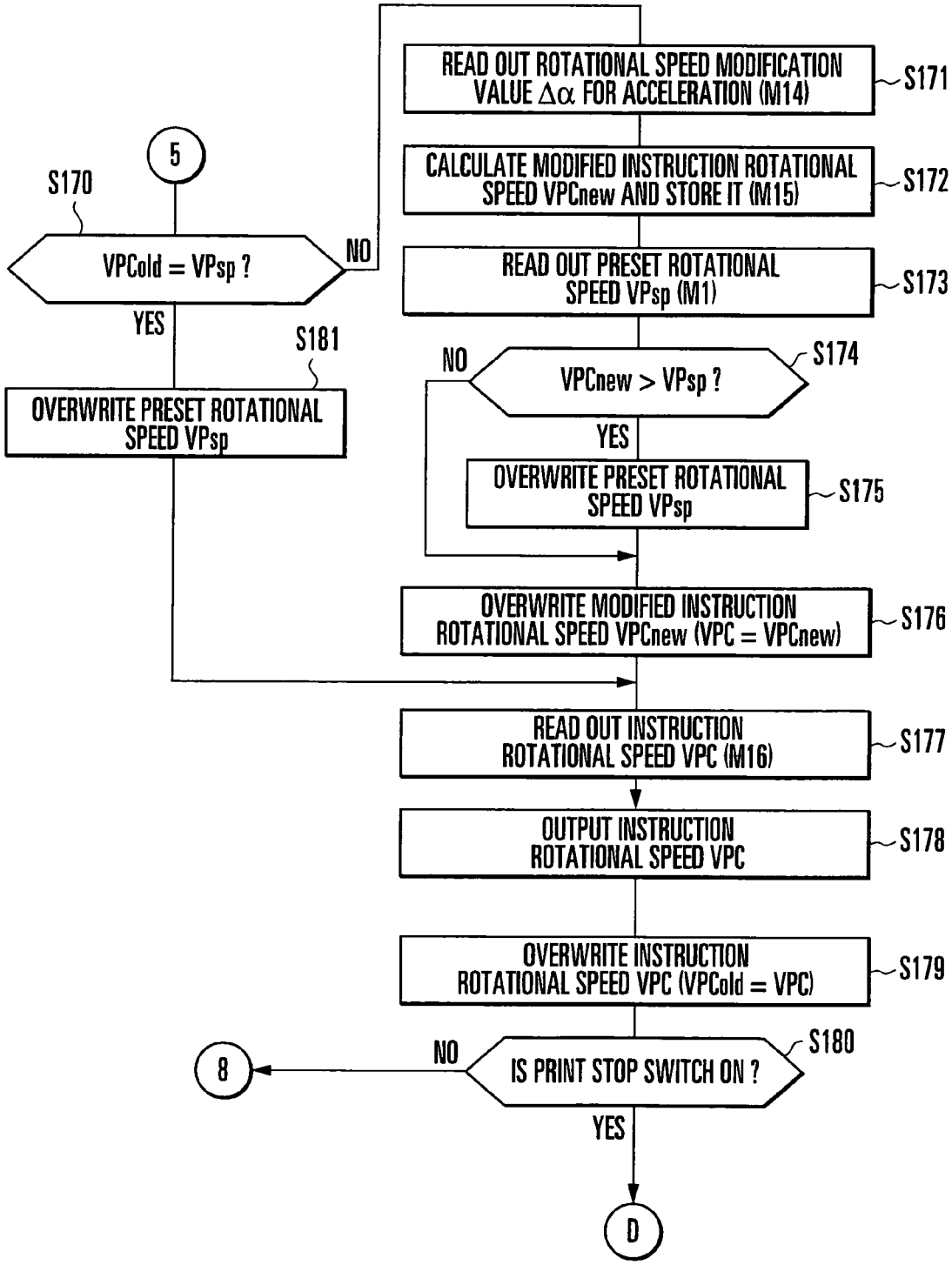
Figure 8G:
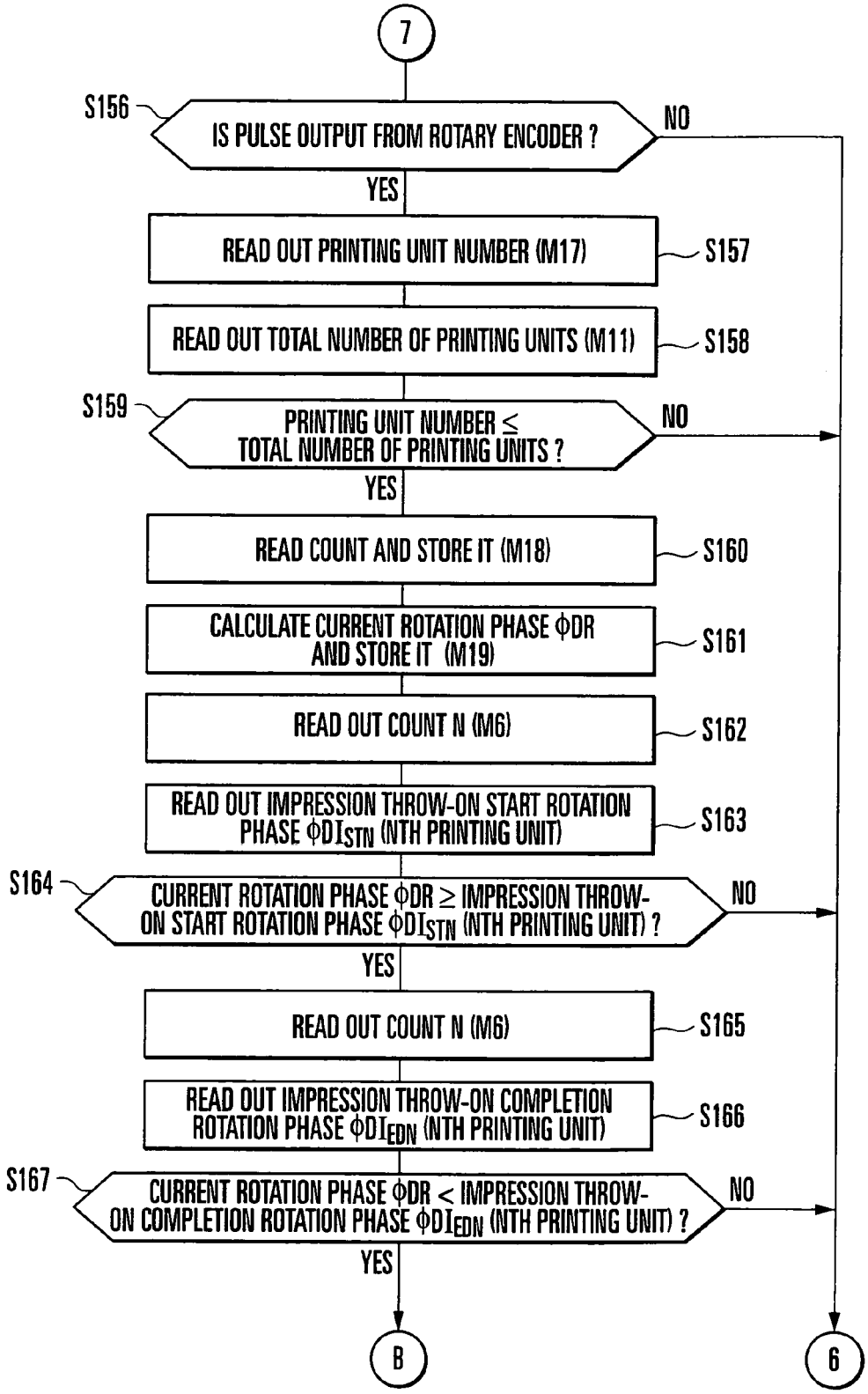
Figure 8H:
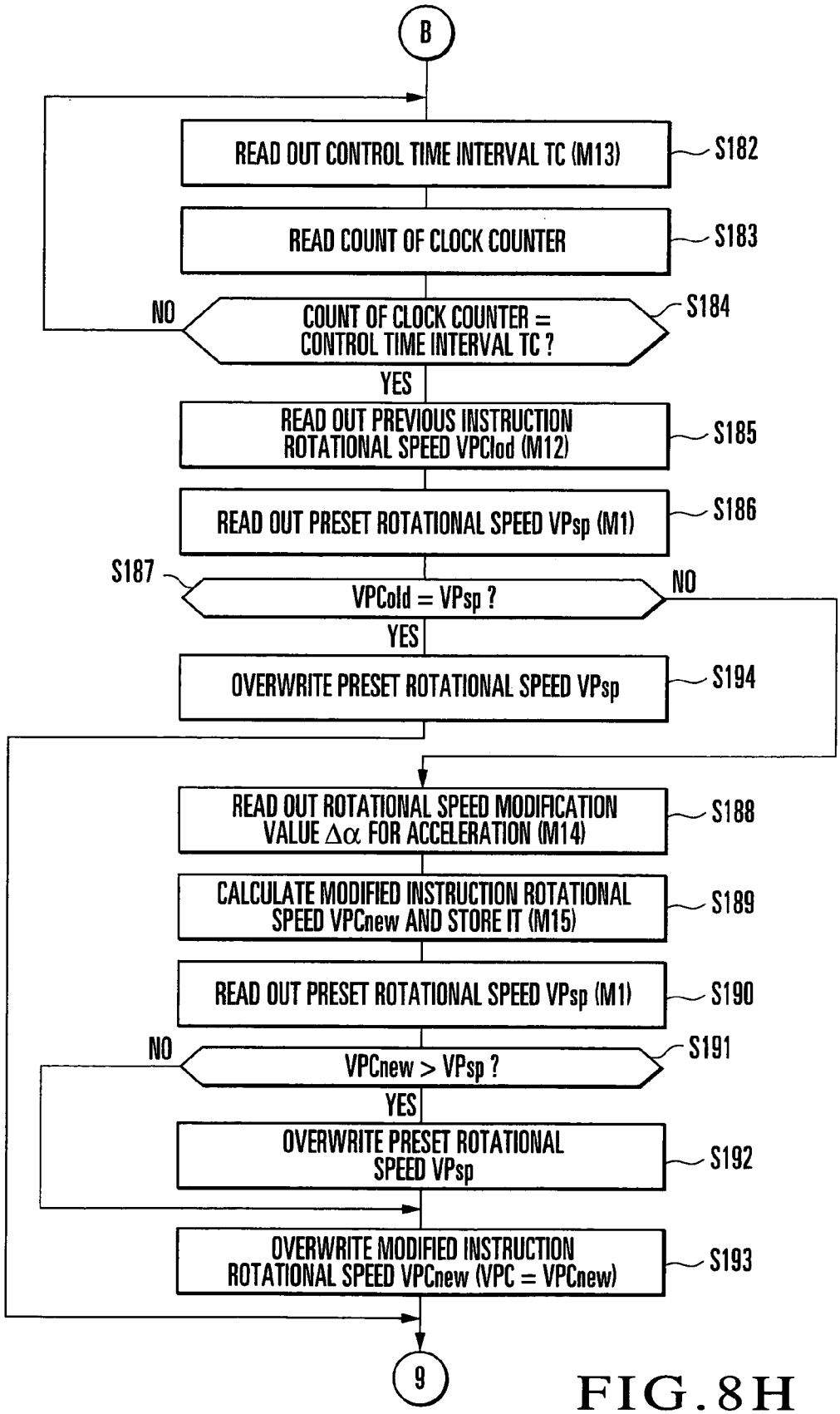
Figure 8I:
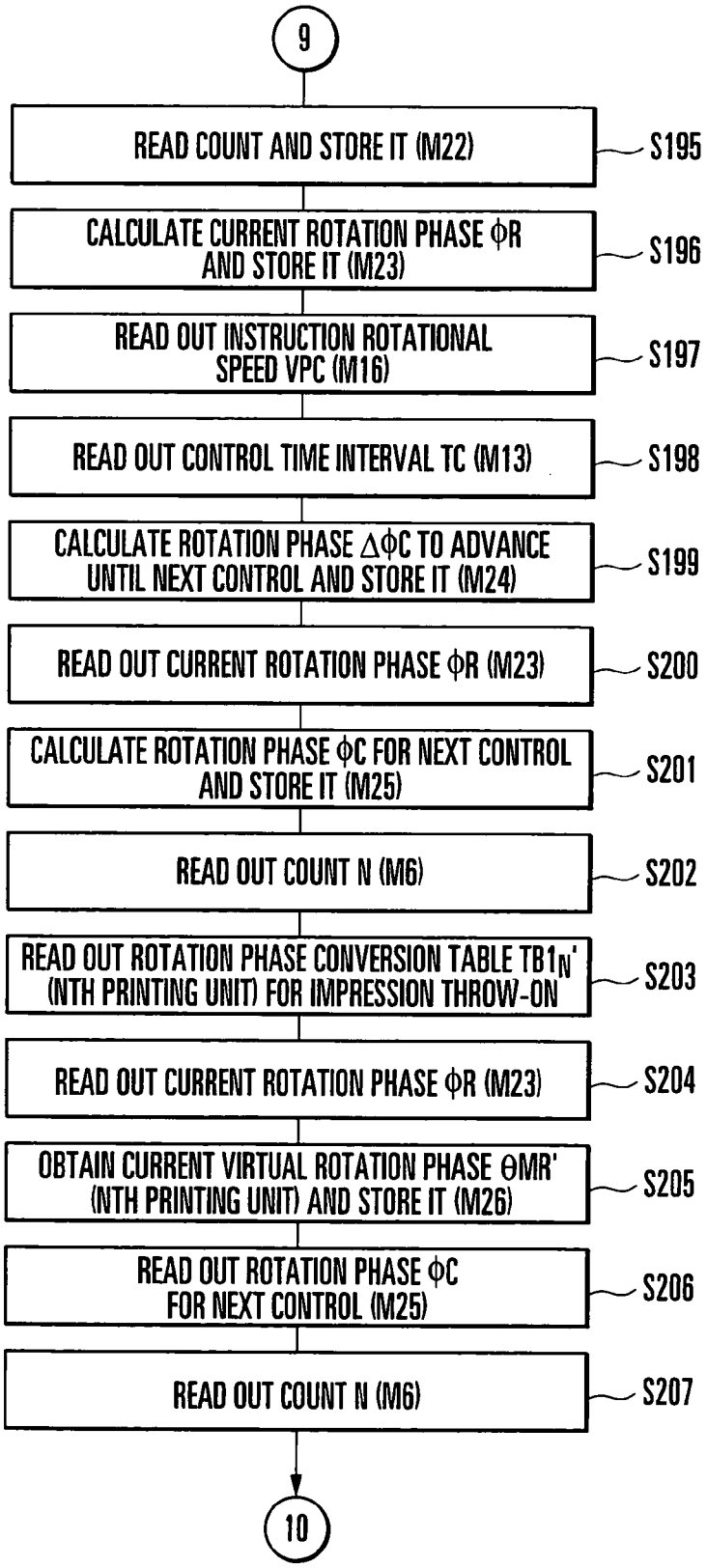
Figure 8J:
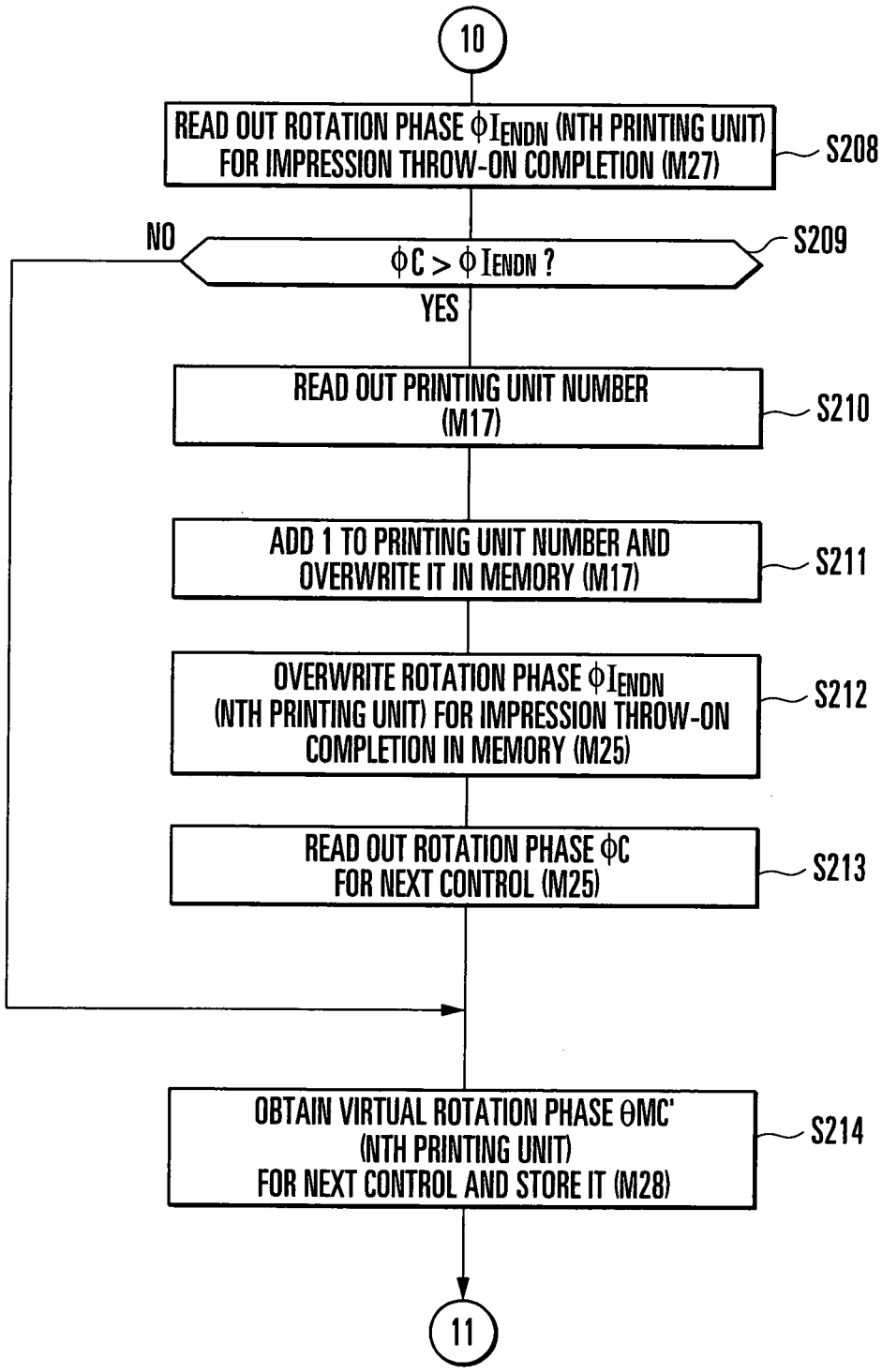

If the timer time T is equal to the control time interval TC (YES in step S155), the CPU 101 reads out the previous instruction rotational speed VPCold in the memory M12 and the preset rotational speed VPsp in the memory M1 (steps S168 and S169), and compares them with each other (step S170 in FIG. 8F).

In this case, if it is confirmed that the previous instruction rotational speed VPCold has not reached VPsp (NO in step S170), the CPU 101 reads out the rotational speed modification value $\Delta\alpha$ for acceleration from the memory M14 and adds it to the previous instruction rotational speed VPCold to obtain a modified instruction rotational speed VPCnew (step S172).

Then, the CPU 101 reads out the preset rotational speed VPsp from the memory M1 (step S173) and compares it with the modified instruction rotational speed VPCnew (step S174). If it is confirmed that the modified instruction rotational speed VPCnew does not exceed the preset rotational speed VPsp (NO in step S174), the CPU 101 sets the modified instruction rotational speed VPCnew as the instruction rotational speed VPC (step S176), and outputs the instruction rotational speed VPC to the drive motor driver 114 (steps S177 and S178).

After outputting the instruction rotational speed VPC to the drive motor driver 114, the CPU 101 writes it in the memory M12 as the previous instruction rotational speed VPCold (step S179). The CPU 101 then returns to step S151 (FIG. 8E) via step S180, and repeats the same operation.

Hence, as soon as the impression throw-on sensor 112 is turned on, measurement of the impression throw-on/off rotation phase $\phi$DR is started, and the speed of the printing press increases by $\Delta\alpha$ in each control time interval TC.

In step S170, if the previous instruction rotational speed VPCold is equal to the preset rotational speed VPsp, the CPU 101 sets the instruction rotational speed VPC as the preset rotational speed VPsp (step S181) and advances to step S177. In step S174, if the modified instruction rotational speed VPCnew exceeds the preset rotational speed VPsp, the CPU 101 sets modified instruction rotational speed VPCnew as the preset rotational speed VPsp (step S175) and advances to step S176.

<Impression Throw-on>

During the repetition of the processing operation, if the printing press rotation phase detection rotary encoder 118 outputs a pulse (YES in step S156, FIG. 8G), the CPU 101 reads out the printing unit number stored in the memory M17 and the total number of printing units stored in the memory M11 (steps S157 and S158), and compares them with each other (step S159).

If the printing unit number is equal to or less than the total number of printing units, the CPU 101 advances to step S160. If the printing unit number exceeds the total number of printing units, the CPU 101 returns to step S153 (FIG. 8E). In this case, the printing unit number is 1, which is equal to or less than the total number of printing units. Hence, the CPU 101 advances to step S160.

In step S160, the CPU 101 reads the count of the impression throw-on/off phase detection counter 117, and obtains a current impression throw-on/off rotation phase $\phi$DR from the readout count of the impression throw-on/off phase detection counter 117 (step S161).

Then, the CPU 101 reads out the count N=1 in the memory M6 (step S162) and the impression throw-on start rotation phase $\phi DI_{ST1}$ of the (N=1)th printing unit from the memory M20 (step S163), and compares the readout impression throw-on start rotation phase $\phi DI_{ST1}$ of the printing unit with the current impression throw-on/off rotation phase $\phi$DR (step S164).

If the current impression throw-on/off rotation phase $\phi$DR is equal to or more than the impression throw-on start rotation phase $\phi DI_{ST1}$ (YES in step S164), the CPU 101 reads out the count N=1 in the memory M6 (step S165) and the impression throw-on completion rotation phase $\phi DI_{ED1}$ of the (N=1)th printing unit from the memory M21 (step S166), and compares the readout impression throw-on completion rotation phase $\phi DI_{ED1}$ of the printing unit with the current impression throw-on/off rotation phase $\phi$DR (step S167).

If it is confirmed that the current impression throw-on/off rotation phase $\phi$DR does not exceed the impression throw-on completion rotation phase $\phi DI_{ED1}$ (YES in step S167), the CPU 101 reads out the control time interval TC stored in the memory M13 (step S182 in FIG. 8H), and compares it with the timer time T which is under counting (steps S183 and S184).

If the timer time T is equal to the control time interval TC (YES in step S184), the CPU 101 reads out the previous instruction rotational speed VPCold in the memory M12 and the preset rotational speed VPsp in the memory M1 (steps S185 and S186), and compares them with each other (step S187).

More specifically, if the current impression throw-on/off rotation phase $\phi$DR is equal to or more than the impression throw-on start rotation phase $\phi DI_{ST1}$, the CPU 101 compares the previous instruction rotational speed VPCold with the preset rotational speed VPsp (step S187) as soon as the timer time T reaches the control time interval TC.

In this case, if it is confirmed that the previous instruction rotational speed VPCold has not reached the preset rotational speed VPsp (NO in step S187), the CPU 101 reads out the rotational speed modification value $\Delta\alpha$ for acceleration from the memory M14 and adds it to the previous instruction rotational speed VPCold to obtain a modified instruction rotational speed VPCnew (step S189).

Then, the CPU 101 reads out the preset rotational speed VPsp from the memory M1 (step S190) and compares it with the modified instruction rotational speed VPCnew (step S191). If it is confirmed that the modified instruction rotational speed VPCnew does not exceed the preset rotational speed VPsp (NO in step S191), the CPU 101 sets the modified instruction rotational speed VPCnew as the instruction rotational speed VPC (step S193).

In step S187, if the previous instruction rotational speed VPCold is equal to the preset rotational speed VPsp, the CPU 101 sets the instruction rotational speed VPC as the preset rotational speed VPsp (step S194). In step S191, if the modified instruction rotational speed VPCnew exceeds the preset rotational speed VPsp, the CPU 101 sets the modified instruction rotational speed VPCnew as the preset rotational speed VPsp (step S192).

Then, the CPU 101 reads the count of the printing press rotation phase detection counter 119 (step S195 in FIG. 8I) and obtains a current rotation phase $\phi R$ of the printing press from this count (step S196). The obtained current rotation phase $\phi R$ of the printing press is stored in the memory M23.

Then, the CPU 101 reads out the instruction rotational speed VPC from the memory M16 (step S197) and the control time interval TC from the memory M13 (step S198), and multiplies the instruction rotational speed VPC by the control time interval TC to obtain a rotation phase $\Delta\phi C$ for which the printing press is to advance until the next control (step S199). The obtained rotation phase $\Delta\phi C$ for which the printing press is to advance until the next control is stored in the memory M24.

Then, the CPU 101 reads out the current rotation phase $\phi R$ of the printing press from the memory M23 (step S200), adds the rotation phase $\Delta\phi C$, for which the printing press is to advance until the next control, to the readout current rotation phase $\phi R$ of the printing press to obtain a rotation phase $\phi C$ of the printing press for the next control (step S201). The obtained rotation phase $\phi C$ of the printing press for the next control is stored in the memory M25.

Then, the CPU 101 reads out the count N=1 from the memory M6 (step S202) and the conversion table $TB1_1$' for converting the rotation phase of the printing press of the (N=1)th printing unit into the rotation phase of the cylinder throw-on/off motor for impression throw-on from the memory M8 (step S203), and obtains the rotation phase of the cylinder throw-on/off motor for impression throw-on corresponding to the current rotation phase $\phi R$ of the printing press from the readout conversion table $TB1_1$' for converting the rotation phase of the printing press of the (N=1)th printing unit into the rotation phase of the cylinder throw-on/off motor for impression throw-on as a current virtual rotation phase $\theta MR'$ of the cylinder throw-on/off motor of the (N=1)th printing unit (steps S204 and S205). The obtained current virtual rotation phase $\theta MR'$ of the cylinder throw-on/off motor of the (N=1)th printing unit is stored in the memory M26.

Then, the CPU 101 reads out the rotation phase $\phi C$ of the printing press for the next control from the memory M25 (step S206) and the rotation phase $\phi I_{END1}$ of the printing press for impression throw-on completion of the (N=1)th printing unit from the memory M27 (step S207; step S208 in FIG. 8J), and compares them with each other (step S209).

In this case, as the rotation phase $\phi C$ of the printing press for the next control does not exceed the rotation phase $\phi I_{END1}$ of the printing press for impression throw-on completion of the (N=1)th printing unit, the CPU 101 advances to step S214 if NO in step S209.

In step S214, the CPU 101 obtains the rotation phase of the cylinder throw-on/off motor for impression throw-on corresponding to the rotation phase $\phi C$ of the printing press for converting the next control from the conversion table $TB1_1$' for the rotation phase of the printing press of the (N=1)th printing unit into the rotation phase of the cylinder throw-on/off motor for impression throw-on as an virtual rotation phase $\theta MC'$ for the next control of the cylinder throw-on/off motor of the (N=1)th printing unit. The obtained virtual rotation phase $\theta MC'$ for the next control of the cylinder throw-on/off motor of the (N=1)th printing unit is stored in the memory M28.

Figure 8K:
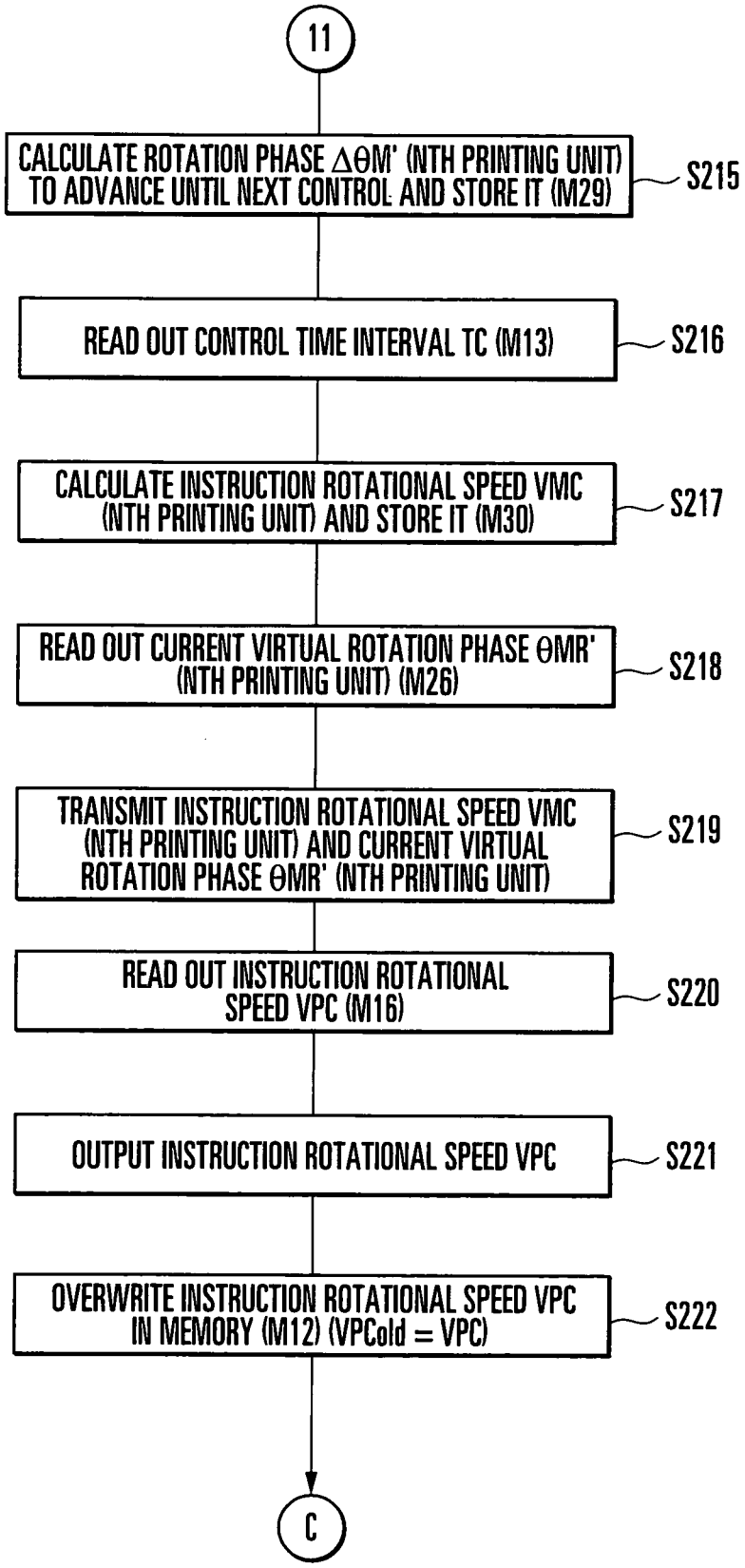
Figure 8L:
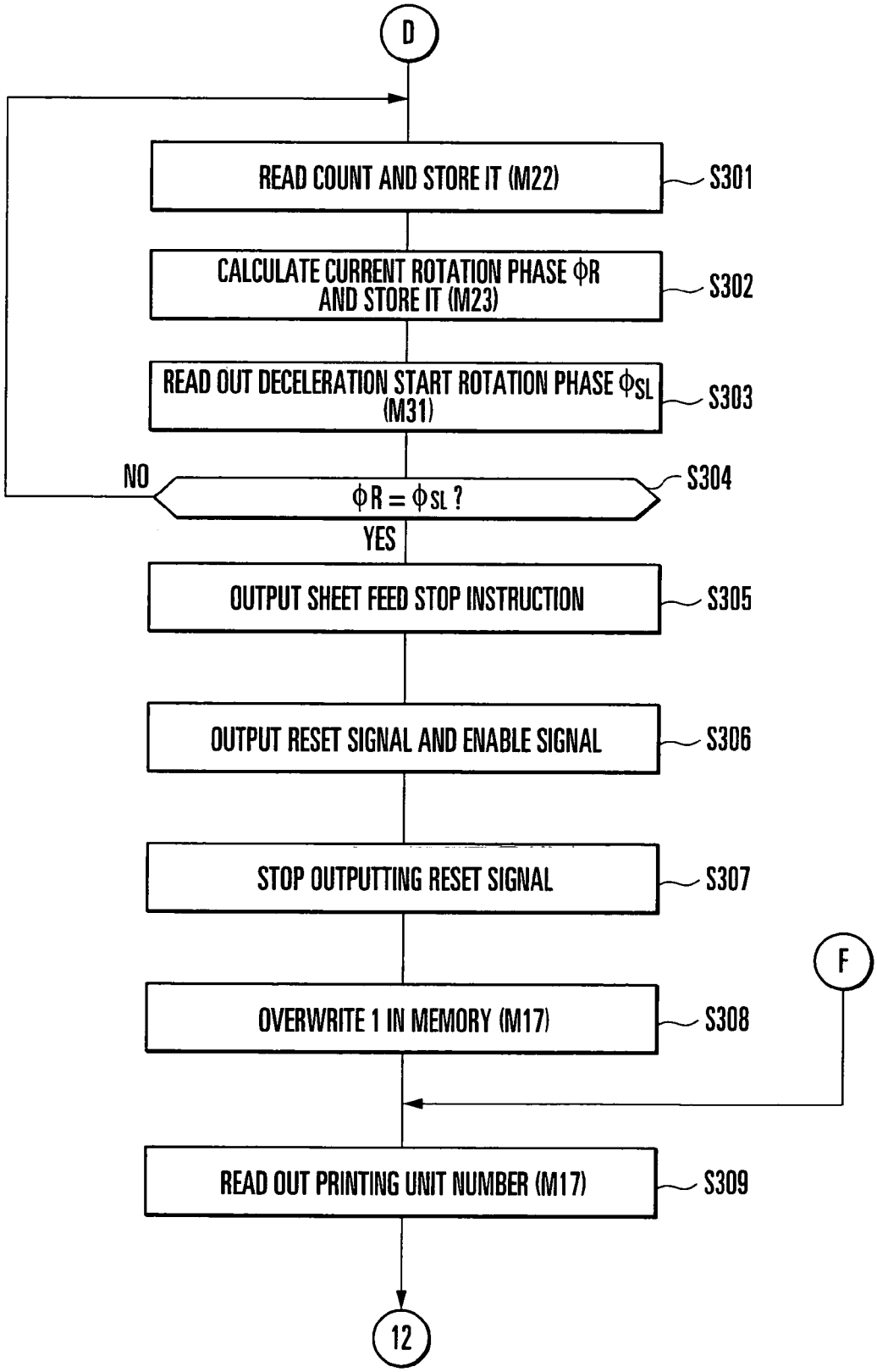

Then, the CPU 101 subtracts the current virtual rotation phase $\theta MR'$ of the cylinder throw-on/off motor of the (N=1)th printing unit from the virtual rotation phase $\theta MC'$ for the next control of the cylinder throw-on/off motor of the (N=1)th printing unit to obtain a rotation phase $\Delta\theta M'$ for which the cylinder throw-on/off motor of the (N=1)th printing unit is to advance until the next control (step S215 in FIG. 8K). The obtained rotation phase $\Delta\theta M'$, for which the cylinder throw-on/off motor of the (N=1)th printing unit is to advance until the next control, is stored in the memory M29.

Then, the CPU 101 divides the rotation phase $\Delta\theta M'$, for which the cylinder throw-on/off motor of the (N=1)th printing unit is to advance until the next control, by the control time interval TC to obtain an instruction rotational speed VMC of the cylinder throw-on/off motor of the (N=1)th printing unit (steps S216 and S217). The obtained instruction rotational speed VMC of the cylinder throw-on/off motor of the (N=1)th printing unit is stored in the memory M30.

Then, the CPU 101 reads out the current virtual rotation phase $\theta MR'$ of the cylinder throw-on/off motor of the (N=1)th printing unit from the memory M26 (step S218), and transmits, to the cylinder throw-on/off controller 200 of the (N=1) th printing unit, the instruction rotational speed VMC of the cylinder throw-on/off motor of the (N=1)th printing unit which is obtained in step S217 and the current virtual rotation phase $\theta MR'$ of the (N=1)th printing unit which is read out in step S218 (step S219). The CPU 101 also reads out the instruction rotational speed VPC from the memory M16 (step S220) and outputs it to the drive motor driver 114 (step S221).

After that, the CPU 101 writes the instruction rotational speed VPC output to the drive motor driver 114 in the memory M12 as the previous instruction rotational speed VPCold (step S222). Then, the CPU 101 returns to the process in step S149 (FIG. 8E) and repeats the same operation.

During this processing operation, in step S209 (FIG. 8J), if the rotation phase $\phi C$ of the printing press for the next control exceeds the rotation phase $\phi I_{END1}$ of the printing press for impression throw-on completion of the (N=1)th printing unit, the CPU 101 reads out the printing unit number in the memory M17 (step S210), adds 1 to the readout printing unit number, and writes the sum in the memory M17 as a new printing unit number (step S211). In this case, since the printing unit number is 1, the CPU 101 sets 2 as the new printing unit number and writes it in the memory M17.

Then, the CPU 101 writes the rotation phase $\phi I_{END1}$ of the printing press for impression throw-on completion of the (N=1)th printing unit in the memory M25 as a rotation phase $\phi C$ of the printing press for the next control (step S212). The CPU 101 then reads out the rotation phase $\phi C$ of the printing press for the next control which is written in the memory M25 (step S213), and advances to the processes from step S214.

The CPU 101 obtains an instruction rotational speed VMC of the cylinder throw-on/off motor and a current virtual rotation phase $\theta MR'$ of the cylinder throw-on/off motor for each of the second-, third-, and fourth-color printing units in the same manner as for the first-color printing unit described above, and transmits them to the cylinder throw-on/off controller 200 of the corresponding printing unit. Thus, in each printing unit, impression throw-on is performed with an appropriate operation pattern to follow a change in speed of the printing press (the changing speed of the rotation phase of the printing press).

<End of Printing>

Assume that desired printing is completed and that the operator turns on the print stop switch 105. The CPU 101 confirms that the print stop switch 105 is ON (YES in step S180, FIG. 8F), and advances to the process in step S301 shown in FIG. 8L.

In this case, the CPU 101 reads the count of the printing press rotation phase detection counter 119 (step S301), and obtains a current rotation phase $\phi R$ of the printing press from this count (step S302). The CPU 101 reads out the deceleration start rotation phase $\phi_{SL}$ of the printing press stored in the memory M31 (step S303) and compares it with the current rotation phase $\phi R$ of the printing press (step S304).

If current rotation phase $\phi R$ of the printing press is equal to the deceleration start rotation phase $\phi_{SL}$ of the printing press (YES in step S304), the CPU 101 outputs a feed stop instruction to the feeding unit 111 (step S305).

Also, the CPU 101 sends a reset signal and enable signal to the impression throw-on/off phase detection counter 117 (step S306), and then stops outputting the reset signal (step S307) to cause the impression throw-on/off phase detection counter 117 to start counting (measurement of the impression throw-on/off rotation phase $\phi DR$) from zero.

Figure 8M:
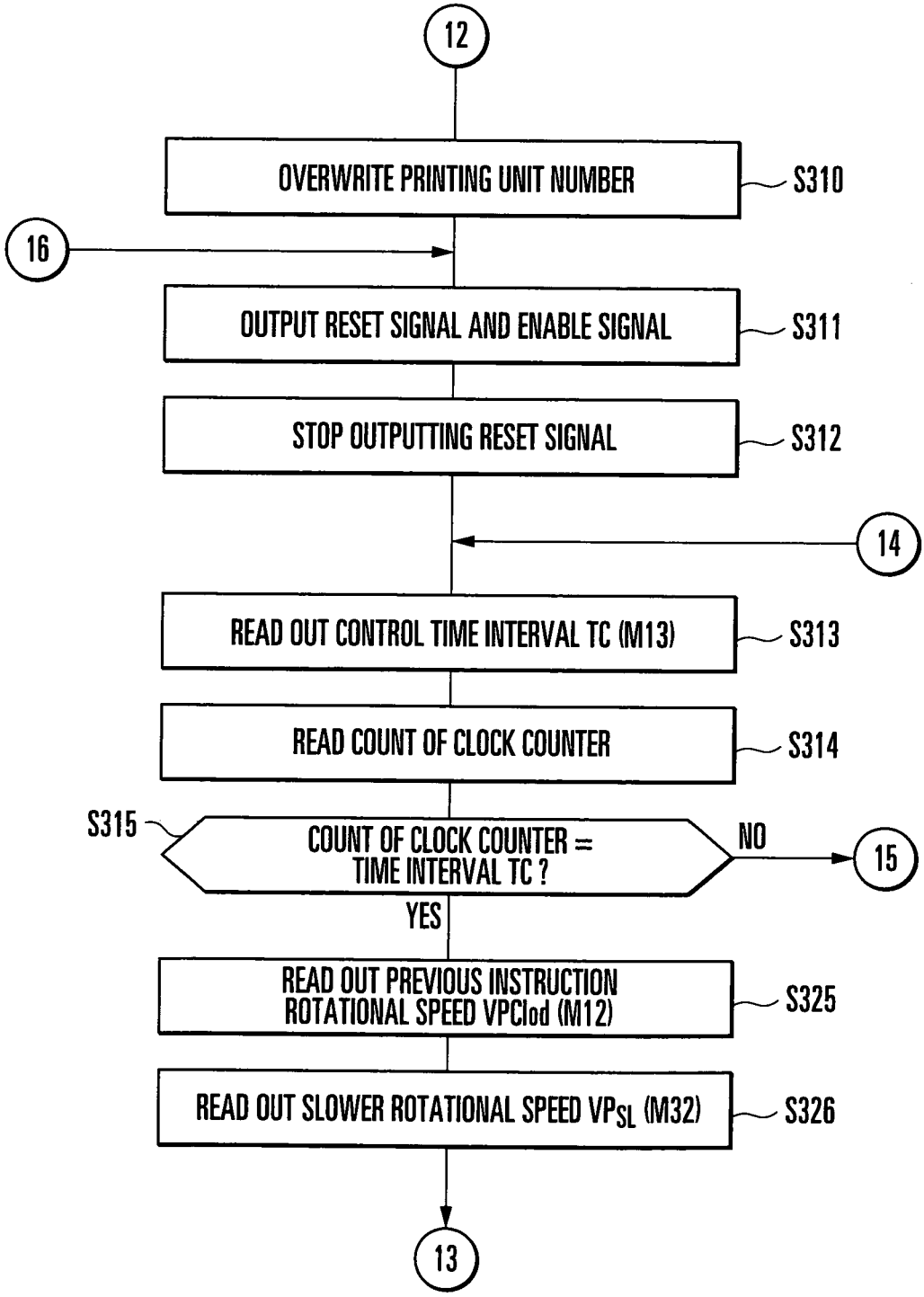

Also, the CPU 101 writes 1 in the memory M17 as the printing unit number (step S308), and the printing unit number written in the memory M17 in the memory M6 as a count N (step S309; step S10 in FIG. 8M).

The CPU 101 also sends a reset signal and enable signal to the internal clock counter 121 (step S311), and then stops outputting the reset signal (step S312) to cause the internal clock counter 121 to start counting from zero (counting of the timer time T).

During counting the timer time T, the CPU 101 reads out the control time interval TC stored in the memory M13 (step S313) and compares it with the timer time T (steps S314 and S315).

Figure 8N:
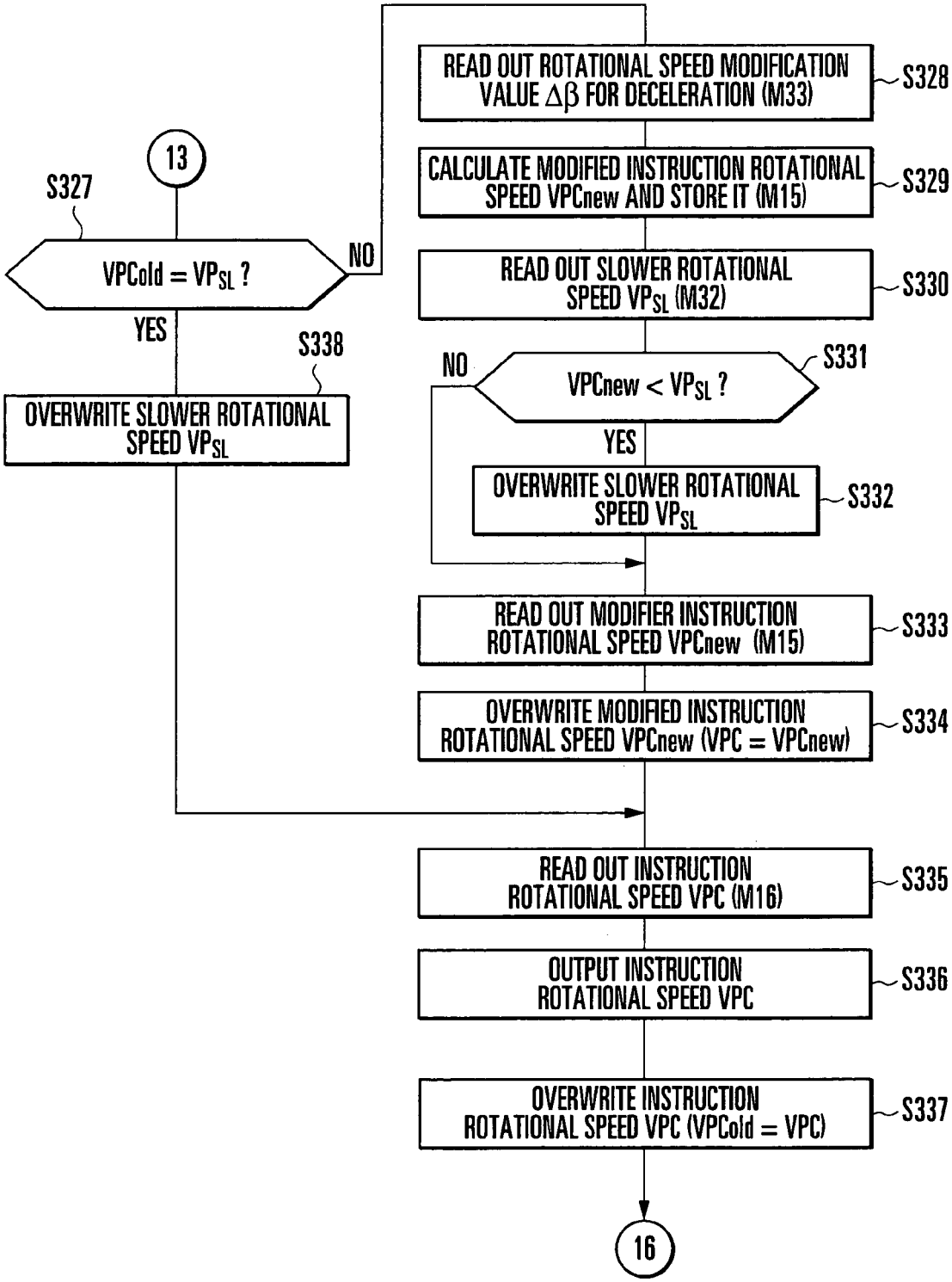
Figure 8O:
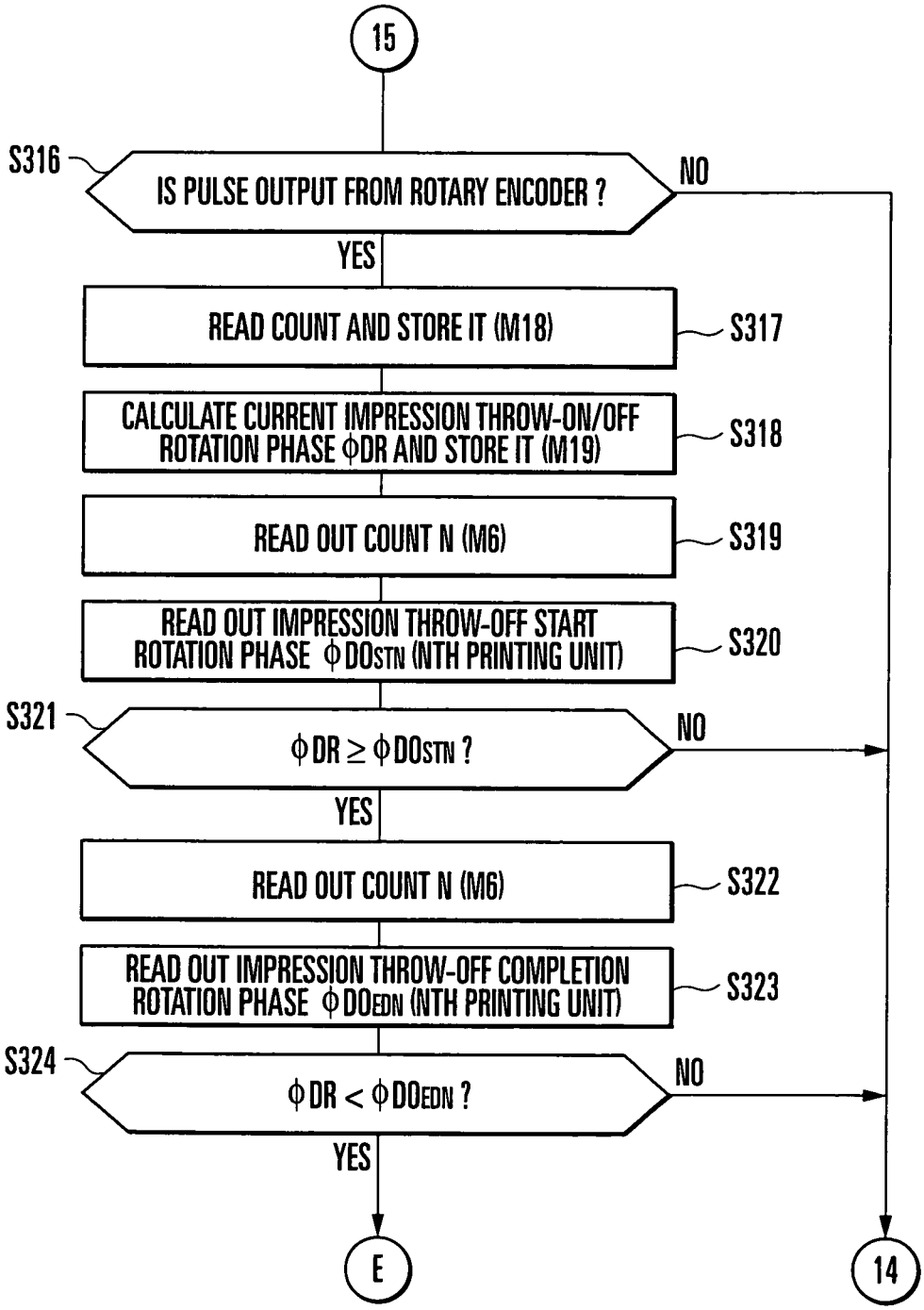
Figure 8P:
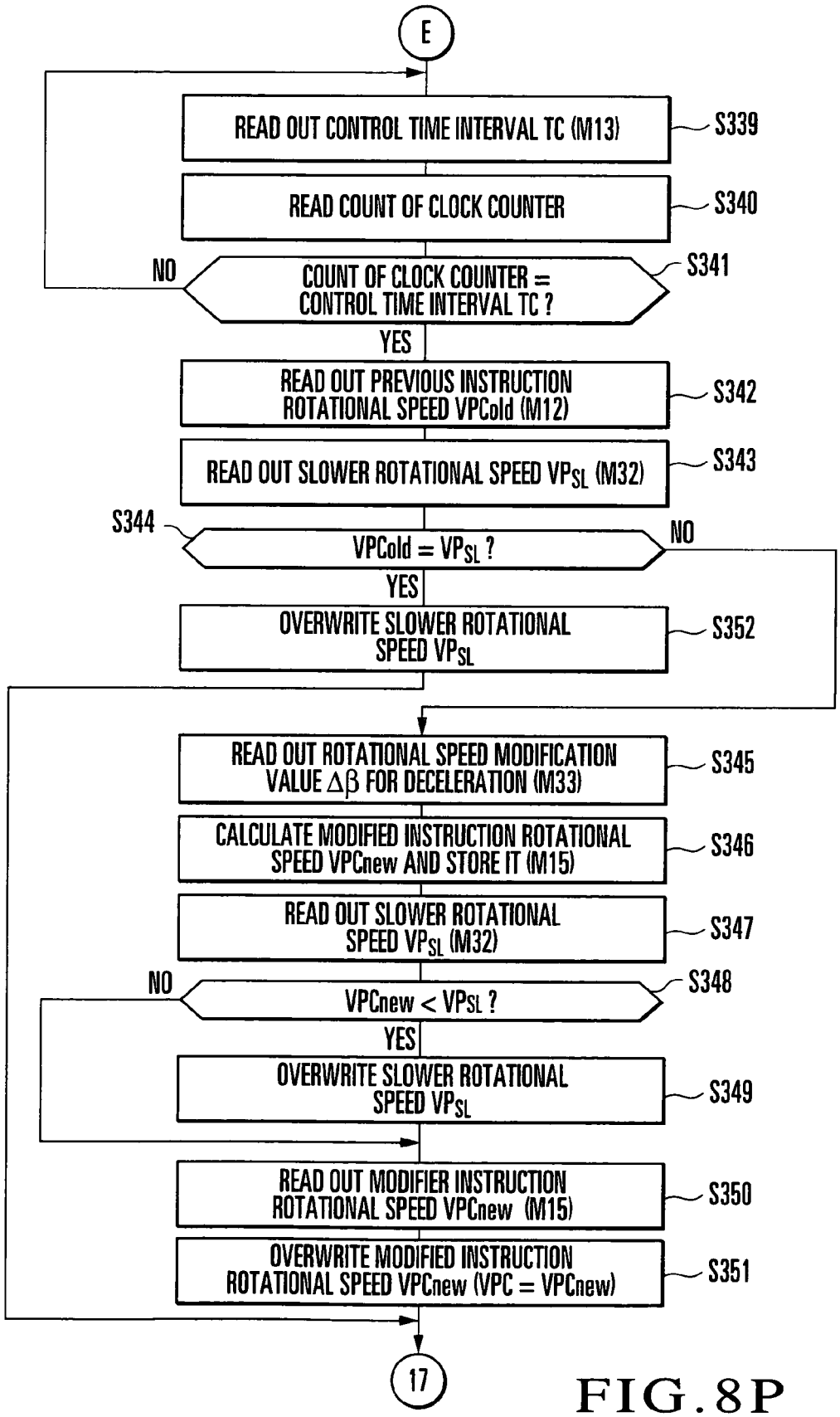
Figure 8Q:
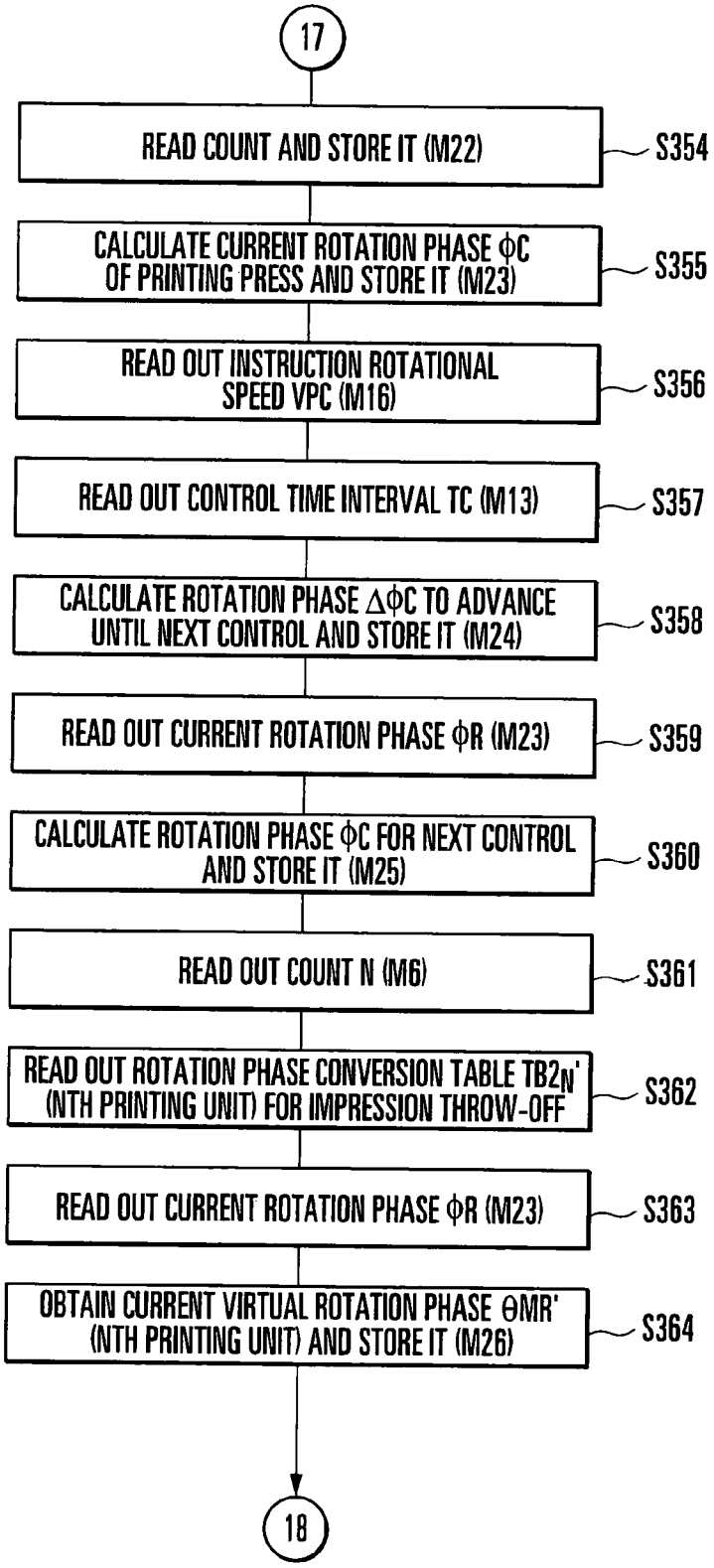
Figure 8R:
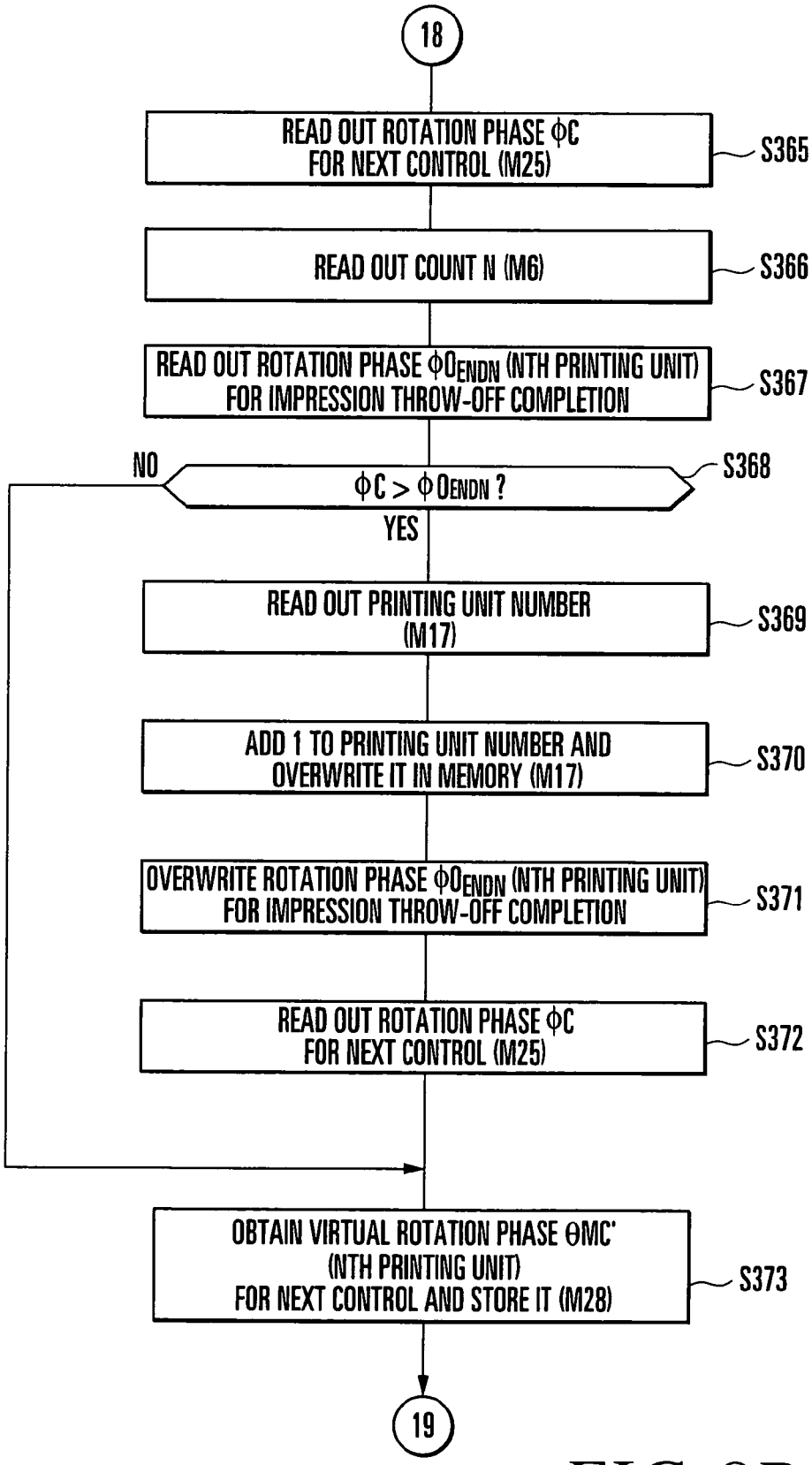

If the timer time T is equal to the control time interval TC (YES in step S315), the CPU 101 reads out the previous instruction rotational speed VPCold in the memory M12 and the slower rotational speed $VP_{SL}$ in the memory M32 (steps S325 and S326), and compares them with each other (step S327 in FIG. 8N).

In this case, as the previous instruction rotational speed VPCold exceeds the slower rotational speed $VP_{SL}$, the CPU 101 advances to step S328 if it is NO in step S327, and reads out the rotational speed modification value $\Delta\beta$ for deceleration from the memory M33. The CPU 101 subtracts the readout rotational speed modification value $\Delta\beta$ for deceleration from the previous instruction rotational speed VPCold to obtain a modified instruction rotational speed VPCnew (step S329).

Then, the CPU 101 reads out the slower rotational speed $VP_{SL}$ from the memory M32 (step S330) and compares it with the modified instruction rotational speed VPCnew (step S331). In this case, as the modified instruction rotational speed VPCnew exceeds the slower rotational speed $VP_{SL}$ (NO in step S331), the CPU 101 sets the modified instruction rotational speed VPCnew as the instruction rotational speed VPC (steps S333 and S334), and outputs the instruction rotational speed VPC to the drive motor driver 114 (steps S335 and S336).

After outputting the instruction rotational speed VPC to the drive motor driver 114, the CPU 101 writes it in the memory M12 as the previous instruction rotational speed VPCold (step S337). The CPU 101 returns to step S311 (FIG. 8M) and repeats the same operation.

Hence, as soon as the current rotation phase $\phi R$ of the printing press becomes the deceleration start rotation phase $\phi_{SL}$ of the printing press, measurement of the impression throw-on/off rotation phase $\phi DR$ is started, and the speed of the printing press lowers by $\Delta\beta$ in each control time interval TC.

In step S327, if the previous instruction rotational speed VPCold is equal to the slower rotational speed $VP_{SL}$, the CPU 101 sets the instruction rotational speed VPC as the slower rotational speed $VP_{SL}$ (step S338) and advances to step S335. In step S331, if the modified instruction rotational speed VPCnew is less than the slower rotational speed $VP_{SL}$, the CPU 101 sets modified instruction rotational speed VPCnew as the slower rotational speed $VP_{SL}$ (step S332) and advances to step S333.

<Impression Throw-Off>

During the repetition of the processing operation, if the printing press rotation phase detection rotary encoder 118 outputs a pulse (YES in step S316, FIG. 8O), the CPU 101 reads the count of the impression throw-on/off phase detection counter 117 (step S317), and obtains a current impression throw-on/off rotation phase $\phi DR$ from the readout count of the impression throw-on/off phase detection counter 117 (step S318).

Then, the CPU 101 reads out the count N=1 in the memory M6 (step S319) and the impression throw-off start rotation phase $\phi DO_{ST1}$ of the (N=1)th printing unit from the memory M34 (step S320), and compares the readout impression throw-off start rotation phase $\phi DO_{ST1}$ of the printing unit with the current impression throw-on/off rotation phase $\phi DR$ (step S321).

If the current impression throw-on/off rotation phase $\phi DR$ is equal to or more than the impression throw-off start rotation phase $\phi DO_{ST1}$ (YES in step S321), the CPU 101 reads out the count N=1 in the memory M6 (step S322) and the impression throw-off completion rotation phase $\phi DO_{ED1}$ of the (N=1)th printing unit from the memory M35 (step S323), and compares the readout impression throw-off completion rotation phase $\phi DO_{ED1}$ of the printing unit with the current impression throw-on/off rotation phase $\phi DR$ (step S324).

If it is confirmed that the current impression throw-on/off rotation phase $\phi DR$ does not exceed the impression throw-off completion rotation phase $\phi DO_{ED1}$ (YES in step S324), the CPU 101 reads out the control time interval TC stored in the memory M13 (step S339 in FIG. 8P), and compares it with the timer time T which is under counting (steps S340 and S341).

If the timer time T is equal to the control time interval TC (YES in step S341), the CPU 101 reads out the previous instruction rotational speed VPCold in the memory M12 and the slower rotational speed $VP_{SL}$ in the memory M32 (steps S342 and S343), and compares them with each other (step S344).

More specifically, if the current impression throw-on/off rotation phase $\phi DR$ is equal to or more than the impression throw-off start rotation phase $\phi DO_{ST1}$, the CPU 101 compares the previous instruction rotational speed VPCold with the slower rotational speed $VP_{SL}$ (step S344) as soon as the timer time T reaches the control time interval TC.

In this case, if it is confirmed that the previous instruction rotational speed VPCold has not reached the slower rotational speed $VP_{SL}$ (NO in step S344), the CPU 101 reads out the rotational speed modification value $\Delta\beta$ for deceleration from the memory M33 (step S345) and subtracts it from the previous instruction rotational speed VPCold to obtain a modified instruction rotational speed VPCnew (step S346).

Then, the CPU 101 reads out the slower rotational speed $VP_{SL}$ from the memory M32 (step S347) and compares it with the modified instruction rotational speed VPCnew (step S348). If it is confirmed that the modified instruction rotational speed VPCnew does not exceed the slower rotational speed $VP_{SL}$ (NO in step S348), the CPU 101 sets the modified instruction rotational speed VPCnew as the instruction rotational speed VPC (steps S350 and 351).

In step S344, if the previous instruction rotational speed VPCold is equal to the slower rotational speed $VP_{SL}$, the CPU 101 sets the instruction rotational speed VPC as the slower rotational speed $VP_{SL}$ (step S352). In step S348, if the modified instruction rotational speed VPCnew is less than the slower rotational speed $VP_{SL}$, the CPU 101 sets the modified instruction rotational speed VPCnew as the slower rotational speed $VP_{SL}$ (step S349).

Then, the CPU 101 reads the count of the printing press rotation phase detection counter 119 (step S354 in FIG. 8Q) and obtains a current rotation phase $\phi R$ of the printing press from this count (step S355). The obtained current rotation phase $\phi R$ of the printing press is stored in the memory M23.

Then, the CPU 101 reads out the instruction rotational speed VPC from the memory M16 (step S356) and the control time interval TC from the memory M13 (step S357), and multiplies the instruction rotational speed VPC by the control time interval TC to obtain a rotation phase $\Delta\phi C$ for which the printing press is to advance until the next control (step S358). The obtained rotation phase $\Delta\phi C$ for which the printing press is to advance until the next control is stored in the memory M24.

Then, the CPU 101 reads out the current rotation phase $\phi R$ of the printing press from the memory M23 (step S359), adds the rotation phase $\Delta\phi C$, for which the printing press is to advance until the next control, to the readout current rotation phase $\phi R$ of the printing press to obtain a rotation phase $\phi C$ of the printing press for the next control (step S360). The obtained rotation phase $\phi C$ of the printing press for the next control is stored in the memory M25.

Then, the CPU 101 reads out the count N=1 from the memory M6 (step S361) and the conversion table $TB2_1'$ for converting the rotation phase of the printing press of the (N=1)th printing unit into the rotation phase of the cylinder throw-on/off motor for impression throw-off from the memory M10 (step S362), and obtains the rotation phase of the cylinder throw-on/off motor for impression throw-off corresponding to the current rotation phase $\phi R$ of the printing press from the readout conversion table $TB2_1'$ for converting the rotation phase of the printing press of the (N=1)th printing unit into the rotation phase of the cylinder throw-on/off motor for impression throw-off as a current virtual rotation phase $\theta MR'$ of the cylinder throw-on/off motor of the (N=1)th printing unit (steps S363 and S364). The obtained current virtual rotation phase $\theta MR'$ of the cylinder throw-on/off motor of the (N=1)th printing unit is stored in the memory M26.

Then, the CPU 101 reads out the rotation phase $\phi C$ of the printing press for the next control from the memory M25 (step S365 in FIG. 8R) and the rotation phase $\phi O_{END1}$ of the printing press for impression throw-off completion of the (N=1)th printing unit (steps S366 and S367), and compares them with each other (step S368).

In this case, as the rotation phase $\phi C$ of the printing press for the next control does not exceed the rotation phase $\phi O_{END1}$ of the printing press for impression throw-off completion of the (N=1)th printing unit, the CPU 101 advances to step S373 if NO in step S368.

In step S373, the CPU 101 obtains the rotation phase of the cylinder throw-on/off motor for impression throw-off corresponding to the rotation phase $\phi C$ of the printing press for the next control from the conversion table $TB2_1'$ for converting the rotation phase of the printing press of the (N=1)th printing unit into the rotation phase of the cylinder throw-on/off motor for impression throw-off as an virtual rotation phase $\theta MC'$ for the next control of the cylinder throw-on/off motor of the (N=1)th printing unit. The obtained virtual rotation phase $\theta MC'$ for the next control of the cylinder throw-on/off motor of the (N=1)th printing unit is stored in the memory M28.

Figure 8S:
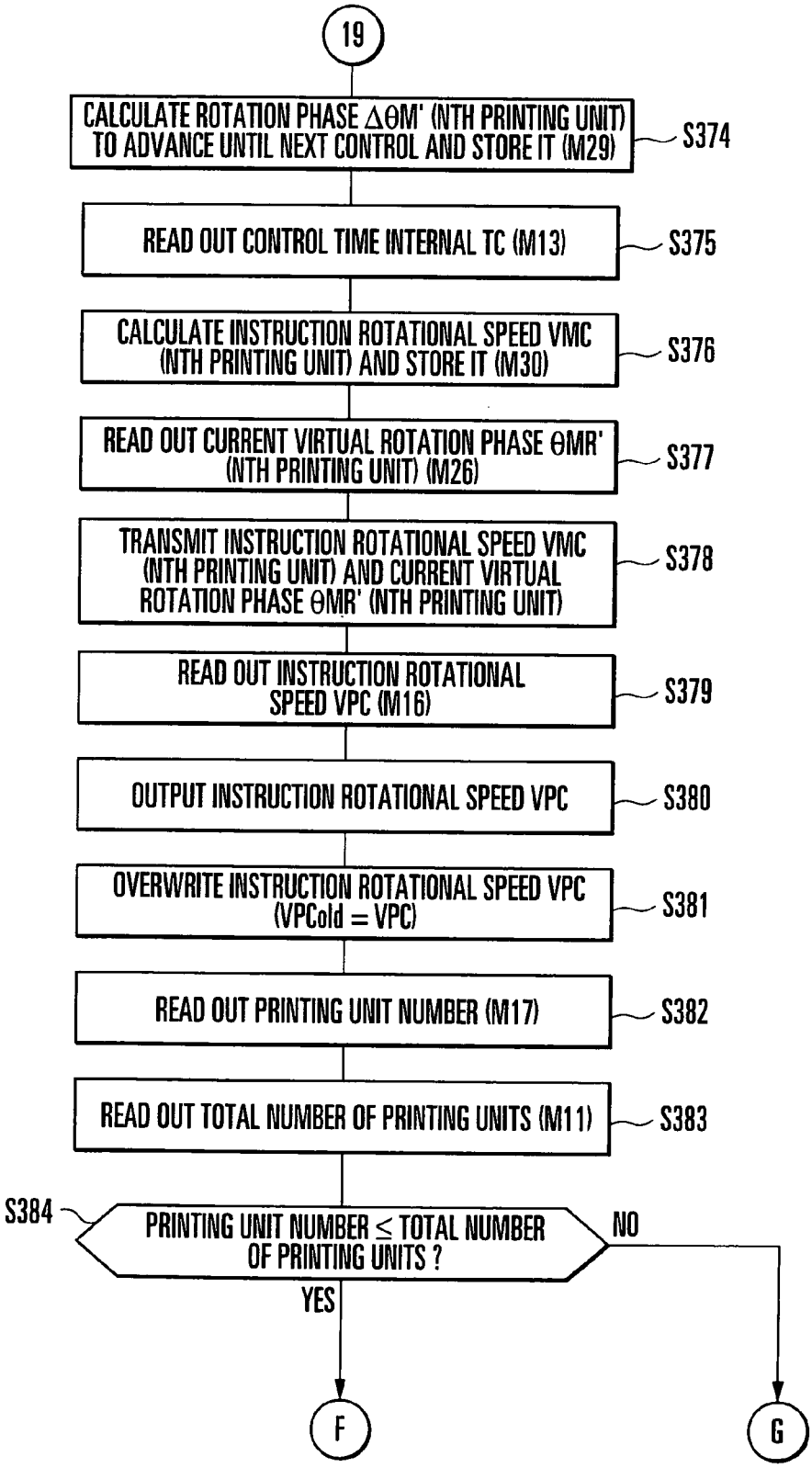
Figure 8T:
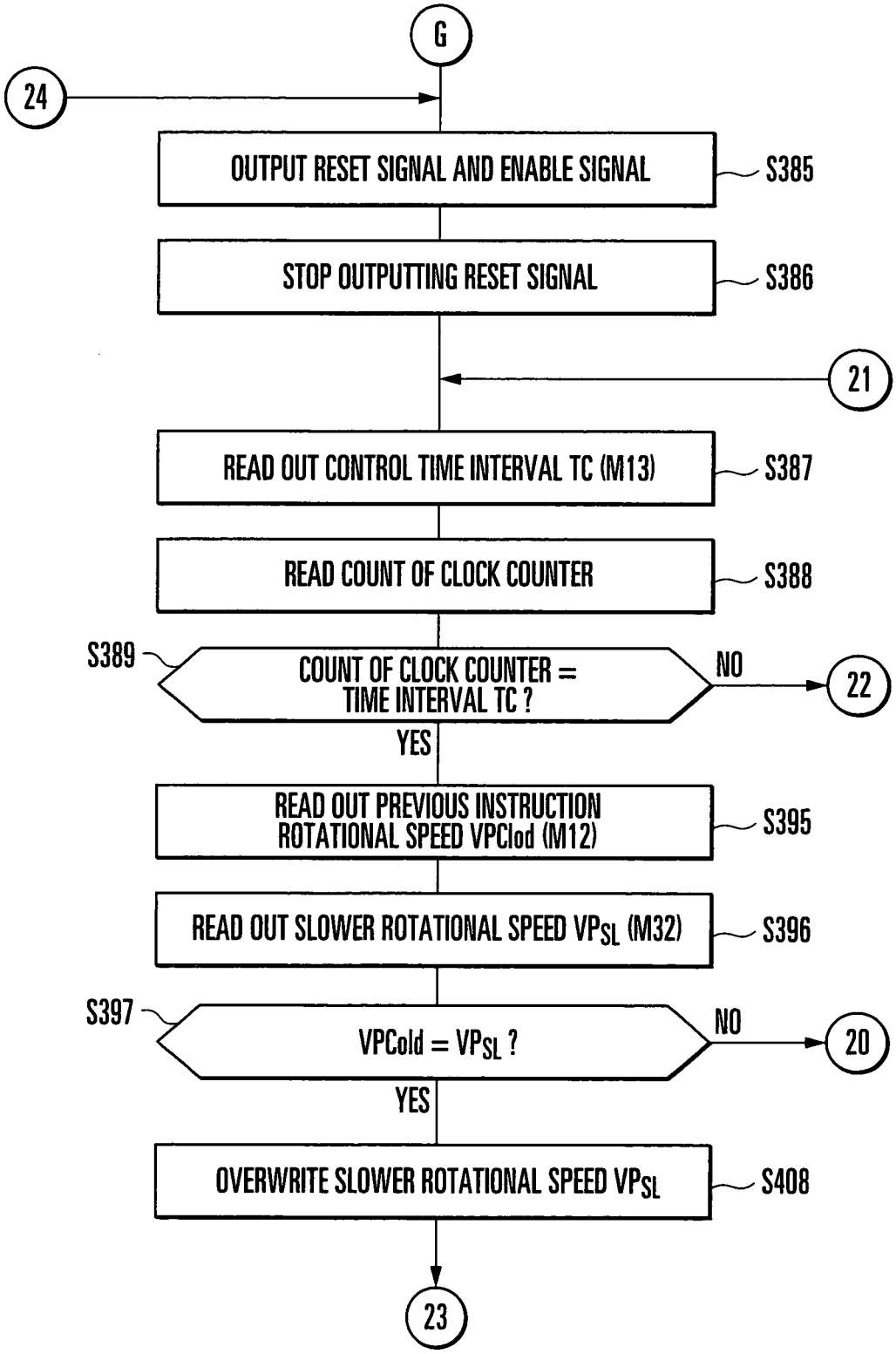

Then, the CPU 101 subtracts the current virtual rotation phase $\theta MR'$ of the cylinder throw-on/off motor of the (N=1)th printing unit from the virtual rotation phase $\theta MC'$ for the next control of the cylinder throw-on/off motor of the (N=1)th printing unit to obtain a rotation phase $\Delta\theta M'$ for which the cylinder throw-on/off motor of the (N=1)th printing unit is to advance until the next control (step S374 in FIG. 8S). The obtained rotation phase $\Delta\theta M'$, for which the cylinder throw-on/off motor of the (N=1)th printing unit is to advance until the next control, is stored in the memory M29.

Then, the CPU 101 divides the rotation phase $\Delta\theta M'$, for which the cylinder throw-on/off motor of the (N=1)th printing unit is to advance until the next control, by the control time interval TC to obtain an instruction rotational speed VMC of the cylinder throw-on/off motor of the (N=1)th printing unit (steps S375 and S376). The obtained instruction rotational speed VMC of the cylinder throw-on/off motor of the (N=1)th printing unit is stored in the memory M30.

Then, the CPU 101 reads out the current virtual rotation phase $\theta MR'$ of the cylinder throw-on/off motor of the (N=1)th printing unit from the memory M26 (step S377), and transmits, to the cylinder throw-on/off controller 200 of the (N=1) th printing unit, the instruction rotational speed VMC of the cylinder throw-on/off motor of the (N=1)th printing unit which is obtained in step S376 and the current virtual rotation phase $\theta MR'$ of the (N=1)th printing unit which is read out in step S377 (step S378). The CPU 101 also reads out the instruction rotational speed VPC from the memory M16 (step S379) and outputs it to the drive motor driver 114 (step S380).

After that, the CPU 101 writes the instruction rotational speed VPC output to the drive motor driver 114 in the memory M12 as the previous instruction rotational speed VPCold (step S381) and reads out the printing unit number in the memory M17 and the total number of printing units in the memory M11 (steps S382 and S383). Upon confirmation of the fact that the printing unit number is equal to or less than the total number of printing units (YES in step S384), the CPU 101 returns to the process in step S309 (FIG. 8L) and repeats the same operation.

During this processing operation, in step S368 (FIG. 8R), if the rotation phase $\phi C$ of the printing press for the next control exceeds the rotation phase $\phi O_{END1}$ of the printing press for impression throw-off completion of the (N=1)th printing unit, the CPU 101 reads out the printing unit number in the memory M17 (step S369), adds 1 to the readout printing unit number, and writes the sum in the memory M17 as a new printing unit number (step S370). In this case, since the printing unit number is 1, the CPU 101 sets 2 as the new printing unit number and writes it in the memory M17.

Then, the CPU 101 writes the rotation phase $\phi O_{END1}$ of the printing press for impression throw-off completion of the (N=1)th printing unit in the memory M25 as a rotation phase $\phi C$ of the printing press for the next control (step S371). The CPU 101 then reads out the rotation phase $\phi C$ of the printing press for the next control which is written in the memory M25 (step. S372), and advances to the processes from step S373.

The CPU 101 obtains an instruction rotational speed VMC of the cylinder throw-on/off motor and a current virtual rotation phase θMR' of the cylinder throw-on/off motor for each of the second-, third-, and fourth-color printing units in the same manner as for the first-color printing unit described above, and transmits them to the cylinder throw-on/off controller 200 of the corresponding printing unit. Thus, in each printing unit, impression throw-off is performed with an appropriate operation pattern to follow a change in speed of the printing press (the changing speed of the rotation phase of the printing press).

When impression throw-off in the fourth-color printing unit is completed and the printing unit number exceeds the total number of printing units in step S384, the CPU 101 sends a reset signal and enable signal to the internal clock counter 121 (step S385 in FIG. 8T), and then stops outputting the reset signal (S386) to cause the internal clock counter 121 to start counting (counting of the timer time T) from zero.

During this counting of the timer time T, the CPU 101 reads out the control time interval TC stored in the memory M13 (step S387) and compares it with the timer time T (steps S388 and S389).

If the timer time T is equal to the control time interval TC (YES in step S389), the CPU 101 reads out the previous instruction rotational speed VPCold in the memory M12 and the slower rotational speed $VP_{SL}$ in the memory M32 (steps S395 and S396), and compares them with each other (step S397).

In this case, upon confirmation of the fact that the previous instruction rotational speed VPCold has not reached the slower rotational speed reached $VP_{SL}$ (NO in step S397), the CPU 101 reads out the rotational speed modification value Δβ for deceleration from the memory M33 (step S398 in FIG. 8U) and subtracts it from the previous instruction rotational speed VPCold to obtain a modified instruction rotational speed VPCnew (step S399).

Then, the CPU 101 reads out the slower rotational speed $VP_{SL}$ from the memory M32 (step S400) and compares it with the modified instruction rotational speed VPCnew (step S401). Upon confirmation of the fact that the modified instruction rotational speed VPCnew is equal to or larger than the slower rotational speed $VP_{SL}$ (NO in step S401), the CPU 101 sets the modified instruction rotational speed VPCnew as the instruction rotational speed VPC (steps S403 and S404), and outputs the instruction rotational speed VPC to the drive motor driver 114 (steps S405 and S406).

After outputting the instruction rotational speed VPC to the drive motor driver 114, the CPU 101 writes it in the memory M12 as the previous instruction rotational speed VPCold (step S407). The CPU 101 returns to step S385 (FIG. 8T), and repeats the same operation. Hence, even after impression throw-off in the fourth-color printing unit is completed, the speed of the printing press decreases by Δβ in each control time interval TC.

Figure 8U:
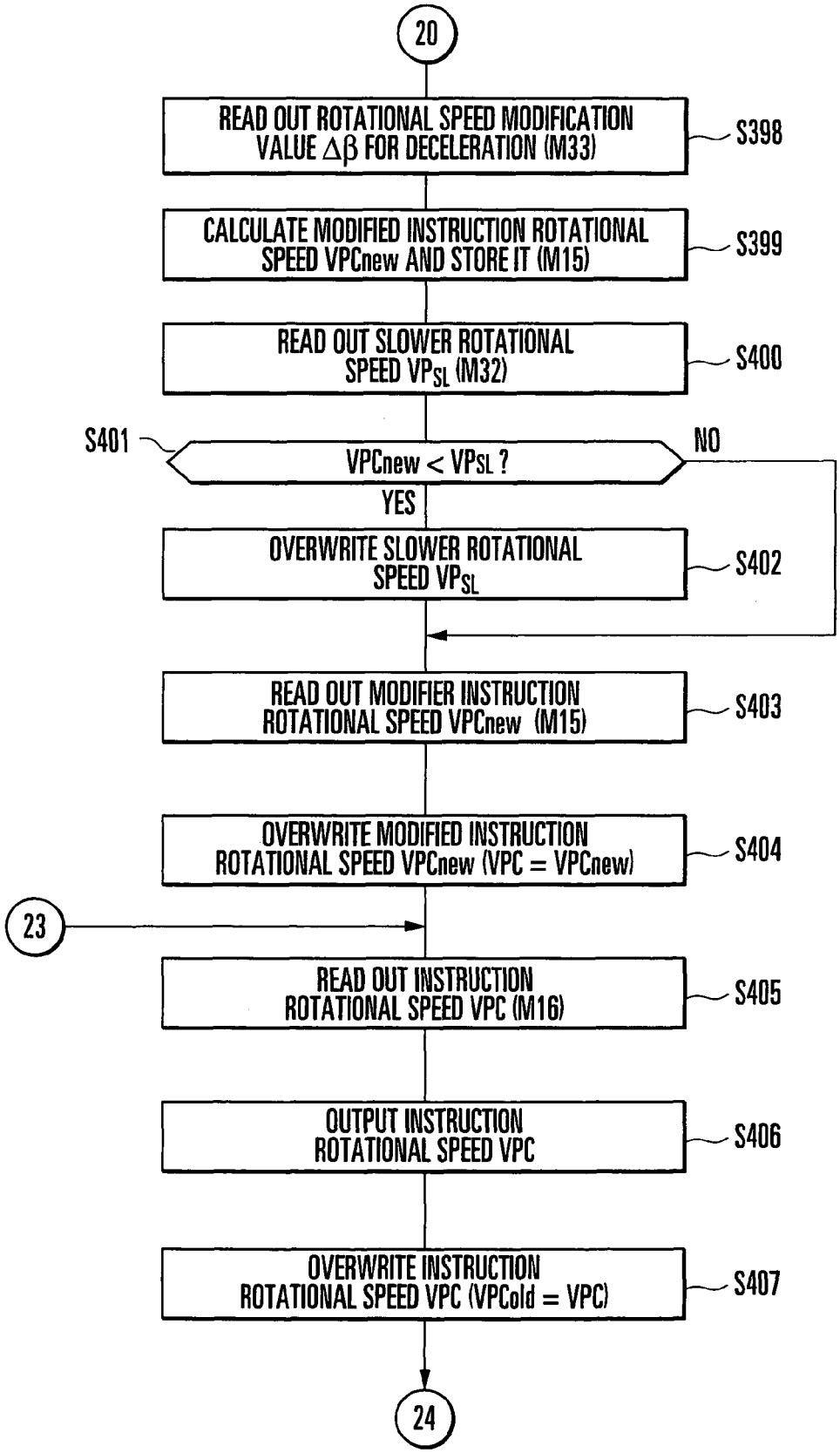
Figure 8V:
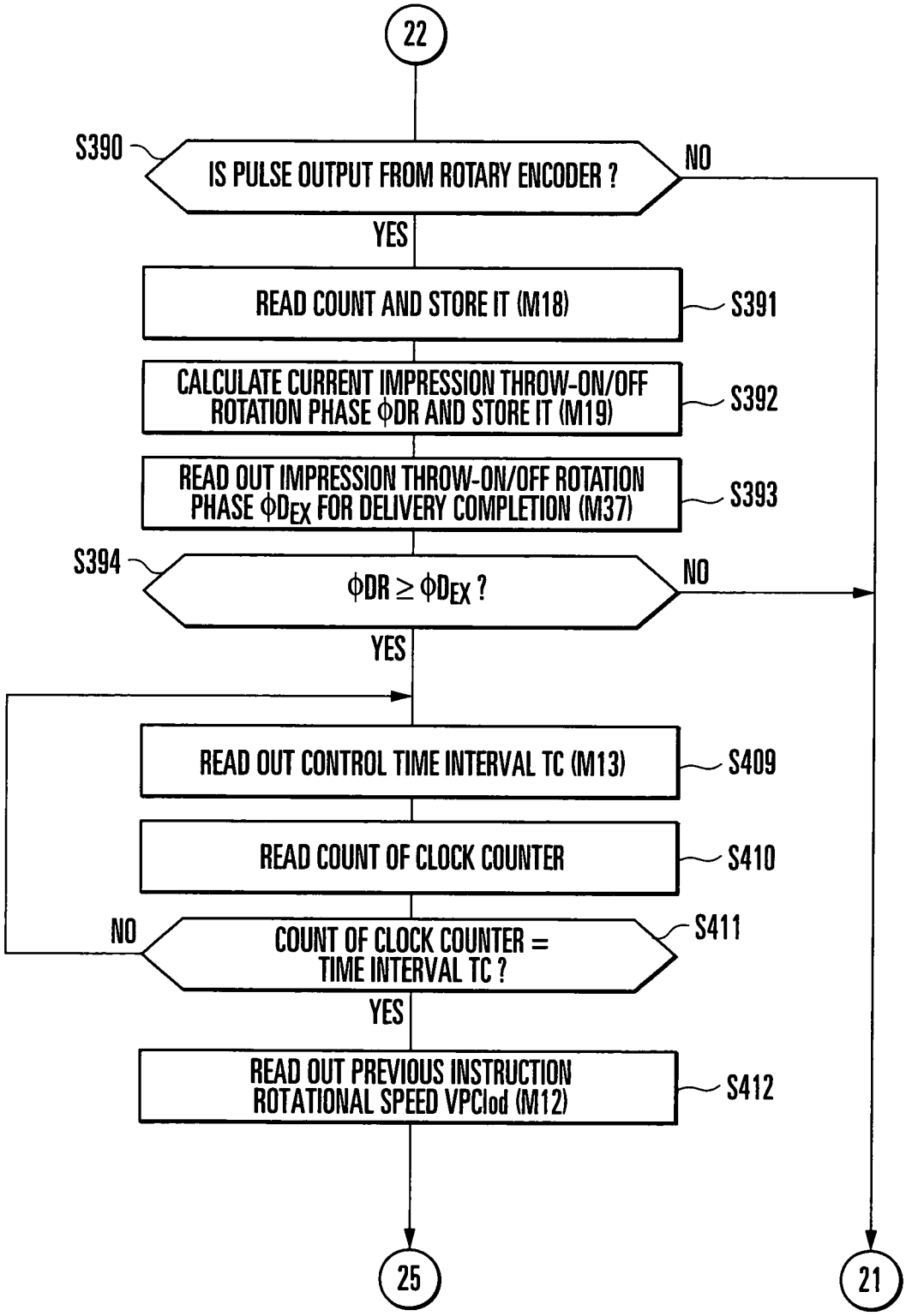

In step S397, if the previous instruction rotational speed VPCold is equal to the slower rotational speed $VP_{SL}$, the CPU 101 sets the instruction rotational speed VPC as the slower rotational speed $VP_{SL}$ (step S408) and advances to step S405 (FIG. 8U). In step S401, if the modified instruction rotational speed VPCnew is less than the slower rotational speed $VP_{SL}$, the CPU 101 sets the modified instruction rotational speed VPCnew as the slower rotational speed $VP_{SL}$ (step S402) and advances to step S403.

<Completion of Delivery>

During the repetition of the processing operation, if the printing press rotation phase detection rotary encoder 118 outputs a pulse (YES in step S390, FIG. 8V), the CPU 101 reads the count of the impression throw-on/off phase detection counter 117 (step S391), and obtains a current impression throw-on/off rotation phase $\phi DR$ from the readout count of the impression throw-on/off phase detection counter 117 (step S392).

Then, the CPU 101 reads out the impression throw-on/off rotation phase $\phi D_{EX}$ for completion of delivery from the memory M37 (step S393), and compares it with the readout impression throw-on/off rotation phase $\phi DR$ for completion of delivery (step S394).

Upon confirmation of the fact that the current impression throw-on/off rotation phase $\phi DR$ exceeds the impression throw-on/off rotation phase rotation phase $\phi D_{EX}$ for completion of delivery (YES in step S394), the CPU 101 reads out the control time interval TC stored in the memory M13 (step S409), and compares it with the timer time T which is under counting (steps S410 and S411).

Figure 8W:
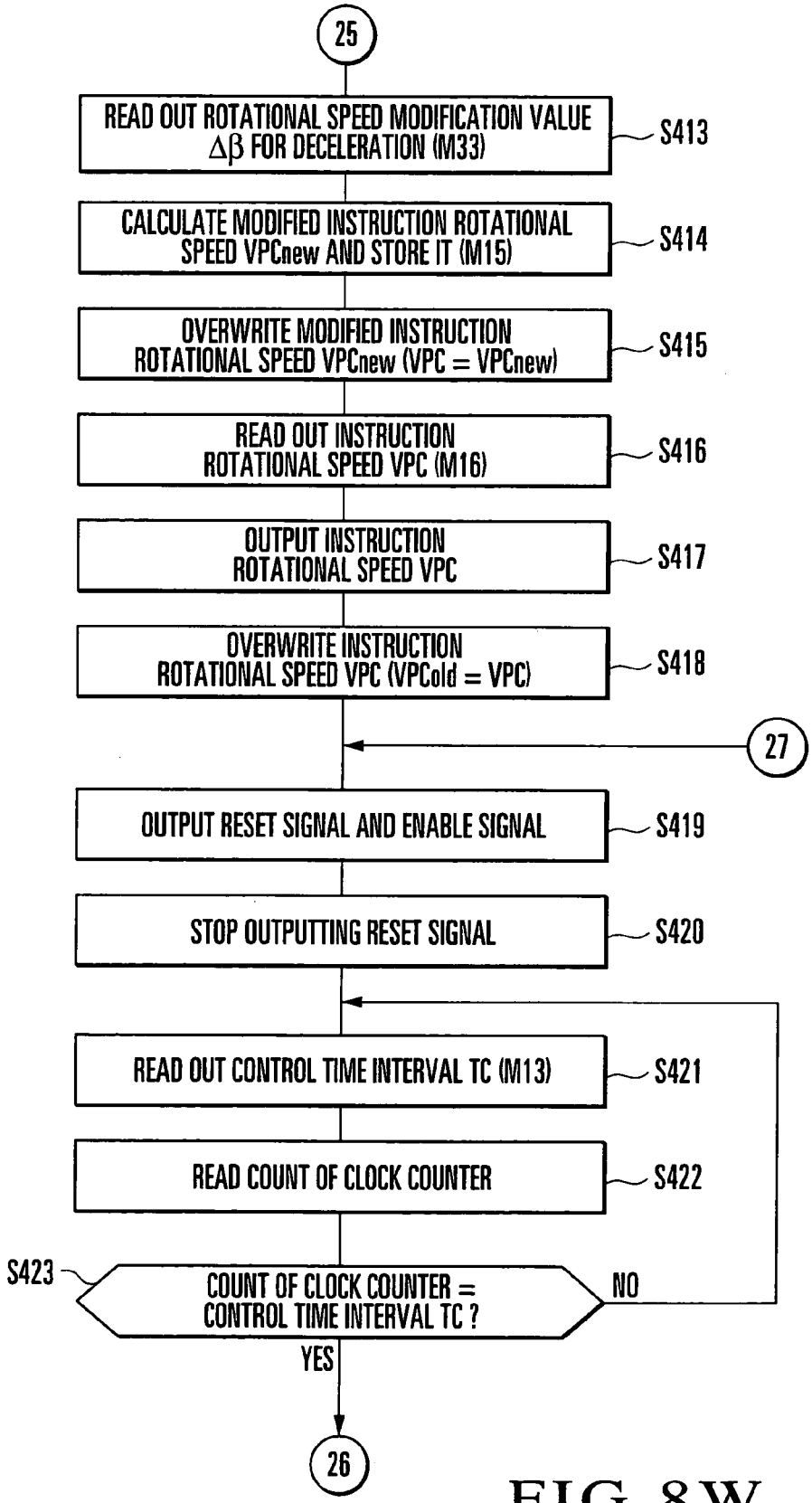
Figure 8X:
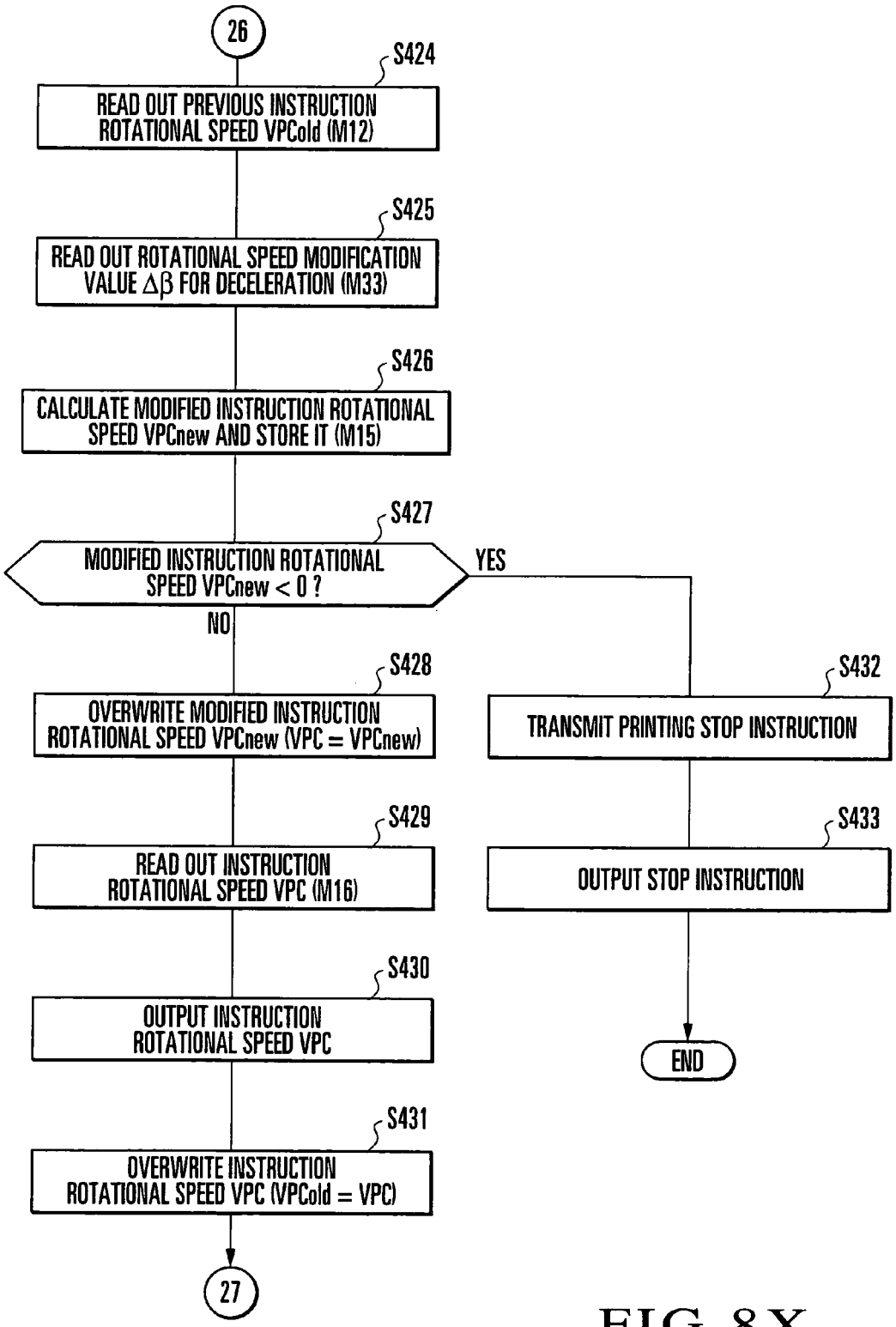

If the timer time T is equal to the control time interval TC (YES in step S411), the CPU 101 reads out the previous instruction rotational speed VPCold in the memory M12 and the rotational speed modification value Δβ for deceleration in the memory M33 (step S412; step S413 in FIG. 8W). The CPU 101 then subtracts the readout rotational speed modification value Δβ for deceleration from the previous instruction rotational speed VPCold to obtain a modified instruction rotational speed VPCnew (step S414). The CPU 101 then sets the modified instruction rotational speed VPCnew as the instruction rotational speed VPC (step S415) and outputs the instruction rotational speed VPC to the drive motor driver 114 (steps S416 and S417).

After outputting the instruction rotational speed VPC to the drive motor driver 114, the CPU 101 writes it in the memory M12 as the previous instruction rotational speed VPCold (step S418). Then, the CPU 101 causes the internal clock counter 121 to start counting the timer time T (steps S419 and S420) and compares the timer time T with the control time interval TC (steps S421 to S423). Every time the timer time T reaches the control time interval TC (YES in step S423), the CPU 101 decreases the speed of the printing press by Δβ (steps S424 to S431 in FIG. 8X).

When the modified instruction rotational speed VPCnew falls below 0 (YES in step S427), the CPU 101 transmits a printing stop instruction to the cylinder throw-on/off controller 200 of each printing unit (step S432) and outputs a stop instruction to the drive motor driver 114 (step S433). Thus, the printing press stops.

The processing operation of the CPU 201 of the cylinder throw-on/off controller 200 of each printing unit will be described hereinafter.

When a printing start instruction is transmitted from the controller 100 (YES in step S501, FIG. 9A), in step S502, the CPU 201 waits for the instruction rotational speed VMC of the cylinder throw-on/off motor and the current virtual rotation phase θMR' to be transmitted from the controller 100. In step S503, the CPU 201 waits for the printing stop instruction to be transmitted from the controller 100.

When the instruction rotational speed VMC of the cylinder throw-on/off motor and the current virtual rotation phase θMR' are transmitted from the controller 100 (YES in step S502), the CPU 201 receives them and stores the former in the memory M50 and the latter in the memory M51 (step S504).

Then, the CPU 201 reads the count of the rotation phase detection counter 220 of the cylinder throw-on/off motor (step S505) and obtains a current rotation phase θMR of the cylinder throw-on/off motor from the read count of the rotation phase detection counter 220 of the cylinder throw-on/off motor. The obtained current rotation phase θMR of the cylinder throw-on/off motor is stored in the memory M53.

Figure 9A:
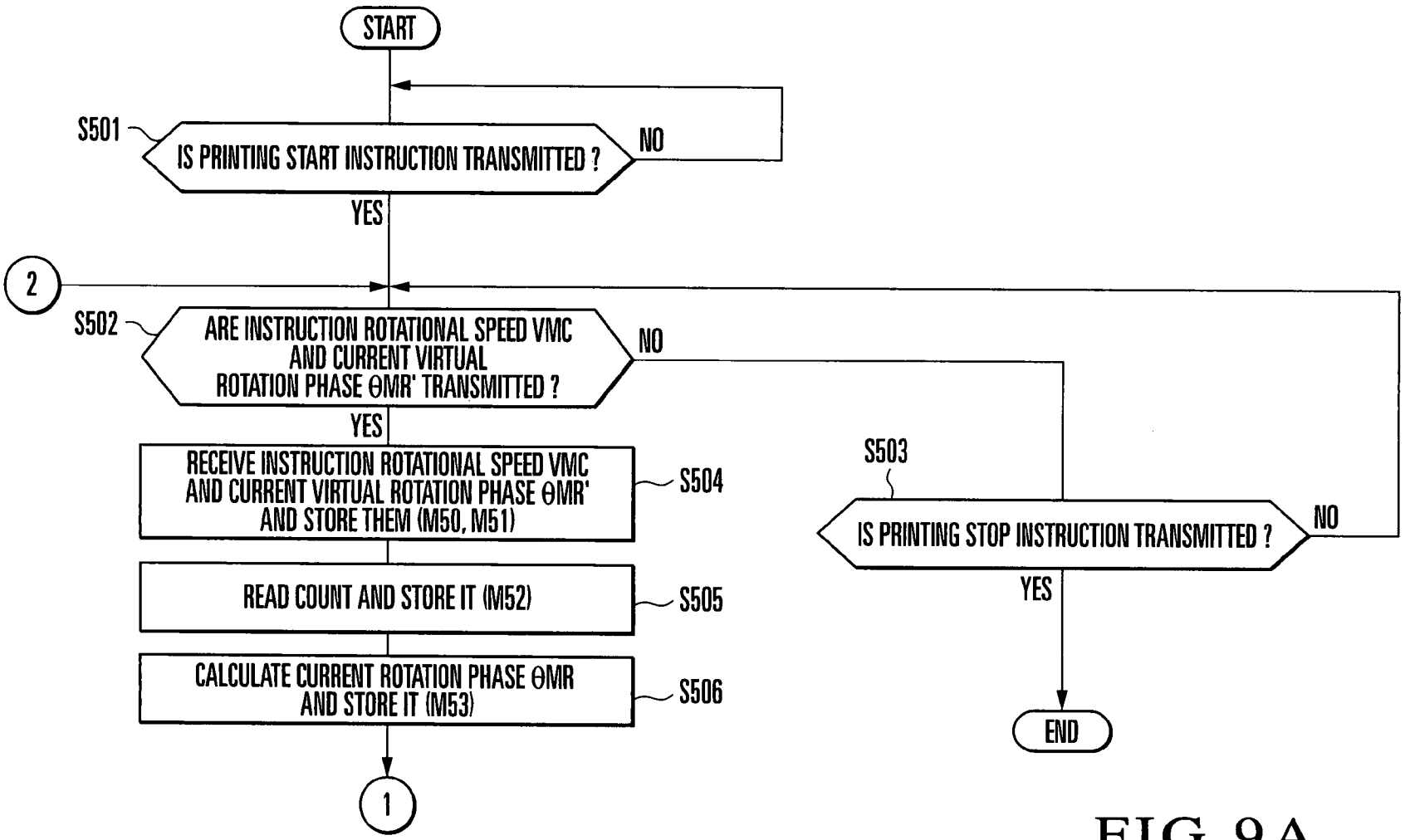
FIGS. 9A and 9B are flowcharts showing processing operation performed by the CPU of the cylinder throw-on/off controller shown in FIG. 6.
Figure 9B:
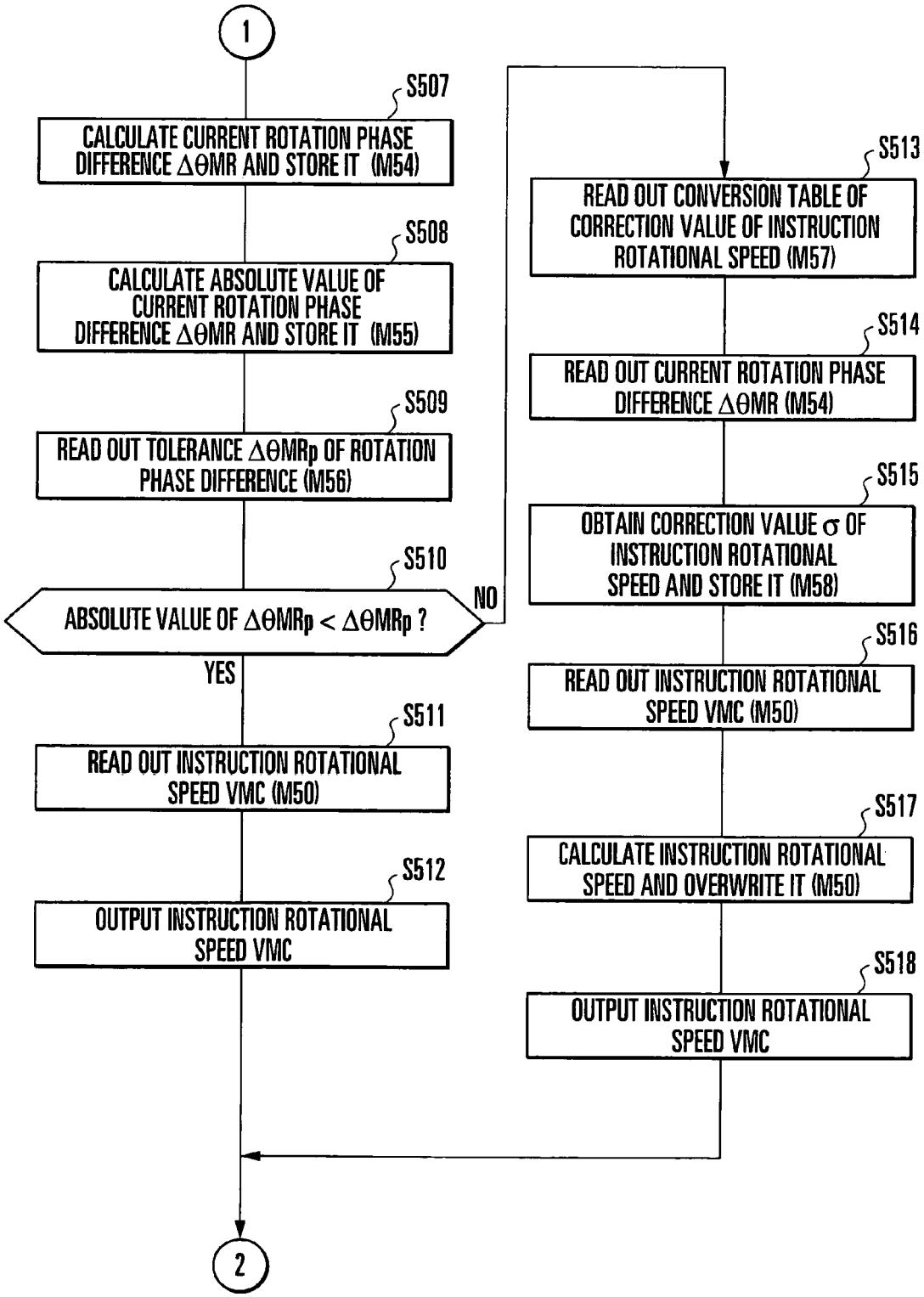

Then, the CPU 201 subtracts the current rotation phase θMR of the cylinder throw-on/off motor from the current virtual rotation phase θMR' of the cylinder throw-on/off motor to obtain a current rotation phase difference ΔθMR of the cylinder throw-on/off motor (step S507 in FIG. 9B). The obtained current rotation phase difference ΔθMR of the cylinder throw-on/off motor is stored in the memory M54.

The CPU 201 also obtains the absolute value of the current rotation phase difference ΔθMR of the cylinder throw-on/off motor from the current rotation phase difference ΔθMR of the cylinder throw-on/off motor (step S508). The obtained absolute value of the current rotation phase difference ΔθMR of the cylinder throw-on/off motor is stored in the memory M55.

Then, the CPU 201 reads out the tolerance ΔθMRp of the rotation phase difference of the cylinder throw-on/off motor in the memory M56 (step S509) and compares it with the absolute value of the current rotation phase difference ΔθMR of the cylinder throw-on/off motor (step S510).

If the absolute value of the current rotation phase difference ΔθMR of the cylinder throw-on/off motor is equal to or less than the tolerance ΔθMRp of the rotation phase difference of the cylinder throw-on/off motor (YES in step S510), the CPU 201 reads out the instruction rotational speed VMC of the cylinder throw-on/off motor from the memory M50 (step S511) and outputs it to the drive motor driver 218 of the cylinder throw-on/off motor.

If the absolute value of the current rotation phase difference ΔθMR of the cylinder throw-on/off motor exceeds the tolerance ΔθMRp of the rotation phase difference of the cylinder throw-on/off motor (NO in step S510), the CPU 201 reads out, from the memory M57, the conversion table for converting the current rotation phase difference of the cylinder throw-on/off motor into the correction value of the instruction rotational speed (step S513), and obtains a correction value σ of the instruction rotational speed of the cylinder throw-on/off motor corresponding to the current rotation phase difference ΔθMR of the cylinder throw-on/off motor from the conversion table for converting the current rotation phase difference of the cylinder throw-on/off motor into the correction value of the instruction rotational speed (steps S514 and S515). The obtained correction value σ of the instruction rotational speed of the cylinder throw-on/off motor is stored in the memory M58.

Then, the CPU 201 reads out the instruction rotational speed VMC of the cylinder throw-on/off motor from the memory M50 (step S516), adds the correction value σ of the instruction rotational speed of the cylinder throw-on/off motor which is obtained in step S514 to the readout instruction rotational speed VMC of the cylinder throw-on/off motor, overwrites the sum in the memory M50 as the instruction rotational speed VMC of the cylinder throw-on/off motor (step S517), and outputs the overwritten instruction rotational speed VMC of the cylinder throw-on/off motor to the drive motor driver 218 of the cylinder throw-on/off motor (step S518).

Figure 10A:
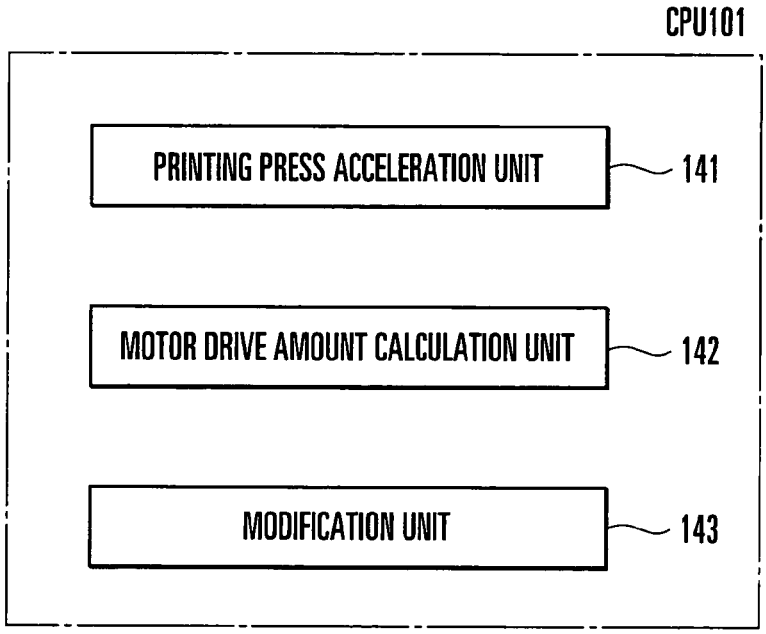
FIG. 10A is a functional block diagram of the CPU in accelerating the speed of the printing press.

The function of the CPU 101 in accelerating/decelerating the printing press speed will be described with reference to FIGS. 10A and 10B. In the printing press acceleration, as shown in FIG. 10A, the CPU 101 comprises a printing press acceleration unit 141, motor drive amount calculation unit 142, and modification unit 143. The printing press acceleration unit 141 performs the processes in steps S126 to S138, S140, S142 to S145, S151 to S155, S168 to S174, S176 to S180, S182 to S191, S193, and S220 to S222. The motor drive amount calculation unit 142 performs the processes in steps S185 to S217. The modification unit 143 performs the processes in steps S106 to S114 and S119 to S123. The modification unit 143 can be omitted.

Figure 10B:
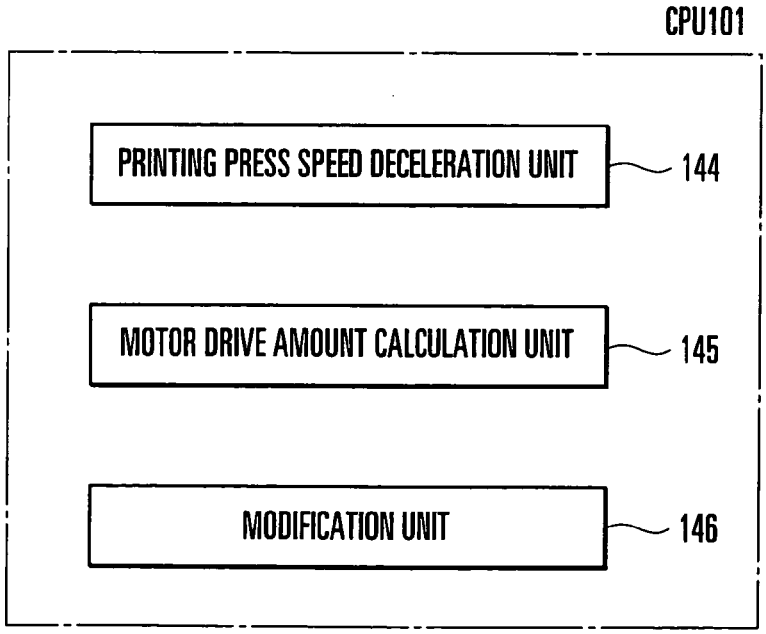
FIG. 10B is a functional block diagram of the CPU in decelerating the speed of the printing press.

In the printing press deceleration, as shown in FIG. 10B, the CPU 101 comprises a printing press speed deceleration unit 144 and modification unit 146. The printing press speed deceleration unit 144 performs the processes in steps S311 to S315, S325 to S331, S333 to S337, S339 to S348, S350 to S351, S379 to S380, S385 to S389, S395 to S401, S403 to S407, and S409 to S433. A motor drive amount calculation unit 145 performs the processes in steps S342 to S376. The modification unit 143 performs the processes in steps S106 to S111 and S115 to S123. The modification unit 146 can be omitted.

Second Embodiment

Figure 11:
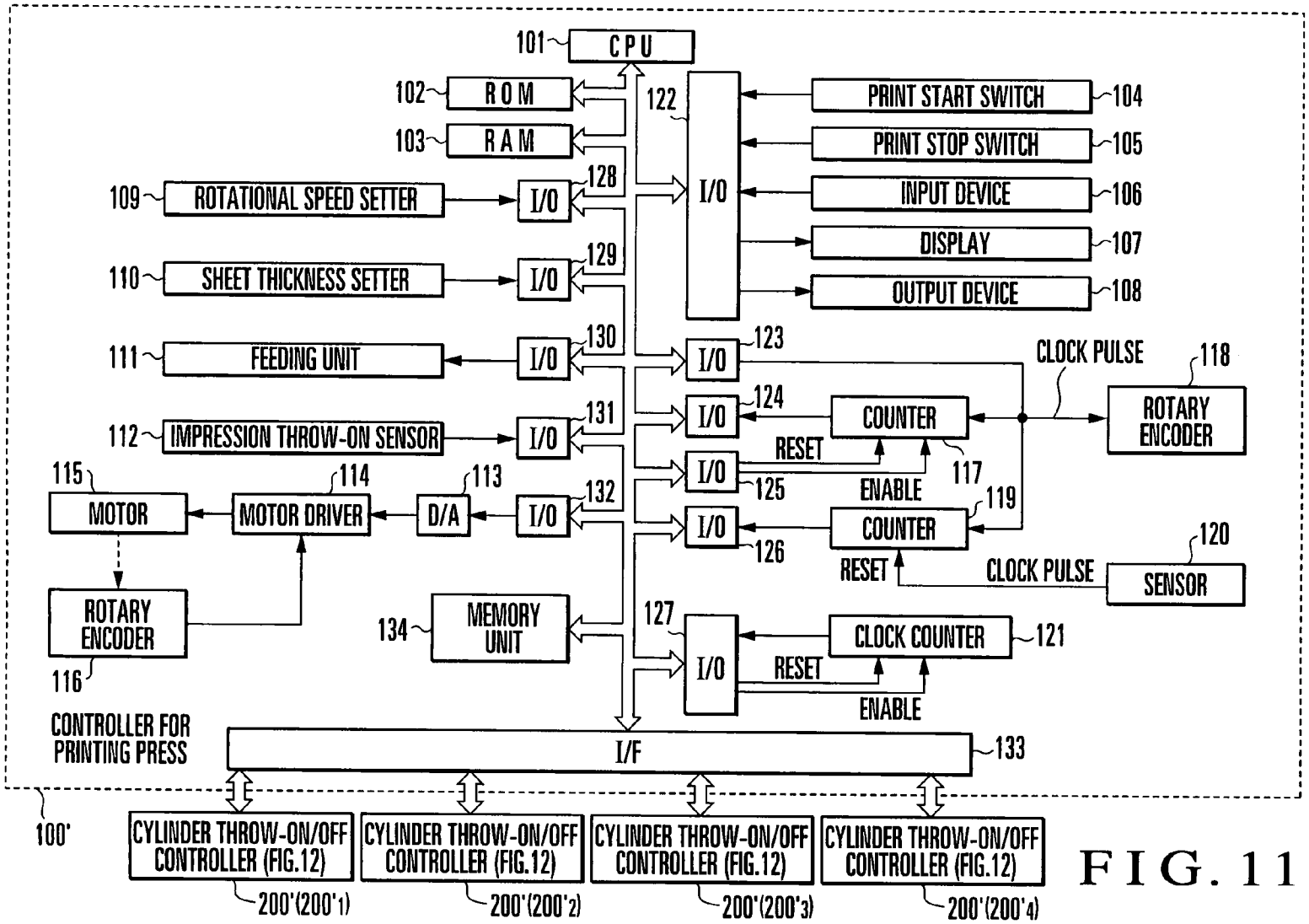
FIG. 11 is a block diagram of a cylinder throw-on/off apparatus for a printing press according to the second embodiment of the present invention.
Figure 12:
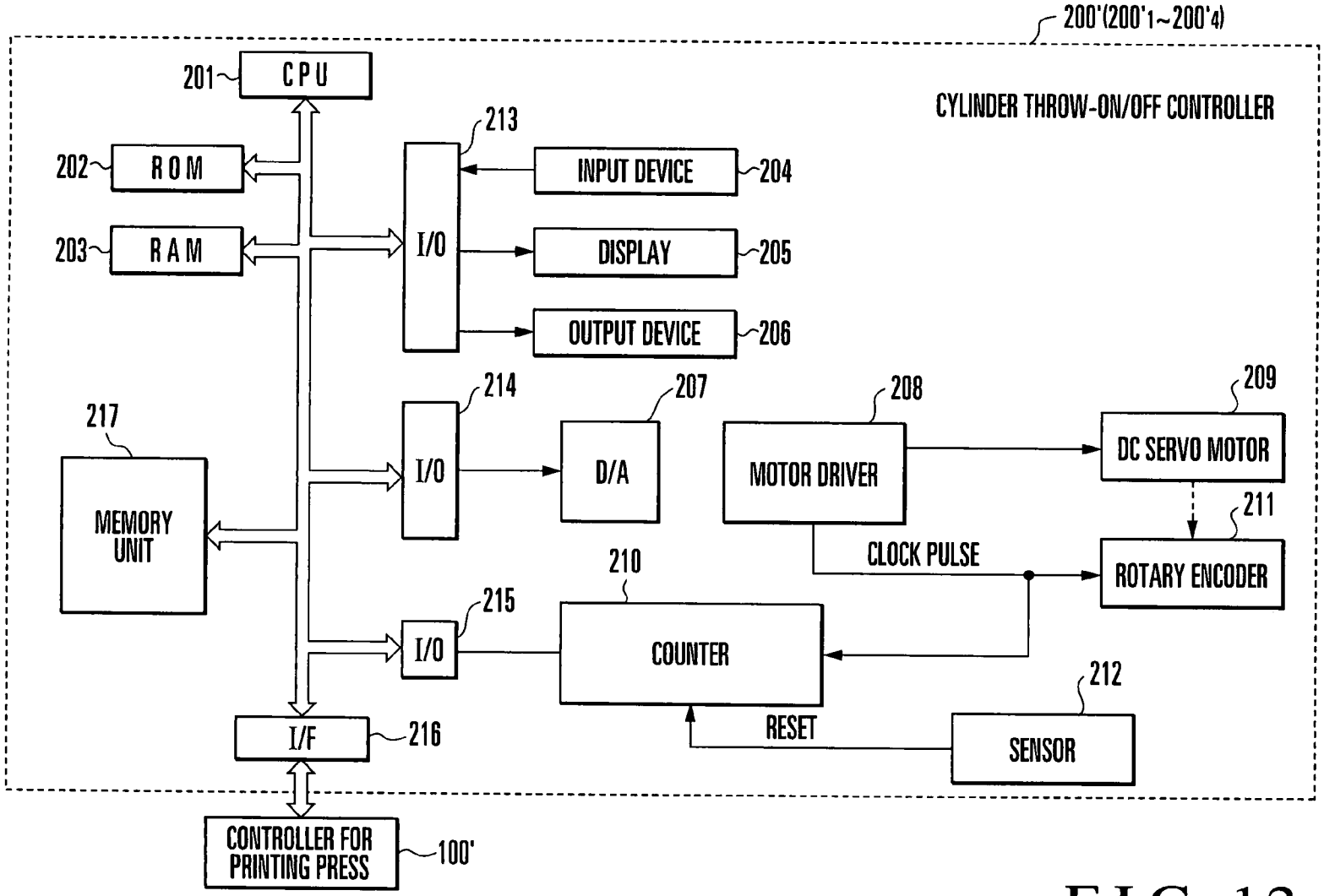
FIG. 12 is a block diagram of a cylinder throw-on/off controller of a printing unit shown in FIG. 11.

The second embodiment of the present invention will be described with reference to FIGS. 11 and 12.

The first embodiment described above uses a stepping motor as a cylinder throw-on/off motor. The second embodiment is different from the first embodiment in that it uses a DC servo motor as a cylinder throw-on/off motor. The basic configuration (FIG. 11) of a controller 100' is identical to that of the controller 100 in the first embodiment except that the content stored in a memory unit 134 is that of the DC servo motor.

When compared to FIG. 6, in a cylinder throw-on/off controller 200' (FIG. 12), a DC servo motor 209 is used as a cylinder throw-on/off motor in place of the stepping motor 219. A servo motor rotation phase detection counter 210 is used in place of the stepping motor rotation phase detection counter 220. A DC servo motor home position detection sensor 212 is used in place of the stepping motor home position detection sensor 221.

The content to be stored in the memory unit 217 is that of the DC servo motor, in the same manner as in the controller 100'. The processing operation of a CPU 101 of the controller 100' and that of a CPU 201 of the cylinder throw-on/off controller 200' are the same as those of the first embodiment, and accordingly a repetitive description will be omitted.

As has been described above, according to the present invention, impression throw-on is performed with an appropriate operation pattern to follow a change in speed of the printing press (the changing speed of the rotation phase). This can suppress an impact applied in impression throw-on and shortens the time taken until printing is started, thus improving the operation rate of the printing press.

What is claimed is:

1. A cylinder throw-on/off apparatus for a printing press, comprising:

at least one printing unit comprising a plate cylinder including a notch in an outer surface thereof, an impression cylinder including a notch in an outer surface thereof, and a blanket cylinder disposed between said plate cylinder and said impression cylinder and including a notch in an outer surface thereof;

a cylinder throw-on/off motor which is driven while the notch of said blanket cylinder opposes the notch of said plate cylinder to throw on/off said blanket cylinder with respect to said plate cylinder, and driven while the notch of said blanket cylinder opposes the notch of said impression cylinder to throw on/off said blanket cylinder with respect to said impression cylinder;

rotation phase detection means for detecting a rotation phase of said printing press;

accelerating means for accelerating said printing press to a predetermined printing speed;

throw-on operation control means for driving said cylinder throw-on/off motor, while the printing press is accelerating at a predetermined rate, to control throw-on operation of said blanket cylinder for said plate cylinder and said impression cylinder; and motor drive amount calculation means which, when controlling the throw-on operation of said blanket cylinder, calculates a drive amount of said cylinder throw-on/off motor, on the basis of a curve representing a predetermined relationship between the rotation phase of the printing press and the drive amount of the cylinder throw-on/off motor, the speed of the printing press undergoing a speed change at a predetermined rate relative to the predetermined printing speed without requiring a constant speed period, and the rotation phase thereof detected by said rotation phase detection means.

2. An apparatus according to claim 1, wherein said at least one printing unit comprises a plurality of printing units, and said motor drive amount calculation means obtains the drive amount of said cylinder throw-on/off motor for each of said plurality of printing units.

3. An apparatus according to claim 1, further comprising thickness setting means for setting a thickness of a printing target object to be printed by said printing press, and modification means for modifying a relationship between the rotation phase of said printing press which is used by said motor drive amount calculation means and the drive amount of said cylinder throw-on/off motor during the throw-on operation in accordance with the thickness of the printing target object set by said thickness setting means.

4. A cylinder throw-on/off apparatus for a printing press, comprising:

at least one printing unit comprising a plate cylinder including a notch in an outer surface thereof, an impression cylinder including a notch in an outer surface thereof, and a blanket cylinder disposed between said plate cylinder and said impression cylinder and including a notch in an outer surface thereof;

a cylinder throw-on/off motor which is driven while the notch of said blanket cylinder opposes the notch of said plate cylinder to throw on/off said blanket cylinder with respect to said plate cylinder, and driven while the notch of said blanket cylinder opposes the notch of said impression cylinder to throw on/off said blanket cylinder with respect to said impression cylinder;

rotation phase detection means for detecting a rotation phase of said printing press;

decelerating means for decelerating said printing press from a predetermined printing speed at which said printing press is currently operated until said printing press stops;

throw-off operation control means for driving said cylinder throw-on/off motor, while the printing press is decelerating at a predetermined rate form the predetermined printing speed without requiring a constant speed period, to control throw-off operation of said blanket cylinder from said plate cylinder and said impression cylinder; and motor drive amount calculation means which, when controlling the throw-off operation of said blanket cylinder, calculates a drive amount of said cylinder throw-on/off motor, on the basis of a curve representing a predetermined relationship between the rotation phase of the printing press and the drive amount of the cylinder throw-on/off motor, the speed of the printing press undergoing a speed change at a predetermined rate, and the rotation phase thereof detected by said rotation phase detection means.

5. An apparatus according to claim 4, wherein said at least one printing unit comprises a plurality of printing units, and said motor drive amount calculation means obtains the drive amount of said cylinder throw-on/off motor for each of said plurality of printing units.

6. An apparatus according to claim 4, further comprising thickness setting means for setting a thickness of a printing target object to be printed by said printing press, and modification means for modifying a relationship between the rotation phase of said printing press which is used by said motor drive amount calculation means and the drive amount of said cylinder throw-on/off motor during the throw-off operation in accordance with the thickness of the printing target object set by said thickness setting means.

7. A cylinder throw-on/off method for a printing press comprising at least one printing unit comprising a plate cylinder including a notch in an outer surface thereof, an impression cylinder including a notch in an outer surface thereof, and a blanket cylinder disposed between the plate cylinder and the impression cylinder and including a notch in an outer surface thereof, and a cylinder throw-on/off motor which throws on/off the blanket cylinder with respect to the plate cylinder and the impression cylinder, said method comprising the steps of:

detecting a rotation phase of the printing press;

accelerating the printing press to a predetermined printing speed, driving the cylinder throw-on/off motor, while the printing press is accelerating at a predetermined rate, to perform control to throw the blanket cylinder onto the plate cylinder while the notch of the blanket cylinder opposes the notch of the plate cylinder, and throw the blanket cylinder onto the impression cylinder while the notch of the blanket cylinder opposes the notch of the impression cylinder, and calculating, when controlling the throw-on operation of said blanket cylinder, a drive amount of the cylinder throw-on/off motor, on the basis of a curve representing a predetermined relationship between the rotation phase of the printing press and the drive amount of the cylinder throw-on/off motor, the speed of the printing press undergoing a speed change at a predetermined rate relative to the predetermined printing speed without requiring a constant speed period, and the rotation phase thereof detected by said rotation phase detection means.

8. A method according to claim 7, wherein the at least one printing unit comprises a plurality of printing units, and the step of calculating the drive amount comprises the step of calculating a drive amount of the cylinder throw-on/off motor for each of the plurality of printing units.

9. A method according to claim 7, further comprising the steps of setting a thickness of a printing target object to be printed by the printing press, and modifying a relationship between the rotation phase of the printing press and the drive amount of the cylinder throw-on/off motor during the throw-on operation in accordance with the preset thickness of the printing target object.

10. A cylinder throw-on/off method for a printing press comprising at least one printing unit comprising a plate cylinder including a notch in an outer surface thereof, an impression cylinder including a notch in an outer surface thereof, and a blanket cylinder disposed between the plate cylinder and the impression cylinder and including a notch in an outer surface thereof, and a cylinder throw-on/off motor which throws on/off the blanket cylinder with respect to the plate cylinder and the impression cylinder, said method comprising the steps of:

detecting a rotation phase of the printing press;

decelerating the printing press from a predetermined printing speed at which the printing press is currently operated until the printing press stops, driving the cylinder throw-on/off motor, while the printing press is decelerating at a predetermined rate, to perform control to throw off the blanket cylinder from the plate cylinder while the notch of the blanket cylinder opposes the notch of the plate cylinder, and throw off the blanket cylinder from the impression cylinder while the notch of the blanket cylinder opposes the notch of the impression cylinder, and calculating, when controlling the throw-off operation of said blanket cylinder, a drive amount of the cylinder throw-on/off motor, on the basis of a curve representing a predetermined relationship between the rotation phase of the printing press and the drive amount of the cylinder throw-on/off motor, the speed of the printing press undergoing a speed change at a predetermined rate from the predetermined printing speed without requiring a constant speed period, and the rotation phase thereof detected by said rotation phase detection means.

11. A method according to claim 10, wherein the at least one printing unit comprises a plurality of printing units, and the step of calculating the drive amount comprises the step of calculating a drive amount of the cylinder throw-on/off motor for each of the plurality of printing units.

12. A method according to claim 10, further comprising the steps of setting a thickness of a printing target object to be printed by the printing press, and modifying a relationship between the rotation phase of the printing press and the drive amount of the cylinder throw-on/off motor during the throw-off operation in accordance with the preset thickness of the printing target object.

* * * * *

UNITED STATES PATENT AND TRADEMARK OFFICE

CERTIFICATE OF CORRECTION

PATENT NO. : 8,720,332 B2
APPLICATION NO. : 12/283879
DATED : May 13, 2014
INVENTOR(S) : Toshiyuki Sato and Toshihiro Kobashi It is certified that error appears in the above-identified patent and that said Letters Patent is hereby corrected as shown below:

In the Claims

Column 27, Claim 4, line 66, delete “form” and insert --from--.

Signed and Sealed this
Sixteenth Day of December, 2014

Michelle K. Lee

Michelle K. Lee
*Deputy Director of the United States Patent and Trademark Office*